US012758038B2

(12) United States Patent
Youngblood et al.

(10) Patent No.: US 12,758,038 B2
(45) Date of Patent: Oct. 13, 2026

(54) MULTI-ZONE TEMPERATURE MODULATION SYSTEM FOR BED OR BLANKET

(71) Applicant: Sleep Solutions Inc., Wilmington, DE (US)

(72) Inventors: Tara Youngblood, Mooresville, NC (US); Todd Youngblood, Mooresville, NC (US); Matthew Holling, Mooresville, NC (US)

(73) Assignee: Sleep Solutions Inc., Wilmington, DE (US)

( * ) Notice: Subject to any disclaimer, the term of this patent is extended or adjusted under 35 U.S.C. 154(b) by 919 days.

(21) Appl. No.: 17/702,436

(22) Filed: Mar. 23, 2022

(65) Prior Publication Data

US 2022/0304486 A1 Sep. 29, 2022

Related U.S. Application Data

(60) Provisional application No. 63/166,590, filed on Mar. 26, 2021.

(51) Int. Cl.

| | |
|---|---|
| ***A47G 9/02*** | (2006.01) |
| ***A47C 21/04*** | (2006.01) |
| ***F24H 1/10*** | (2022.01) |
| ***F25B 21/04*** | (2006.01) |

(52) U.S. Cl.

CPC ..... *A47G 9/0215* (2013.01); *A47C 21/044* (2013.01); *A47C 21/048* (2013.01); *F24H 1/101* (2013.01); *F25B 21/04* (2013.01)

(58) Field of Classification Search

CPC ..... A47C 21/044; A47C 21/04; A47C 21/048; F25B 21/02; F25B 2321/0251; F25B 2321/0252; F25B 21/04; F25B 2321/021; F25B 2321/0211; F25B 2321/0212; F25B 2321/023

See application file for complete search history.

(56) References Cited

U.S. PATENT DOCUMENTS

| | | | |
|---|---|---|---|
| 5,448,788 | A | 9/1995 | Wu |
| 6,463,743 | B1 | 10/2002 | Laliberté |
| 7,041,049 | B1 | 5/2006 | Raniere |
| 7,382,047 | B2 | 6/2008 | Chen et al. |
| 7,460,899 | B2 | 12/2008 | Almen |
| 7,524,279 | B2 | 4/2009 | Auphan |

(Continued)

FOREIGN PATENT DOCUMENTS

| | | | | |
|---|---|---|---|---|
| FR | 2793007 | A1 * | 11/2000 | ..... B67D 1/0869 |
| KR | 20170000492 | A * | 1/2017 | ..... A47C 21/044 |

*Primary Examiner* — Miguel A Diaz

(74) *Attorney, Agent, or Firm* — Cozen O'Connor

(57) ABSTRACT

A temperature modulation system for a bed, blanket, or other furniture includes a fluid for moderating temperature change, a number of conduit circuits for directing the fluid through respective zones, a control unit including a thermoelectric device for modulating temperature of the fluid, and a pump. Each of the conduit circuits selectively and independently directs fluid through its respective zone in order to produce a temperature within the zone that is independent of the temperature outside the zone. The system also includes an arrangement of one or more zones in an arrangement in which the control unit is programmed to vary the zone temperature over time according to a schedule.

15 Claims, 64 Drawing Sheets

(56) References Cited

U.S. PATENT DOCUMENTS

| | | | |
|---|---|---|---|
| 7,546,653 | B2 | 6/2009 | Ye |
| 7,608,041 | B2 | 10/2009 | Sutton |
| 7,699,785 | B2 | 4/2010 | Nemoto |
| 7,868,757 | B2 | 1/2011 | Radivojevic et al. |
| 7,908,687 | B2 | 3/2011 | Ward et al. |
| 8,179,270 | B2 | 5/2012 | Rai et al. |
| 8,290,596 | B2 | 10/2012 | Wei et al. |
| 8,348,840 | B2 | 1/2013 | Heit et al. |
| 8,529,457 | B2 | 9/2013 | Devot et al. |
| 8,768,520 | B2 | 7/2014 | Oexman et al. |
| 9,044,101 | B2 | 6/2015 | Garcia et al. |
| 9,186,479 | B1 | 11/2015 | Franceschetti et al. |
| 9,459,597 | B2 | 10/2016 | Kahn et al. |
| 9,750,415 | B2 | 9/2017 | Breslow et al. |
| 10,368,797 | B2 | 8/2019 | Huang |
| 10,376,670 | B2 | 8/2019 | Shouldice et al. |
| 10,599,116 | B2 | 3/2020 | Pillai et al. |
| 2006/0053558 | A1 | 3/2006 | Ye |
| 2006/0293602 | A1 | 12/2006 | Clark |
| 2006/0293608 | A1 | 12/2006 | Rothman et al. |
| 2007/0234741 | A1 | 10/2007 | Lee et al. |
| 2008/0234785 | A1 | 9/2008 | Nakayama et al. |
| 2009/0112069 | A1 | 4/2009 | Kanamori et al. |
| 2010/0100004 | A1 | 4/2010 | Someren |
| 2010/0293715 | A1 | 11/2010 | Sakamoto et al. |
| 2011/0015495 | A1 | 1/2011 | Dothie et al. |
| 2011/0230790 | A1 | 9/2011 | Kozlov |
| 2011/0267196 | A1 | 11/2011 | Hu et al. |
| 2012/0296402 | A1 | 11/2012 | Kotter |
| 2014/0277308 | A1 | 9/2014 | Cronise et al. |
| 2016/0029808 | A1* | 2/2016 | Youngblood ..... F25D 29/00 62/3.2 |
| 2016/0136385 | A1* | 5/2016 | Scorcioni ..... A61B 5/4812 600/26 |
| 2017/0138663 | A1 | 5/2017 | Wells |
| 2017/0231812 | A1 | 8/2017 | Boyden et al. |
| 2018/0110960 | A1* | 4/2018 | Youngblood ..... A47C 21/048 |
| 2018/0344517 | A1 | 12/2018 | Nofzinger |
| 2019/0203983 | A1 | 7/2019 | Jeon et al. |

* cited by examiner

MULTI-ZONE TEMPERATURE MODULATION SYSTEM FOR BED OR BLANKET

CROSS REFERENCE TO RELATED APPLICATIONS

This application relates to and claims priority from the following applications. This application claims the benefit of U.S. Provisional Patent Application No. 63/166,590, filed Mar. 26, 2021, which is incorporated herein by reference in its entirety.

BACKGROUND OF THE INVENTION

1. Field of the Invention

The present invention relates generally to heating and cooling systems for bed mattresses, blankets, and other furniture, and more specifically to a control unit for a temperature modulation system operable to perform thermoelectric heating or cooling of a fluid.

2. Background of the Invention

It is generally known in the prior art to provide a temperature-conditioned surface. It is desirable to control the temperature of a bed or other piece of furniture that supports a person, such as when sleeping. Such control has therapeutic value in treating symptoms of menopause or conditions of hypothermia or hyperthermia, particularly when those conditions manifest themselves over a long period of time. Therapeutic value is also seen for individuals who have circulatory disorders, sleep disorders, and other conditions that are improved by increasing the comfort felt during sleep. Such control is desirable even outside the therapeutic value of cooling or heating a surface (e.g., mattress), simply to match the personal comfort preferences of healthy individuals, to promote higher quality sleep, or to provide localized control when a more general control (e.g., heating or air conditioning of a sleeping space) is unavailable or when adjustments to the general control might cause others discomfort or are inefficient from an energy consumption perspective.

Various methods of temperature control are known, including such classic systems as electric blankets or heating pads, as well as more recent developments that involve the circulation of a heated or cooled fluid through a mattress, such as directing air through the chambers of an air mattress or directing air or a fluid through a tube that is embedded within a mattress or a mattress pad. The more advanced of these systems utilize a heat source or sink (i.e., cooling source) to heat or cool a reservoir of fluid to a selected target temperature and pump the heated or cooled fluid through the available conduit, relying on principles of heat exchange to control the surface temperature.

Prior art patent documents include the following:

U.S. Pat. No. 7,908,687 for Device for temperature conditioning an air supply by inventors Ward et al., filed Feb. 15, 2007 and issued Mar. 22, 2011, discloses a heating and cooling device for temperature conditioning an air supply for an air conditioned appliance, said heating/cooling device comprising: a first air passage for channeling a first air flow; a second air passage for channeling a second air flow; an inlet fan for drawing air into said first, air passage; an exhaust fan for drawing air through said second air passage; one or a plurality of heat exchangers for exchanging heat between air in said first air passage and air in said second exhaust air passage; wherein said first air passage comprises a tubular channel having an inlet at a first end and only one outlet, said outlet being at a second end of said passage, and said inlet fan is positioned at said inlet, such that said first air flow is channeled through said inlet fan, along the whole of said air passage, encountering all of said one or plurality of heat exchangers, and out of said outlet.

U.S. Pat. No. 7,546,653 for Air mattress by inventor Ye, filed Aug. 23, 2005 and issued Jun. 16, 2009, discloses an air mattress including a mattress envelope having a compartment and comprising a thermal functional layer and an outer layer overlapped thereon and an air cushion including a plurality of individual air chambers evenly disposed in the compartment of the mattress envelope and an air supplying tube communicatively interconnecting the air chamber with each other. A thermal control arrangement includes a liquid supplying tube spirally extending at the thermal functional layer of the mattress envelope for guiding a flow of thermal liquid and a thermal energy generator arranged to regulate a temperature of the thermal liquid such that when the thermal liquid passes through the liquid supplying tube, the thermal liquid thermo-communicating with the thermal functional layer of the mattress envelope towards the outer layer so as to regulate a temperature of the mattress envelope.

U.S. Patent Publication No. 2007/0234741 for Heat radiator having a thermo-electric cooler and multiple heat radiation modules and the method of the same by inventors Lee et al., filed Apr. 11, 2006 and published Oct. 11, 2007, discloses a heat radiator having a thermo-electric cooler and multiple heat radiation modules and the method of the same is capable of applying forced heat conduction on a hot spot on a computer circuit through a plurality of conduction paths. The heat radiator comprises a first heat radiation module with a heat sink simultaneously attached to the hot spot and the thermo-electric cooler and a second radiation module with a heat sink attached on the thermo-electric cooler only, whereby the heat generated in a heat source, such as a central processing unit (CPU) and an accelerated graphic chip, and delivered from the heat absorption terminal to the heat release terminal of the cooler can be dissipated efficiently. The first heat radiation module and the second radiation module further respectively include a first and a second radiating fin sets.

U.S. Patent Publication No. 2019/0203983 for Cooling apparatus using thermoelectric modules by inventors Jeon et al., filed Mar. 30, 2018 and published Jul. 4, 2019, discloses a cooling apparatus using thermoelectric modules. The cooling apparatus includes a cooling container, a first thermoelectric module contacting the cooling container at a first position, and a first heat dissipating module contacting the first thermoelectric module. The first heat dissipating module includes a loop heat pipe including a first evaporation unit contacting the first thermoelectric module and provided with a wick structure located therein, a first condensation unit located at the outside of the cooling container, a first vapor pipe line configured to interconnect one side of the first evaporation unit and one side of the first condensation unit such that gas is placed therein, and a first liquid pipe line configured to interconnect the other side of the first evaporation unit and the other side of the first condensation unit such that a working fluid is placed therein.

U.S. Patent Publication No. 2017/0138663 for Beverage cooling system by inventor Wells, filed May 13, 2016 and published May 18, 2017, discloses various systems, processes, and techniques may be used for cooling beverages. In one general implementation, a beverage cooling system may include a pump, a cooling subsystem, and a control subsystem. The pump may circulate a coolant that is used to keep a beverage in a python cool, the cooling subsystem may extract heat from the coolant to keep it cool, and the control subsystem may monitor the coolant temperature and control the cooling subsystem. The cooling subsystem may include a cooling block, a thermoelectric cooler, a heat distributor, a heat pipe assembly, a fin assembly, and a fan. The cooling block may be adapted to receive the coolant and receive heat therefrom. The thermoelectric cooler may be thermally coupled to one side of the cooling block and adapted to extract heat from the cooling block.

U.S. Pat. No. 6,463,743 for modular thermoelectric unit and cooling system using same by inventor Laliberte, filed Mar. 12, 2002 and issued Oct. 15, 2002, discloses a modular thermoelectric cooling/heating unit installed through an opening in a wall separating first and second temperature zones. This modular thermoelectric cooling/heating unit comprises a thermoelectric device including a cold surface, a hot surface, and a cooling/heating member between an electrical power supply and the cold and hot surfaces. A heat conducting block has a proximal end for thermally contacting with a first one of the cold and hot surfaces, and a distal end. A first heatsink thermally contacts with a second one of the cold and hot surfaces, a second heatsink thermally contacts with the distal end of the heat conducting block, and a thermally insulated housing covers at least a portion of the heat conducting block between the proximal and distal ends of this block. In operation, the first heatsink is located in the first temperature zone, at least a portion of the heat conducting block and the thermally insulated housing extend through the wall opening, and the second heatsink is located in the second temperature zone. The above described modular thermoelectric cooling/heating unit can be used in a modular cooling system for retrofit into an existing refrigeration unit.

U.S. Pat. No. 7,382,047 for Heat dissipation device by inventors Chen et al., filed Dec. 27, 2005 and issued June 3, 2008, discloses a heat dissipation device (1) including a heat sink (10), a fan (20), and a cooling member (30). The heat sink includes a base, a plurality of fins extending from the base and at least one heat pipe thermally connecting the base and the fins. The cooling member is provided with a fin assembly thereon and includes a cold surface attached to one side of the fins and a condensing portion of the at least one heat pipe to make the one side of the fins and the condensing portion have a lower temperature.

U.S. Patent Publication No. 2010/0293715 for Temperature-controlled air circulation type bedding by inventors Sakamoto et al., filed Oct. 21, 2008 and published Nov. 25, 2010, discloses temperature-controlled air circulation type bedding which introduces the blowoff air generated by temperature control unit into an air flow passage provided around a bedding body so as to cool or warm the body of a person in the bedding, controls the blowoff air temperature to form a comfortable sleeping environment irrespective of an external atmosphere temperature, suppresses discharge of carbon dioxide gas, etc. with a compact configuration, and has low power consumption. The temperature-controlled air circulation type bedding includes a temperature control unit 2 which controls the blowoff air temperature by a cooling or heating action, and a bedding body 3 which provides an air flow passage 27 which allows the blowoff air from the temperature control unit to be introduced and circulated therethrough, and cools or warms the inside thereof. The temperature of air which circulates through the bedding is detected so that the temperature of the blowoff air is controlled by the temperature control unit.

U.S. Pat. No. 5,448,788 for Thermoelectric cooling-heating mattress by inventor Wu, filed Mar. 8, 1994 and issued Sep. 12, 1995, discloses a thermostat controlled mattress including a mattress unit having an underlay, a surface cover and a curved circuit. A water circuit tube connects to the curved circuit so as to allow water to be introduced into the mattress unit with the aid of a pump. Water is circulated between the mattress unit and a water storage box via the water circuit tube. A sensor is operatively arranged with respect to the water storage box to sense the temperature and quantity of water contained in the water storage box and sends a signal to a thermostat electric circuit. An aluminum reservoir for the water is connected to the curved circuit of the mattress unit and the water circuit tube. A thermoelectric element is connected to the reservoir and the power supply to heat or cool the water. Water is circulated in the water circuit tube between the curved circuit of the mattress unit and the water storage box, through the reservoir. The water temperature is controlled based on signals generated by the thermostat electric circuit, which activates the power supply operatively connected to the thermoelectric element. A heat sink and a fan may be arranged adjacent to the thermoelectric element such that the fan blows a current of air onto the heat sink.

U.S. Pat. No. 9,044,101 for Climate controlled sleeping space by inventors Garcia et al., filed Mar. 13, 2013 and issued Jun. 2, 2015, discloses an apparatus including a frame forming a sleeping space. The apparatus includes a climate control system connected to the frame, the climate control system having a hot side and a cold side, wherein the cold side is positioned toward the sleeping space. The apparatus includes an insulating canopy supported by the frame. The insulating canopy includes an outer layer, a separator layer, a reflective layer, and an inner layer. The separator layer provides an air cavity that reduces conductive heat transfer between the surface layer and the reflective layer.

U.S. Pat. No. 7,041,049 for Sleep guidance system and related methods by inventor Raniere, filed Nov. 21, 2003 and issued May 9, 2006, discloses a sleep efficiency monitor and methods for pacing and leading a sleeper through an optimal sleep pattern. Embodiments of the present invention include a physiological characteristic monitor for monitoring the sleep stages of a sleeper, a sensory stimulus generator for generating stimulus to affect the sleep stages of a sleeper, and a processor for determining what sleep stage the sleeper is in and what sensory stimulus is needed to cause the sleeper to move to another sleep stage. A personalized sleep profile may also be established for the sleeper and sleep guided in accordance with the profile parameters to optimize a sleep session. By providing sensory stimulus to a sleeper, the sleeper may be guided through the various sleep stages in an optimal pattern so that the sleeper awakens refreshed even if sleep is disrupted during the night or the sleeper's allotted sleep period is different than usual. Embodiments of the invention also involve calibration of the sleep guidance system to a particular sleeper.

U.S. Patent Publication No. 2006/0293602 for Sleep management device by inventor Clark, filed Apr. 8, 2004 and published Dec. 28, 2006, discloses a short sleep/nap management apparatus and method. The apparatus has sensor means to detect one or more physiological parameters associated with a transition in sleep stages from wakefulness, processing means to process the parameters to determine when the transition is reached and start the timer to run for a predetermined period, and alarm means to actuate at the end of said predetermined period to awaken the user.

U.S. Patent Publication No. 2006/0293608 for Device for and method of predicting a user's sleep state by inventors Rothman et al., filed Feb. 28, 2005 and published Dec. 28, 2006, discloses to a device and a method for waking a user in a desired sleep state. The device may predict an occurrence when the user will be in the desired sleep state, such as light sleep, and wake the user during that predicted occurrence. In one embodiment, a user may set a wake-up time representing the latest possible time that the user would like to be awakened. The occurrence closest to the wake-up time when the user will be in light sleep may be predicted, thereby allowing the user to sleep as long as possible, while awakening in light sleep. To predict when the user will be in the desired sleep state, the user's sleep state may be monitored during the night or sleep experience and the monitored information may be used in predicting when the user will be in the desired sleep state.

U.S. Patent Publication No. 2008/0234785 for Sleep controlling apparatus and method, and computer program product thereof by inventors Nakayama et al., filed Sep. 13, 2007 and published Sep. 25, 2008, discloses a sleep controlling apparatus that includes a measuring unit that measures biological information of a subject; a first detecting unit that detects a sleeping state of the subject selected from the group consisting of a falling asleep state, a REM sleep state, a light non-REM sleep state and a deep non-REM sleep state, based on the biological information measured by the measuring unit; a first stimulating unit that applies a first stimulus of an intensity lower than a predetermined threshold value to the subject when the light non-REM sleep state is detected by the first detecting unit; and a second stimulating unit that applies a second stimulus of an intensity higher than the first stimulus after the first stimulus is applied to the subject.

U.S. Pat. No. 7,460,899 for Apparatus and method for monitoring heart rate variability by inventor Almen, filed Feb. 25, 2005 and issued Dec. 2, 2008, discloses a wrist-worn or arm band worn heart rate variability monitor. Heart rate variability ("HRV") refers to the variability of the time interval between heartbeats and is a reflection of an individual's current health status. Over time, an individual may use the results of HRV tests to monitor either improvement or deterioration of specific health issues. Thus, one use of the HRV test is as a medical motivator. When an individual has a poor HRV result, it is an indicator that they should consult their physician and make appropriate changes where applicable to improve their health. If an individual's HRV results deviate significantly from their normal HRV, they may be motivated to consult their physician. In addition, the inventive monitor is capable of monitoring the stages of sleep by changes in the heart rate variability and can record the sleep (or rest) sessions with the resulting data accessible by the user or other interested parties. Alternate embodiments of the invention allow assistance in the diagnosis and monitoring of various cardiovascular and sleep breathing disorders and/or conditions. Other embodiments allow communication with internal devices such as defibrillators or drug delivery mechanisms. Still other embodiments analyze HRV data to assist the user in avoiding sleep.

U.S. Pat. No. 7,524,279 for Sleep and environment control method and system by inventor Auphan, filed Dec. 29, 2004 and issued Apr. 28, 2009, discloses a sleep system that includes sensors capable of gathering sleep data from a person and environmental data during a sleep by the person. A processor executes instructions that analyze this data and control the sleep of the person and the environment surrounding the person. Typically, the instructions are loaded in a memory where they execute to generate an objective measure of sleep quality from the sleep data from the person and gather environmental data during the sleep by the person. Upon execution, the instructions receive a subjective measure of sleep quality from the person after the sleep, create a sleep quality index from the objective measure of sleep quality and subjective measure of sleep quality, correlate the sleep quality index and a current sleep system setting with a historical sleep quality index and corresponding historical sleep system settings. The instructions then may modify the current set of sleep system settings depending on the correlation between the sleep quality index and the historic sleep quality index. These sleep system settings control and potentially change one or more different elements of an environment associated with the sleep system.

U.S. Patent Publication No. 2009/0112069 for Trend prediction device by inventors Kanamori et al., filed Sep. 25, 2008 and published Apr. 30, 2009, discloses a trend prediction device that is versatile and capable of improving the accuracy of predicting a trend in a user's physical condition. The trend prediction device includes: a sensor-data converter configured to convert sensor data detected by a sleep sensor into a sleep-related parameter for making a physical-data-trend judgment; a parameter acquisition unit configured to acquire a lifestyle-related parameter that indicates an action of the user during a non-sleeping period, and possibly changing the physical-data trend; and a parameter comparator configured to compare the sleep-related and the lifestyle-related parameters with respective reference parameters. The trend prediction device is configured to judge whether the physical data has an increase or a decrease in trend on the basis of the comparison result of the sleep-related and the lifestyle-related parameters with their respective reference parameters.

U.S. Pat. No. 7,608,041 for Monitoring and control of sleep cycles by inventor Sutton, filed Apr. 20, 2007 and issued Oct. 27, 2009, discloses a system including: a monitor for monitoring a user's sleep cycles; a processor which counts the sleep cycles to provide a sleep cycle count and which selects an awakening time according to a decision algorithm including the sleep cycle count as an input; and an alarm for awakening the user at the awakening time. Use of the sleep cycle count as an input to the decision algorithm advantageously enables a user to more fully control and optimize his or her personal sleeping behavior.

U.S. Pat. No. 7,699,785 for Method for determining sleep stages by inventor Nemoto, filed Feb. 23, 2005 and issued Apr. 20, 2010, discloses a method for determining sleep stages of an examinee, including detecting signals of the examinee with a biosignal detector, calculating a signal strength deviation value that indicates deviation of a signal strength of the detected signals, and determining a sleep stage by using the signal strength deviation value or a value of a plurality of values based on the signal strength deviation value as an indicator value.

U.S. Patent Publication No. 2010/0100004 for Skin temperature measurement in monitoring and control of sleep and alertness by inventor van Someren, filed Dec. 15, 2008 and published Apr. 22, 2010, discloses a method of an arrangement for monitoring sleep in a subject by measuring within a prescribed interval skin temperature of a predetermined region of the subject's body and a motion sensor for sensing motion of the subject, comparing the measured skin temperature of the predetermined region with a predetermined temperature threshold, and classifying the subject as being asleep or awake based on whether the skin temperature of the predetermined region is above or below the temperature threshold and on the motion data. In alternative aspects the invention relates to methods of and arrangements for manipulating sleep, as well as monitoring or manipulating alertness.

U.S. Pat. No. 7,868,757 for Method for the monitoring of sleep using an electronic device by inventors Radivojevic et al., filed Dec. 29, 2006 and issued Jan. 11, 2011, discloses a method where sleep sensor signals are obtained to a mobile communication device from sensor devices. The mobile communication device checks the sleep sensor signals for a sleep state transition, determines the type of the sleep state transition, forms control signals based on the type of the sleep state transition and sends the control signals to at least one electronic device.

U.S. Patent Publication No. 2011/0015495 for Method and system for managing a user's sleep by inventors Dothie et al., filed Jul. 16, 2010 and published Jan. 20, 2011, discloses a sleep management method and system for improving the quality of sleep of a user which monitors one or more objective parameters relevant to sleep quality of the user when in bed and receives from the user in waking hours via a portable device such as a mobile phone feedback from objective test data on cognitive and/or psychomotor performance.

U.S. Patent Publication No. 2011/0230790 for Method and system for sleep monitoring, regulation and planning by inventor Kozlov, filed Mar. 27, 2010 and published Sep. 22, 2011, discloses a method for operating a sleep phase actigraphy synchronized alarm clock that communicates with a remote sleep database, such as an internet server database, and compares user physiological parameters, sleep settings, and actigraphy data with a large database that may include data collected from a large number of other users with similar physiological parameters, sleep settings, and actigraphy data. The remote server may use "black box" analysis approach by running supervised learning algorithms to analyze the database, producing sleep phase correction data which can be uploaded to the alarm clock, and be used by the alarm clock to further improve its REM sleep phase prediction accuracy.

U.S. Patent Publication No. 2011/0267196 for System and method for providing sleep quality feedback by inventors Hu et al., filed May 3, 2011 and published Nov. 3, 2011, discloses a system and method for providing sleep quality feedback that includes receiving alarm input on a base device from a user; the base device communicating an alarm setting based on the alarm input to an individual sleep device; the individual sleep device collecting sleep data based on activity input of a user; the individual sleep device communicating sleep data to the base device; the base device calculating sleep quality feedback from the sleep data; communicating sleep quality feedback to a user; and the individual sleep device activating an alarm, wherein activating the alarm includes generating tactile feedback to the user according to the alarm setting.

U.S. Pat. No. 8,179,270 for Methods and systems for providing sleep conditions by inventors Rai et al., filed Jul. 21, 2009 and issued May 15, 2012, discloses a method for monitoring a sleep condition with a sleep scheduler wherein the method includes receiving a sleep parameter via an input receiver on the sleep scheduler. The method further includes associating the sleep parameter with an overall alertness and outputting a determined sleep condition based on the overall alertness. A system for providing a sleep condition is further disclosed therein the system comprising includes a display, an input receiver operable to receive a sleep parameter, and a processor in communication with the display. The processor may be operable to determine an overall alertness associated with the sleep parameter and wherein the processor is operable to output a determined sleep condition based on the overall alertness.

U.S. Pat. No. 8,290,596 for Therapy program selection based on patient state by inventors Wei et al., filed Sep. 25, 2008 and issued Oct. 16, 2012, discloses selecting a therapy program based on a patient state, where the patient state comprises at least one of a movement state, sleep state or speech state. In this way, therapy delivery is tailored to the patient state, which may include specific patient symptoms. The therapy program is selected from a plurality of stored therapy programs that comprise therapy programs associated with a respective one at least two of the movement, sleep, and speech states. Techniques for determining a patient state include receiving volitional patient input or detecting biosignals generated within the patient's brain. The biosignals are nonsymptomatic and may be incidental to the movement, sleep, and speech states or generated in response to volitional patient input.

U.S. Patent Publication No. 2012/0296402 for Device and method for brown adipose tissue activation by inventor Kotter, filed May 17, 2011 and published Nov. 22, 2012, discloses devices and methods of activating brown adipose tissue. One method comprises applying a cooling device on a subject at a supraclavicular region or paravertebral region of skin overlying brown adipose tissue; and maintaining the cooling device in contact with the skin at a temperature from 45° F. to 70° F. for a duration of at least 90 minutes so as to cool the region sufficiently to activate the brown adipose tissue.

U.S. Pat. No. 8,348,840 for Device and method to monitor, assess and improve quality of sleep by inventors Heit et al., filed Feb. 4, 2010 and issued Jan. 8, 2013, discloses a medical sleep disorder arrangement that integrates into current diagnosis and treatment procedures to enable a health care professional to diagnose and treat a plurality of subjects suffering from insomnia. The arrangement may include both environmental sensors and body-worn sensors that measure the environmental conditions and the condition of the individual patient. The data may be collected and processed to measure clinically relevant attributes of sleep quality automatically. These automatically determined measures, along with the original sensor data, may be aggregated and shared remotely with the health care professional. A communication apparatus enables the healthcare professional to remotely communicate with and further assess the patient and subsequently administer the treatment. Thus, a more accurate diagnosis and more effective treatment is provided while reducing the required clinician time per patient for treatment delivery.

U.S. Pat. No. 8,529,457 for System and kit for stress and relaxation management by inventors Devot et al., filed Feb. 16, 2009 and issued Sep. 10, 2013, discloses a system and a kit for stress and relaxation management. A cardiac activity sensor is used for measuring the heart rate variability (HRV) signal of the user and a respiration sensor for measuring the respiratory signal of the user. The system contains a user interaction device having an input unit for receiving user specific data and an output unit for providing information output to the user. A processor is used to assess the stress level of the user by determining a user related stress index. The processor is also used to monitor the user during a relaxation exercise by means of determining a relaxation index based on the measured HRV and respiratory signals, the relaxation index being continuously adapted to the incoming measured signals and based thereon the processor instructs the output unit to provide the user with biofeedback and support messages. Finally, the processor uses the user specific data as an input in generating a first set of rules defining an improvement plan for self-management of stress and relaxation. The first set of rules is adapted to trigger commands instructing the output unit to provide the user with motivation related messages. Also, at least a portion of said user specific data is further used to define a second set of rules indicating the user's personal goals.

U.S. Pat. No. 9,459,597 for Method and apparatus to provide an improved sleep experience by selecting an optimal next sleep state for a user by inventors Kahn et al., filed Feb. 28, 2013 and issued Oct. 4, 2016, discloses a sleep sensing system comprising a sensor to obtain real-time information about a user, a sleep state logic to determine the user's current sleep state based on the real-time information. The system further comprising a sleep stage selector to select an optimal next sleep state for the user, and a sound output system to output sounds to guide the user from the current sleep state to the optimal next sleep state.

U.S. Pat. No. 8,768,520 for Systems and methods for controlling a bedroom environment and for providing sleep data by inventors Oexman et al., filed Nov. 14, 2008 and issued Jul. 1, 2014, discloses a system for controlling a bedroom environment that includes an environmental data collector configured to collect environmental data relating to the bedroom environment; a sleep data collector configured to collect sleep data relating to a person's state of sleep; an analysis unit configured to analyze the collected environmental data and the collected sleep data and to determine an adjustment of the bedroom environment that promotes sleep of the person; and a controller configured to effect the adjustment of the bedroom environment. A method for controlling a bedroom environment includes collecting environmental data relating to the bedroom environment; collecting sleep data relating to a person's state of sleep; analyzing the collected environmental data and the collected sleep data; determining an adjustment to the bedroom environment that promotes sleep; and communicating the adjustment to a device that effects the bedroom environment.

U.S. Patent Publication No. 2014/0277308 for Adaptive thermodynamic therapy system by inventors Cronise et al., filed Mar. 17, 2014 and published Sep. 18, 2014, discloses an adaptive thermodynamic therapy system capable of comfortably increasing metabolic expenditure to facilitate excess weight loss, including one or more sensors for measuring a subject user's body temperature, current activity/metabolic level and providing data representative of said body temperature to a computer-based controller, and then actively controlling a thermal load in contact with subject user's body and responsive to the computer-based controller. In one embodiment, the controller is configured to receive input from at least one computer-based device configured to provide user body data and calculate a state value representative of the user body data and to adjust the thermal load to obtain a desired physiological response from the user by modifying the state values.

U.S. Pat. No. 9,186,479 for Methods and systems for gathering human biological signals and controlling a bed device by inventors Franceschetti et al., filed Jun. 5, 2015 and issued Nov. 17, 2015, discloses methods and systems for an adjustable bed device configured to: gather biological signals associated with multiple users, such as heart rate, breathing rate, or temperature; analyze the gathered human biological signals; and heat or cool a bed based on the analysis.

U.S. Pat. No. 10,376,670 for Methods and systems for sleep management by inventors Shouldice et al., filed Jul. 8, 2014 and issued Aug. 13, 2019, discloses a processing system including methods to promote sleep. The system may include a monitor such as a non-contact motion sensor from which sleep information may be determined. User sleep information, such as sleep stages, hypnograms, sleep scores, mind recharge scores and body scores, may be recorded, evaluated and/or displayed for a user. The system may further monitor ambient and/or environmental conditions corresponding to sleep sessions. Sleep advice may be generated based on the sleep information, user queries and/or environmental conditions from one or more sleep sessions. Communicated sleep advice may include content to promote good sleep habits and/or detect risky sleep conditions. In some versions of the system, any one or more of a bedside unit sensor module, a smart processing device, such as a smart phone or smart device, and network servers may be implemented to perform the methodologies of the system.

U.S. Pat. No. 10,599,116 for Methods for enhancing wellness associated with habitable environments by inventors Pillai et al., filed Aug. 26, 2016 and issued Mar. 24, 2020, discloses controlling environmental characteristics of habitable environments (e.g., hotel or motel rooms, spas, resorts, cruise boat cabins, offices, hospitals and/or homes, apartments or residences) to eliminate, reduce or ameliorate adverse or harmful aspects and introduce, increase or enhance beneficial aspects in order to improve a "wellness" or sense of "wellbeing" provided via the environments. Control of intensity and wavelength distribution of passive and active illumination addresses various issues, symptoms or syndromes, for instance to maintain a circadian rhythm or cycle, adjust for "jet lag" or season affective disorder, etc. Air quality and attributes are controlled. Scent(s) may be dispersed. Noise is reduced and sounds (e.g., masking, music, natural) may be provided. Environmental and biometric feedback is provided. Experimentation and machine learning are used to improve health outcomes and wellness standards.

U.S. Patent Publication No. 2017/0231812 for Method, device and system for modulating an activity of brown adipose tissue in a vertebrate subject by inventors Boyden et al., filed May 4, 2017 and published Aug. 17, 2017, discloses devices, systems, and methods for treatment of a disease, disorder, or condition in a vertebrate subject. A device is provided that includes one or more cooling elements configured to be applied to one or more tissues of a vertebrate subject to modulate at least one activity of brown adipose tissue of the vertebrate subject, and a programmable controller configured to provide instructions to the one or more cooling elements in response to information regarding one or more physiological conditions of the vertebrate subject.

U.S. Pat. No. 9,750,415 for Heart rate variability with sleep detection by inventors Breslow et al., filed Jul. 12, 2016 and issued Sep. 5, 2017, discloses a system using continuous tracking of sleep activity and heart rate activity to evaluate heart rate variability immediately before transitioning to an awake state, e.g., at the end of the last phase of deep sleep. In particular, a wearable, continuous physiological monitoring system includes one or more sensors to detect sleep states, the transitions between sleep states, and the transitions from a sleep state to an awake state for a user. This information can be used in conjunction with continuously monitored heart rate data to calculate heart rate variability of the user at the end of the last phase of sleep preceding the user waking up. By using the history of heart rate data in conjunction with sleep activity in this manner, an accurate and consistent recovery score can be calculated based on heart rate variability.

U.S. Pat. No. 10,368,797 for System for monitoring sleep efficiency by inventor Huang, filed May 7, 2018 and issued Aug. 6, 2019, discloses a system for monitoring sleep efficiency including a measuring device and a data processing device. The measuring device is for measuring body temperature of a subject and for outputting temperature data associated with the body temperature. The data processing device receives the temperature data, and is programmed to process the temperature data so as to determine sleep efficiency. The processing of the temperature data includes constructing a curve of the body temperature over asleep episode, finding a saddle point of the curve occurring for a first time, treating a time instance at which the saddle point occurs as a sleep-onset time point at which the subject falls asleep, and determining the sleep efficiency according to the sleep-onset time point.

U.S. Patent Publication No. 2018/0344517 for Methods and apparatuses for the thermal treatment of neurologic and psychiatric disorders by inventor Nofzinger, filed Jun. 6, 2018 and published Dec. 6, 2018, discloses a method and apparatuses for applying region cooling to modulate the autonomic nervous system (and particularly the parasympathetic nervous systems) to treat a medical disorder. Described herein are methods and apparatuses for modulating a patient's parasympathetic nervous system by simulating a diving reflex using localized cooling.

SUMMARY OF THE INVENTION

In accordance with the aforementioned needs, the present invention includes a temperature modulation system for a bed that uses a fluid, such as a liquid or a gas, as the medium for temperature change at a surface of the bed. The fluid is directed through at least two conduit circuits that traverse respective independent zones, utilizing principles of heat exchange to heat or cool the bed surface. The invention employs a thermoelectric device to modulate the temperature of the fluid and a pump, such as a multichannel pump or a pump in combination with a multi-way valve, to pump the fluid through the conduit circuits. In this arrangement, each of the conduit circuits selectively and independently directs fluid through its respective zone to achieve a temperature of the mattress within the zone that is independent of the temperature of the mattress outside that zone.

One embodiment of the present invention is directed to a system for heating or cooling a fluid, including a control unit comprising a first section and a second section, wherein the first section of the control unit includes at least one fluid reservoir connected to at least one pump, wherein the at least one pump is operable to move fluid from the at least one fluid reservoir into at least one thermoelectric module, wherein the at least one thermoelectric module is operable to heat and/or cool the fluid, wherein the second section of the control unit includes at least one heat sink connected to the at least one thermoelectric module and at least one fan, wherein the at least one fan generates an air path over the at least one heat sink, and wherein at least one partition separates the first section from the second section, such that the air path generated by the at least one fan does not intersect the at least one fluid reservoir or the at least one thermoelectric module.

Another embodiment of the present invention is directed to A system for heating or cooling a fluid, including a control unit comprising a first section and a second section, a thermally-regulated article connected to the control unit by tubing and configured to receive fluid from and return fluid to the control unit via the tubing, wherein the first section of the control unit includes at least one fluid reservoir connected to at least one accumulator, wherein the at least one accumulator is connected to at least one pump, wherein the at least one pump is operable to move the fluid from the at least one accumulator into at least one thermoelectric module, wherein the at least one thermoelectric module is operable to heat and/or cool the fluid, wherein the second section of the control unit includes at least one heat sink connected to the at least one thermoelectric module and at least one fan, and wherein the at least one accumulator is operable to receive fluid returning from the thermally-regulated article.

Yet another embodiment of the present invention is directed to A system for heating or cooling a fluid, including a control unit, wherein the control unit is configured to connect to at least one thermally-regulated article, wherein the at least one thermally-regulated article is connected to the control unit by tubing and configured to receive fluid from and return fluid to the control unit via the tubing, wherein the control unit includes at least one fluid reservoir connected to at least one accumulator, wherein the at least one accumulator includes a first chamber and a second chamber, wherein the first chamber and the second chamber of the at least one accumulator are connected to at least one pump, wherein the at least one pump is operable to move fluid from the first chamber into a first thermoelectric module and fluid from the second chamber into a second thermoelectric module, wherein the first thermoelectric module and the second thermoelectric module are operable to heat and/or cool the fluid, wherein fluid from the first thermoelectric module is connected via a first set of tubing to the at least one thermally-regulated article and fluid from the second thermoelectric module is connected via a second set of tubing to the at least one thermally-regulated article, and wherein the at least one accumulator is operable to receive fluid returning from the thermally-regulated article.

These and other aspects of the present invention will become apparent to those skilled in the art after a reading of the following description of the preferred embodiment when considered with the drawings, as they support the claimed invention.

DETAILED DESCRIPTION

Figure 1:
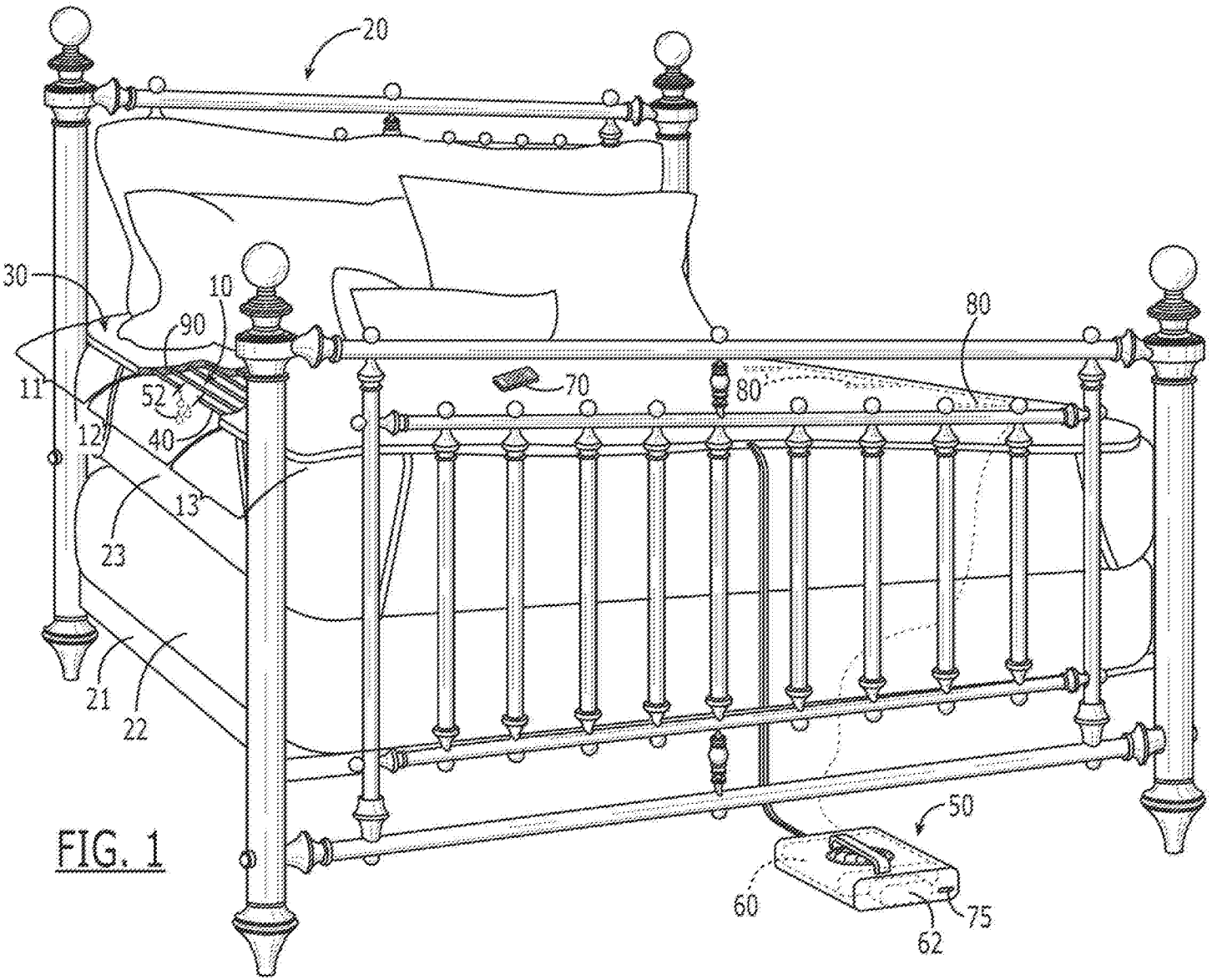
FIG. 1 is an isometric view of a preferred embodiment of the present invention.

It is desirable to control the temperature of a bed or other piece of furniture that supports a person, such as when sleeping. Such control has therapeutic value in treating symptoms of menopause or conditions of hypothermia or hyperthermia, particularly when those conditions manifest themselves over a long period of time. Therapeutic value is also seen for individuals who have circulatory disorders, sleep disorders, and other conditions that are improved by increasing the comfort felt during sleep. Such control is desirable even outside the therapeutic value of cooling or heating a mattress, simply to match the personal comfort preferences of healthy individuals, or to provide localized control when a more general control, such as heating or air conditioning of a sleeping space, is unavailable or when adjustments to the general control might cause others discomfort or are inefficient from an energy consumption perspective.

One embodiment of the present invention is directed to a system for heating or cooling a fluid, including a control unit comprising a first section and a second section, wherein the first section of the control unit includes at least one fluid reservoir connected to at least one pump, wherein the at least one pump is operable to move fluid from the at least one fluid reservoir into at least one thermoelectric module, wherein the at least one thermoelectric module is operable to heat and/or cool the fluid, wherein the second section of the control unit includes at least one heat sink connected to the at least one thermoelectric module and at least one fan, wherein the at least one fan generates an air path over the at least one heat sink, and wherein at least one partition separates the first section from the second section, such that the air path generated by the at least one fan does not intersect the at least one fluid reservoir or the at least one thermoelectric module.

Another embodiment of the present invention is directed to A system for heating or cooling a fluid, including a control unit comprising a first section and a second section, a thermally-regulated article connected to the control unit by tubing and configured to receive fluid from and return fluid to the control unit via the tubing, wherein the first section of the control unit includes at least one fluid reservoir connected to at least one accumulator, wherein the at least one accumulator is connected to at least one pump, wherein the at least one pump is operable to move the fluid from the at least one accumulator into at least one thermoelectric module, wherein the at least one thermoelectric module is operable to heat and/or cool the fluid, wherein the second section of the control unit includes at least one heat sink connected to the at least one thermoelectric module and at least one fan, and wherein the at least one accumulator is operable to receive fluid returning from the thermally-regulated article.

Yet another embodiment of the present invention is directed to A system for heating or cooling a fluid, including a control unit, wherein the control unit is configured to connect to at least one thermally-regulated article, wherein the at least one thermally-regulated article is connected to the control unit by tubing and configured to receive fluid from and return fluid to the control unit via the tubing, wherein the control unit includes at least one fluid reservoir connected to at least one accumulator, wherein the at least one accumulator includes a first chamber and a second chamber, wherein the first chamber and the second chamber of the at least one accumulator are connected to at least one pump, wherein the at least one pump is operable to move fluid from the first chamber into a first thermoelectric module and fluid from the second chamber into a second thermoelectric module, wherein the first thermoelectric module and the second thermoelectric module are operable to heat and/or cool the fluid, wherein fluid from the first thermoelectric module is connected via a first set of tubing to the at least one thermally-regulated article and fluid from the second thermoelectric module is connected via a second set of tubing to the at least one thermally-regulated article, and wherein the at least one accumulator is operable to receive fluid returning from the thermally-regulated article.

In connection with the known methods of accomplishing temperature control, there are various problems and deficiencies that render these known methods ineffective or less than fully effective at achieving temperature control under optimal conditions. For example, such systems, particularly those that are designed for cooling, are often fairly noisy, thereby interfering with the subject individual's ability to sleep and defeating many of the therapeutic aspects of such systems.

Of somewhat more universal importance, however, is the lack of specificity such systems have in controlling temperatures in various zones of coverage, when the user desires different temperatures in different zones. A user that desires a particular temperature for sleeping is able share his or her bed with another person who desires a different temperature for sleeping—a situation that often leads to arguments, one user's lack of comfort, or a compromise that leaves neither partner happy. Another user might desire, for example, a certain temperature for the majority of his or her body but a somewhat warmer temperature for his or her feet, or a somewhat cooler temperature for his or her head.

In order to satisfy the need for multiple zones, conventional systems have heretofore utilized multiple apparatuses to conduct zone-independent temperature modulations. In the situation where the bed is to be shared, each side of the bed is provided with its own independent temperature control apparatus. A similar arrangement could potentially be used for different zones associated with a single user. However, conventional arrangements that require multiple independent systems require substantial duplication of the most expensive and potentially noisy parts of a conventional temperature control system—the circulation pump and the heating or cooling source.

For systems that utilize fluid in order to accomplish heating or cooling, the rate at which a device is able to cool or heat to a specific temperature and the amount of power required to cool or heat to that temperature requires improvement. Existing fluid-controlled systems either fail to treat the fluid at all, allowing it to flow at its ambient temperature and therefore being very limited in the range of deliverable temperatures, or they fail to separate the fluid flowing through the article from air used to withdraw excess heat from the system, hurting the thermal efficiency of the device. There is there a need for a fluid-controlled system having an increased thermal efficiency.

Yet another issue with conventional single-zone systems is that they are not programmatically controllable over time. Although some systems provide for thermostatic control to prevent overheating or overcooling, some users might desire, for example, a warmer temperature at bedtime and a cooler temperature later in the sleep cycle, or vice versa. These systems are even more deficient when the user wishes to coordinate varying temperatures in various zones with various stages of the sleep cycle in order to promote deeper and more satisfying sleep.

Although many of the applications of the present invention relate to sleep and beds, the invention is equally applicable to other types of support furniture, such as chairs, or to more portable systems, such as wheelchair cushions, blankets, or mattress pads.

What is needed is a multi-zone temperature modulation system that enables selective and independent heating or cooling of specific zones using a single heating or cooling apparatus and pump to minimize the cost efficiency of manufacture, and that is able to be programmatically controlled to vary the target temperature over time according to personal comfort or sleep cycle considerations.

Referring now to the drawings, FIG. 1 illustrates the general arrangement of a preferred embodiment of a multi-zone temperature modulation system 10 according to the present invention in an environmental perspective view. A bed 20 includes a support frame 21, a box spring foundation 22, and a mattress 23. In FIG. 1, the mattress 23 has been provided with a mattress pad 30 that has embedded within it a multi-zone temperature modulation system 10 according to the present invention. In one embodiment, the mattress 23 and mattress pad 30 are combined into a single piece, with the temperature modulation system 10 being embedded in the mattress 23 itself. Incorporating the temperature modulation system 10 into a separate mattress pad 30 and not the mattress 23 is advantageous because of the ability to use a separate mattress pad 30 to retrofit an existing mattress 23.

In one embodiment, the system 10 includes only a single temperature zone. In another embodiment, as shown in FIG. 1, the system 10 includes a plurality of temperature zones, such as, by way of example and not of limitation, three temperature zones 11, 12, 13, which correspond generally to the position of a person's head and neck, trunk and legs, and feet when the person (not shown) lies on the mattress 23. The depicted system 10 is arranged to permit the three zones 11, 12, 13 to be targeted for three independent temperatures. As used herein, the term "independent temperature" refers to a zone temperature that is set or targeted without respect to the temperature of another zone; an independent temperature is able to be the same temperature as that of another zone, and there is no requirement that the temperatures be different. The present invention is not limited to a particular number or arrangement of the zones; it is sufficient for the multi-zone aspect of this invention that there be more than one zone, regardless of the disposition of the zones.

In order to accomplish the temperature modulation of the zones 11, 12, 13, a set of conduit circuits 40, at least one per zone, is provided. In one embodiment, the conduit circuits 40 comprise any suitable material, such as plastic or metal, and/or more preferably flexible silicone, selected with the principal consideration being the ability of the conduit circuit material to transmit heat to or from the mattress pad 30. In one embodiment, there is more than one conduit circuit 40 per zone. The conduit circuit or circuits 40 repeatedly traverse the zone in a back-and-forth arrangement, in order to provide temperature modulation to the entire desired surface area of the zone. The conduit circuits 40 are arranged to return to their starting point to enable the return of fluid to the heating/cooling apparatus 50.

In one embodiment, the set of conduit circuits 40 comprises one or more tubes extending the length of the system 10, wherein each of the one or more tubes is connected to at least one inlet and at least one outlet. In another embodiment, the set of conduit circuits 40 comprises a hydro layer. In one embodiment, the hydro layer comprises a first membrane and second a membrane. The first membrane of is attached to the second membrane along the perimeter of the first membrane, such that the first membrane and the second membrane form a sealed inner compartment. In one embodiment, first membrane includes a plurality of shapes, wherein the first membrane is further welded to the second membrane at a perimeter of each of the plurality of shapes. The plurality of shapes includes at least one of the following: a triangle, a rectangle, a square, an ellipse, a circle, a pentagon, a hexagon, an octagon, and/or any other polygon. At least one inlet and at least one outlet connect the control unit to the sealed inner compartment of the first membrane and the second membrane, such that fluid is able to flow from the control unit to the sealed inner compartment.

The heating/cooling apparatus 50 generally includes one or more reservoirs 60 for temperature modulation fluid 52, which is able to be a liquid, such as water, or a gas, such as air. In a preferred embodiment, water is the fluid mediator for temperature modulation. The reservoir 60 is provided with a device 62 for heating or cooling the liquid 52 stored therein, such as a Peltier thermoelectric device. Such a device is generally well known and useful for its efficient movement of heat when a direct current is applied thereacross. The Peltier device 62 creates a heat source and a heat sink on its opposite sides, and if the direction of the current applied across it is reversed, the heat source and heat sink switch sides. This feature makes a Peltier device 62 ideal for systems which require selective heating and cooling.

The Peltier device 62 is thus used to change the temperature of the reservoir fluid 52, i.e., heating or cooling the fluid 52 in order to heat or cool the zones 11, 12, 13, according to the position of a switch that is under one of various forms of control to be discussed in more detail below. In response to a need for heating or cooling a zone, fluid is drawn from the reservoir 60 and directed through the conduit circuits 40 to effectuate the necessary temperature change. The application of energy necessary to move the fluid 52 through the conduit circuits 40 is effectuated in a variety of possible ways, such as through the use of a multichannel pump, multiple single-outlet pumps, or a single-outlet pump in combination with one or more valves.

Control 70, which is wireless as shown but which is alternatively provided with a wired connection to the heating/cooling apparatus 50, is used to set the target temperatures for each of the zones. Control 70 in combination with temperature probes 80 enables the system to maintain a target temperature in each zone 11, 12, 13 through the selective application of heated or cooled fluid to the conduit circuits 40 in each zone. Using the control 70, a user selects an independent target temperature for each zone 11, 12, 13.

Temperature probes 80 in each zone provides temperature data for that zone to the heating/cooling apparatus 50, which, by comparison of the target temperature set using the control 70 and the actual measured temperature, determines whether to heat or cool the fluid 52 and determine to which conduit circuit or circuits 40 the heated or cooled fluid 52 should be distributed in order to make the actual temperature match the target temperature.

In a preferred embodiment, the mattress pad 30 or mattress 23 (for embedded designs) includes padding 90 between the conduit circuits 40 and the resting surface, in order to improve the comfort of a user who lies upon the system and to prevent the concentrated heat or cold of the conduit circuits 40 from being applied directly or semi-directly to the user's body. Instead, the conduit circuits 40 heats or cools the padding 90, which provides more gentle temperature modulation for the user's body.

Figure 2A:
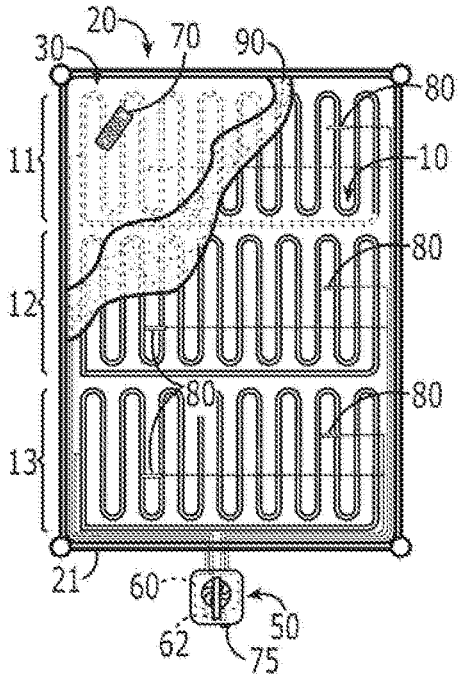
FIG. 2A is a plan view of a preferred embodiment as in FIG. 1.
Figure 2B:
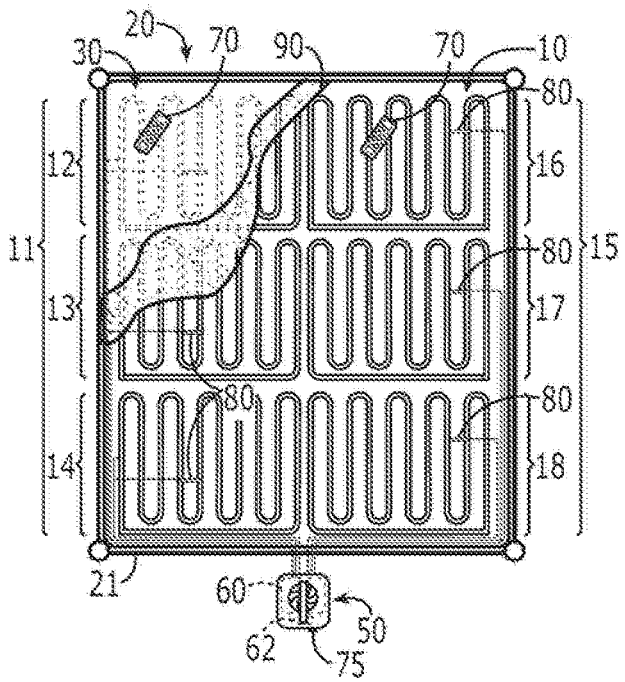
FIG. 2B is a plan view of an alternative embodiment.
Figure 2C:
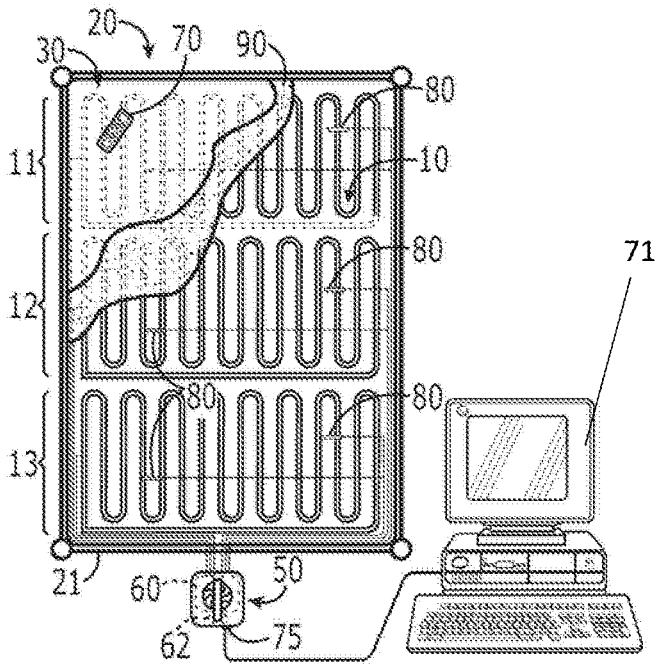
FIG. 2C is a plan view of another alternative embodiment.

Referring now to FIGS. 2A-2C, various embodiments of the present invention are illustrated in plan view for comparative purposes, in order to demonstrate the various zone arrangements that are able to be serviced according to the present invention. In FIG. 2A, the view is as in FIG. 1, in which three zones 11, 12, 13, corresponding generally to the head, body and legs, and feet, respectively, of the subject utilizing the system. Although only three zones are shown, it is equally possible to have two, four, or more zones of control. In FIG. 2B, another preferred embodiment is shown in which two sides of a two-person bed, such as a full, queen, or king size bed, are provided with two separate zones 11, 15. In one embodiment, each zone is divided into zones or subzones 12, 13, 14 and 16, 17, 18 as in FIG. 2A. In the embodiment shown in FIG. 2B, two separate controls are provided in order to enable each user to set his or her own preferences. Despite the presence of two separate controls, a single heating/cooling apparatus 50 is able to be utilized to control the temperature of reservoir fluid 52.

In FIG. 2C, another alternative embodiment is shown in which there are three zones 11, 12, 13. In another embodiment, the device shown in 2C encompasses only a single zone 11. Instead of a wireless handheld control, the heating/cooling apparatus 50 is able to be connected via a port 75 such as a USB, serial, or other port to computer 71. In one embodiment, Computer 71 is programmed to control the operation of the system 10 in accordance with a schedule of target temperatures selected to correlate with sleep cycles of the user. Such an arrangement promotes deeper, more restful sleep by altering body temperature at critical points.

Figure 3:
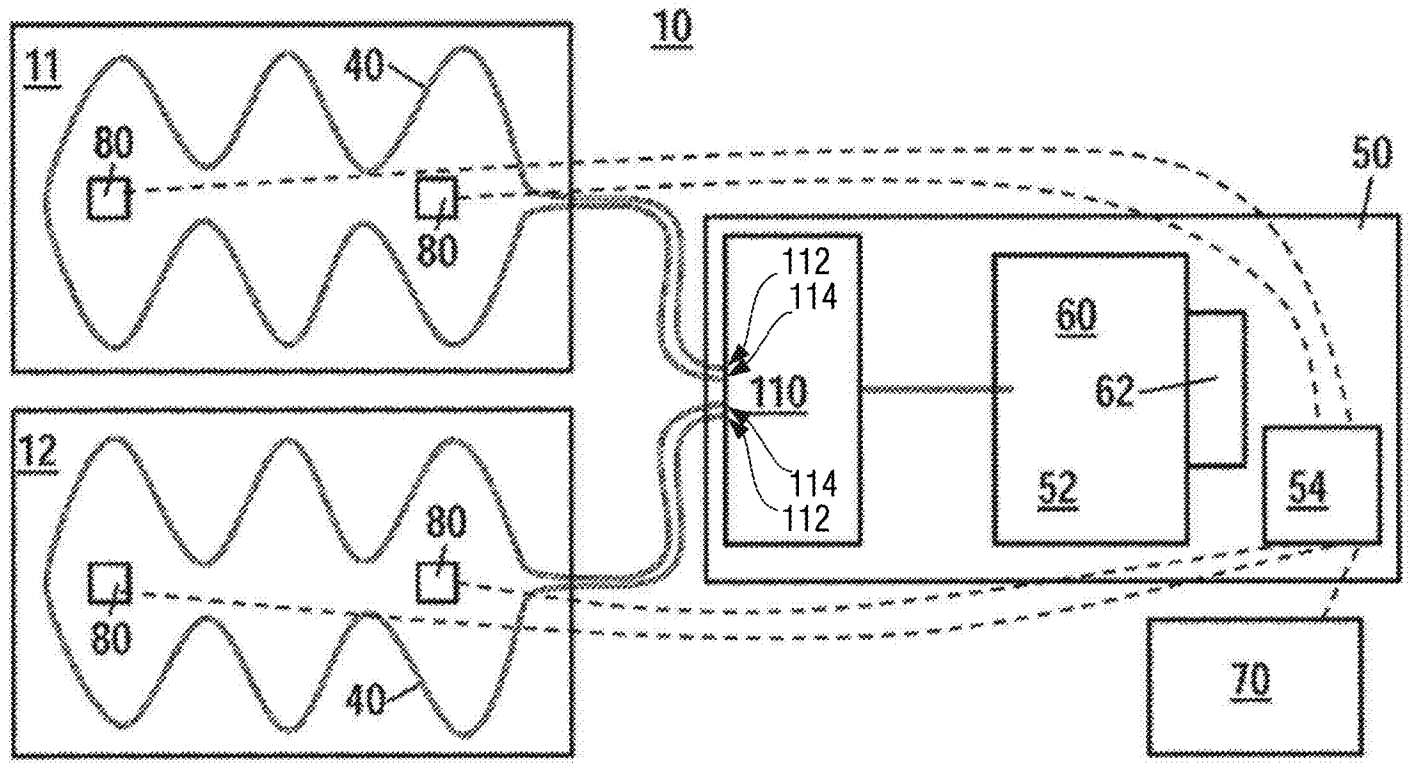
FIG. 3 is a schematic view of a preferred embodiment of the present invention.

Referring now to FIG. 3, a preferred embodiment of the present invention is shown in a schematic view to illustrate in greater and more convenient detail the various components of the system. Zones 11, 12 are provided with conduit circuits 40 for directing a heated or cooled fluid 52 therethrough. The fluid 52 is held in a reservoir 60 and heated or cooled using a Peltier device 62 or any other suitable means. Temperature probes 80 are located within the zones 11, 12 and are connected to the control unit 50, which contains computing apparatus 54, which, in one embodiment, is a microprocessor, a circuit board containing logic circuits, or any other suitable arrangement, the construction of which is well known in the art to which the present invention relates. Computing apparatus 54 is attached to a user interface 70, which comprises a handheld wireless or wired remote control, a personal computer, and/or other suitable input device. The user interface 70 is used to set the parameters of operation of the control unit 50.

The computing apparatus 54 is designed or programmed to operate the Peltier device 62 and more particularly to apply direct current of a given polarity across the Peltier device 62, in order to heat or cool the fluid 52 in the reservoir 60, as needed. The computing apparatus 54 is also designed or programmed to operate a pump and valve system 110, various embodiments of which are illustrated in schematic detail in FIGS. 4A-4C. By manipulating the pump and valve system 110, the computing apparatus controls the manner in which heated or cooled fluid 52 is driven through the conduit circuits 40 to heat or cool the zones 11, 12.

In one example, in the beginning of use, a user, using the user interface 70, calls for a target temperature of 60° F. in zone 11 and a target temperature of 70° F. in zone 12. The temperature probes 80 registers the temperature of zone 11 as 75° F. in zone 11 and 74° F. in zone 12. The computing apparatus 54 therefore activates the Peltier device 62 in cooling mode, to chill the reservoir fluid below 60° F. The computing apparatus 54 also activates the pump and valve system 110, causing fluid 52 to flow through both conduit circuits 40, back and forth across the two zones 11, 12, and returning to the reservoir 60. Over time, the actual temperature as measured by the temperature probes 80 decreases. Eventually, the temperature in zone 12 is measured at the target of 70° F. The computing apparatus 54 then controls the pump and valve system 110 to cause cooled fluid to stop flowing through zone 12, even as cooled fluid continues to flow through zone 11. Eventually, the temperature in zone 11 will also reach the target. However, if the temperature in zone 12 again rises, the pump and valve system is able to be adjusted one or more times during the process to maintain the temperature in zone 12 at the target, while the temperature in zone 11 continues to drop to the lower target temperature.

Those skilled in the art will recognize that programmatic control of the target temperatures over time, such as over the course of a night's sleep, is possible if a computer 70 is employed as the user interface. Because the target temperatures are able to be set at any time, those target temperatures are able to be manipulated through the sleeping period in order to match user preferences or a program to correlate with user sleep cycles to produce a deeper, more restful sleep.

A system 110 according to the present invention permits the elimination of duplicate parts, typically the most expensive parts of such an apparatus, such as the heating/cooling device 62 and the control apparatus 54, through the creative use of one or more pumps and valves and principles of time and flow division.

Figure 4A:
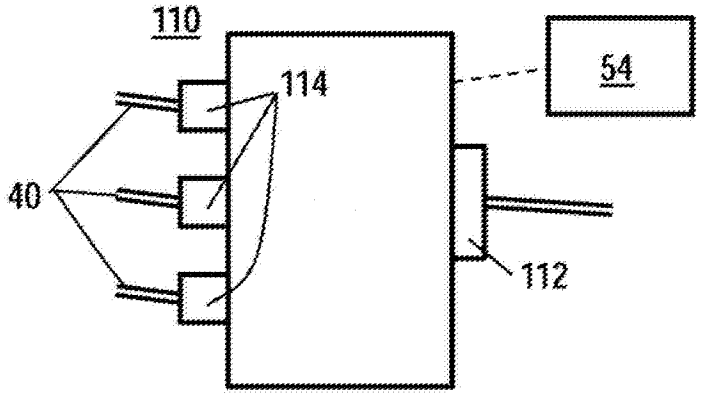
FIG. 4A is a schematic detail view of a pump arrangement according to one embodiment of the present invention.

Referring now to FIG. 4A, a first preferred embodiment of a pump and valve system 110 is a multichannel pump 110 which includes an inlet 112 which serves as a conduit for fluid from the reservoir 60 and a number of outlets 114, each of which is independently controlled to permit fluid 52 to flow or not to flow into a respective conduit circuit 40 associated with a zone 11, 12, 13. In this arrangement, the multichannel pump 110 applies pressure to the fluid 52 and selectively opens each outlet 114 according to instructions from a control apparatus 54 (see FIG. 3) to allow fluid to flow to the associated zone 11, 12, 13, thus cooling or heating the zone 11, 12, 13 in accordance with a differential between the target temperature and the actual temperature for that zone. Because the outlets 114 are individually controlled, the flow of fluid 52 is divided among one or more outlets 114 at the same time. In another embodiment, the pump and valve system is used in a time-division arrangement, whereby the full flow of fluid 52 is directed serially through the respective outlets 114 in order to achieve the same effect.

Figure 4B:
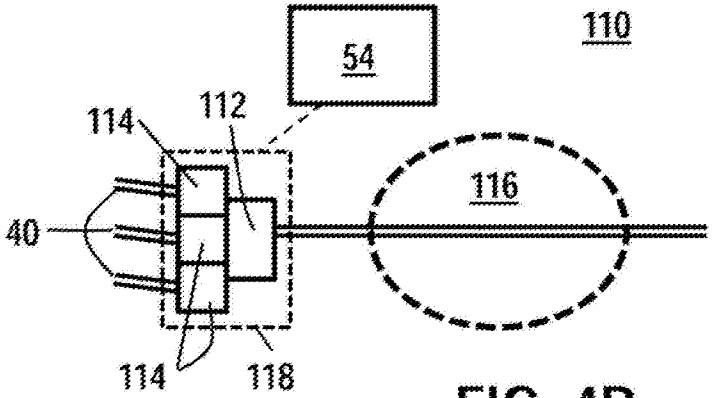
FIG. 4B is a schematic detail view of a pump arrangement according to one embodiment of the present invention.

Referring now to FIG. 4B, a second preferred embodiment of a pump and valve system 110 is illustrated. This arrangement is simpler in scope than the embodiment shown in FIG. 4A, in that the pump 116 is physically separated from the valve 118. The pump 116 is activated to provide fluid pressure, and the valve 118 is under the control of the control apparatus 54, alternately directing the fluid from inlet 112 through outlets 114, 114, 114 serially in a time-division arrangement.

Figure 4C:
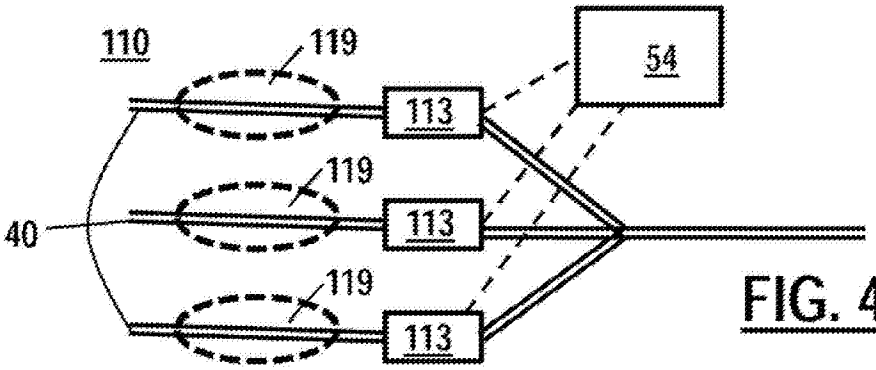
FIG. 4C is a schematic detail view of a pump arrangement according to one embodiment of the present invention.

Referring now to FIG. 4C, another preferred embodiment of a pump and valve system 110 is illustrated. In one embodiment, each zone 11, 12, 13 is provided with its own pump 119 and valve 113, which independently operates to provide fluid pressure through the associated conduit circuit 40. Providing each zone with its own pump 119 is useful when there is a need to provide full flow of fluid 52 through each zone 11, 12, 13 at all times.

The principle of time division, as applied in the present invention, relies upon the tendency of the temperature of a given zone to remain fairly steady over time. That is, heating or cooling only needs to be applied for a few minutes per hour to keep the temperature of a given zone at the target, while another zone requires fairly constant heating or cooling to maintain its target temperature. The control apparatus 54 is therefore able to divide the time among the zones in an efficient manner that keeps each zone as near to its target temperature as possible over the greatest period of time.

Figure 5A:
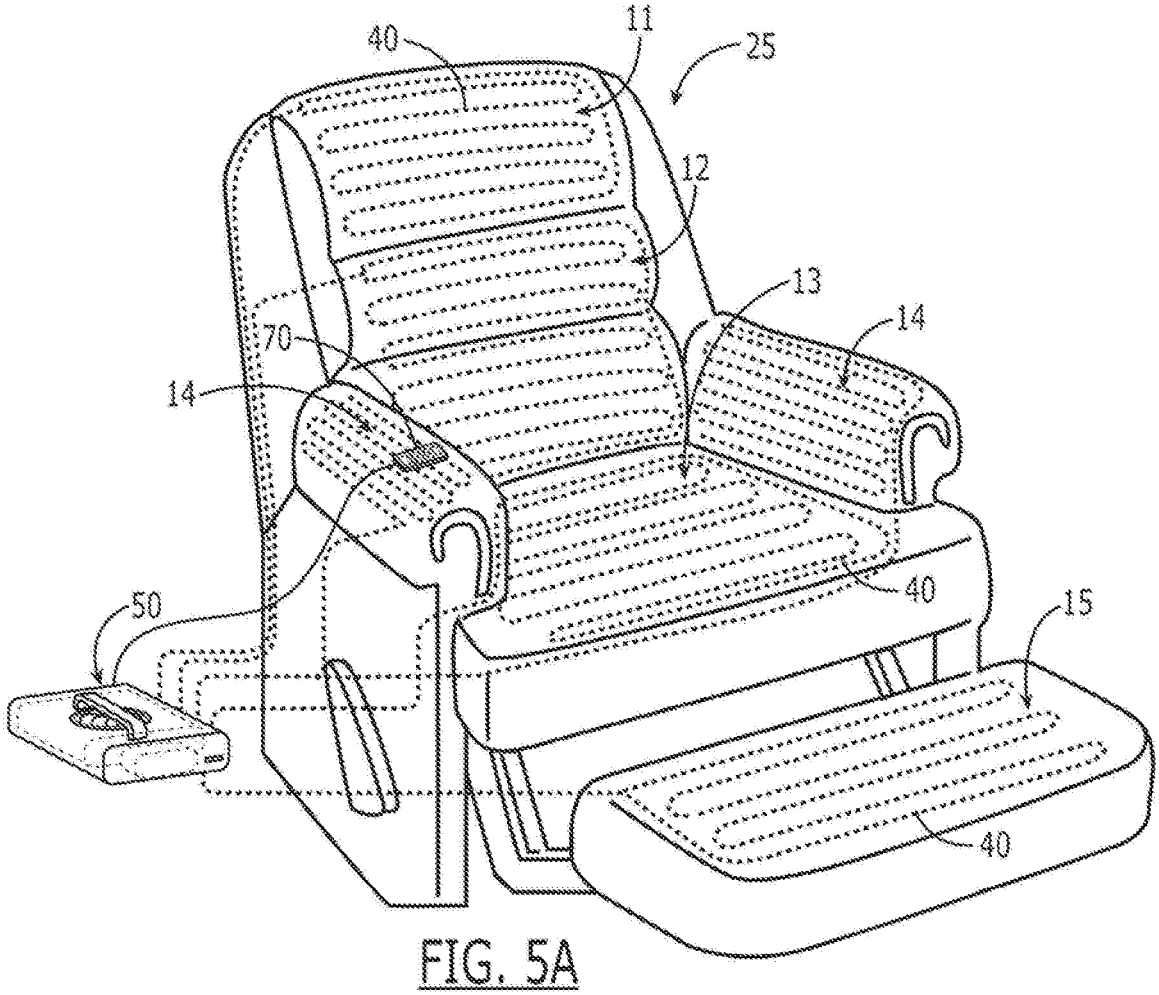
FIG. 5A is an isometric view of a chair including a climate-control system according to one embodiment of the present invention.

Although the arrangement illustrated in FIGS. 1 and 2A-2C is in a mattress-type arrangement, such as a mattress 23 or a mattress pad 30, it is equally possible to apply the concepts of the invention to other contexts. For example, as in FIG. 5A, a recliner chair 25 is shown. In much the same manner as is done with the mattress 23 or mattress pad 30 arrangements, the recliner chair 25 is provided with a number of zones 11, 12, 13, 14, 15, each of which has an associated conduit circuit 40 under independent temperature control by a control apparatus 50 as directed by a user interface 70. The operation of such a system is identical to that described above.

Figure 5B:
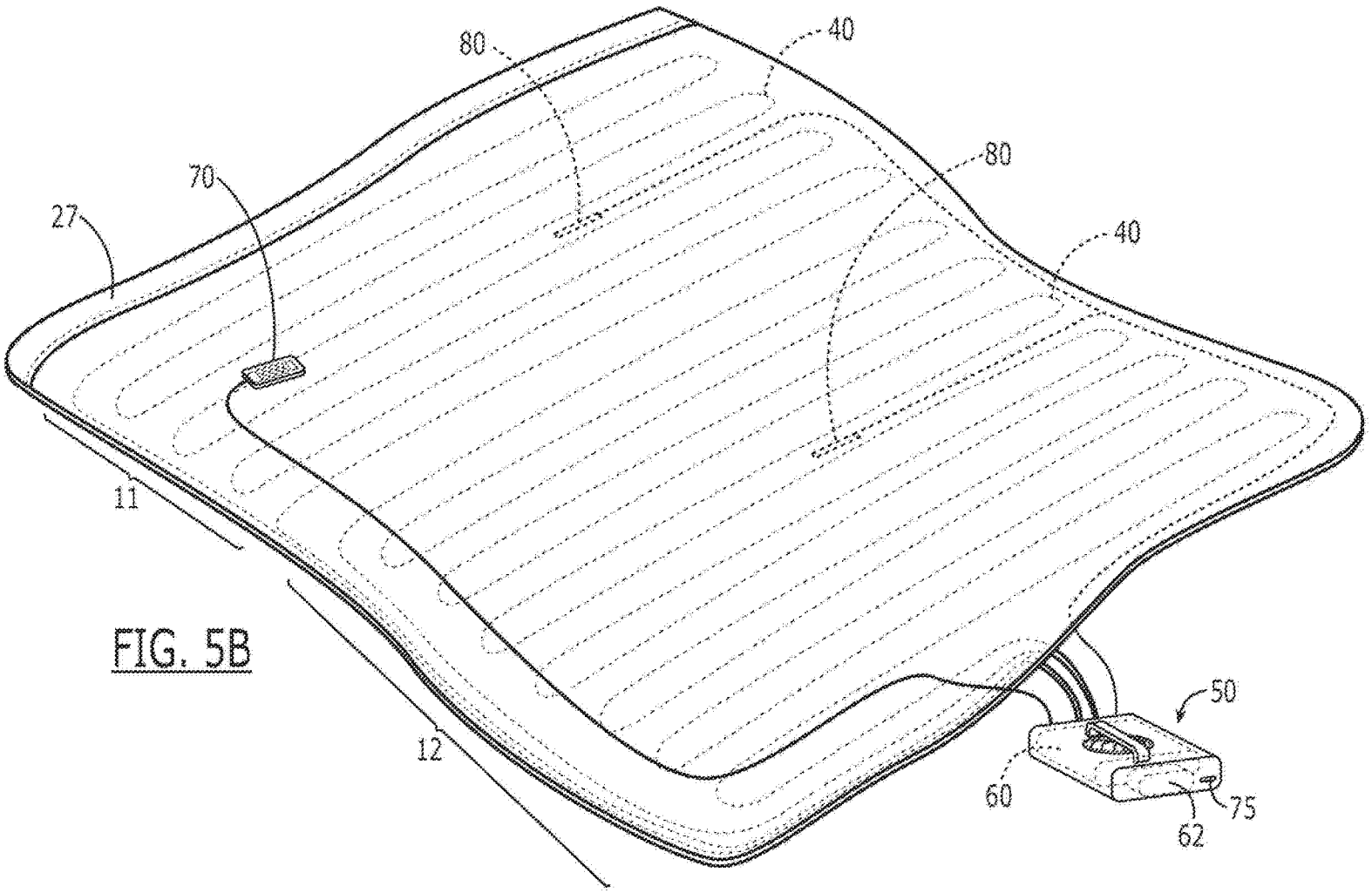
FIG. 5B is an isometric view of an article including a climate-control system according to one embodiment of the present invention.

Also, as is illustrated in FIG. 5B, the concepts of the present invention are not limited to support furniture such as mattresses, chairs, and the like. In one embodiment, a multi-zone heating/cooling system is contained within a blanket 27, for example, which is able to be placed over or under the user to provide heating or cooling within given zones 11, 12. The use of flexible tubing for the conduit circuits 40 is important to promote the ability of the blanket 27 to conform to the user's body.

Referring now to the drawings generally, a temperature modulation system 10 for a bed 20 includes a fluid 52 for moderating temperature change at a surface 24 of the bed 20, a number of conduit circuits 40 for directing the fluid 52 through respective zones 11, 12, 13, and a thermoelectric device 62 for modulating the temperature of the fluid 52. The system 10 also includes a pump 110 for pumping the fluid 52 through the conduit circuits 40. Each of the conduit circuits 40 selectively, by use of a pump and valve system 110, and independently directs fluid 52 through its respective zone 11, 12, 13 to achieve a temperature of the mattress 23 of the bed 20 that is independent of the temperature of the bed 20 outside the zone 11, 12, 13.

The fluid 52 is able to be a liquid such as water, or a gas, such as air, depending upon the requirements of the system. In one embodiment, the pump and valve system 110 is a multichannel pump. In another embodiment, the pump and valve system 110 is a single pump with a multi-outlet valve. In yet another embodiment, the pump and valve system 110 includes several pumps and valves. The particular type of pump and valve system chosen is able to be varied depending on nature of the fluid 52 used. The valves 113 are mechanically or electrically operated, under the control of a control system 54 that selectively opens and closes the valves 113 to permit fluid 52 to flow therethrough.

The system 10 is operable to be designed to operate on a flow-division or a time-division basis, the latter being characterized by permitting the full flow of fluid 52 to be directed through a single conduit circuit 40 for a given period of time, one at a time serially, to achieve the target temperature in each zone 11, 12, 13.

In order that the system 10 controls each zone individually, temperature sensing probes 80 are provided, which give feedback to the control system 54 concerning the actual temperature of the given zone 11, 12, 13. Through the use of a Peltier thermoelectric device 62, it is possible to provide heating and cooling using the same unit, thereby increasing the utility of the present invention in comparison to systems that provide only heating or only cooling. When voltage is applied to the thermoelectric device 62 in one direction, the thermoelectric device 62 provides heating, while when voltage is applied in an opposite direction across the thermoelectric device 62, the thermoelectric device 62 provides cooling.

In the context of bed use, the system 10 is able to be integrated into the mattress 23, or into a separate article, such as a mattress pad 30 or a blanket. The system 10 receives user input through a user interface 70 such as a remote control, wired or wireless. In another embodiment, the system is provided with a port 75 to connect it to a computer 71, such as a personal computer, as shown in FIG. 2C, in order to enable programmatic control of the system over time.

More generally, the present invention includes a multi-zone temperature modulation system 10 for providing selective temperature change to a living subject. The system includes a first zone 11 that includes a first conduit circuit 40 for directing a first fluid 52 therethrough, in order to bring the first zone temperature to a target temperature for the first zone 11. The system also includes a second zone 12 of similar but independent construction, and the second zone 12 has a target temperature that is independent of the target temperature of the first zone 11. As above, this embodiment uses a thermoelectric device for selectively modulating the temperature of the first and second fluids, as well as at least one pump for pumping the fluids through the conduit circuits. This arrangement is applicable to a wide variety of contexts, including beds, mattress pads, chairs, other support furniture, and blankets.

Yet another embodiment involves the use of at least one zone and the selective manipulation of the temperature over a period of time. In such an embodiment, a temperature modulation system 10 provides selective temperature change to a living subject and includes a fluid 52 for moderating temperature change within a selected zone 11 adjacent the subject. At least one conduit circuit directs the fluid 52 through the zone 11 to control temperature of the zone 11 according to a selected target temperature. In one embodiment, the control system 54 (either on its own or under the programmatic control of an attached computer 71) is programmed to control the zone temperature according to a schedule of target temperatures over a selected period of time.

Figure 6:
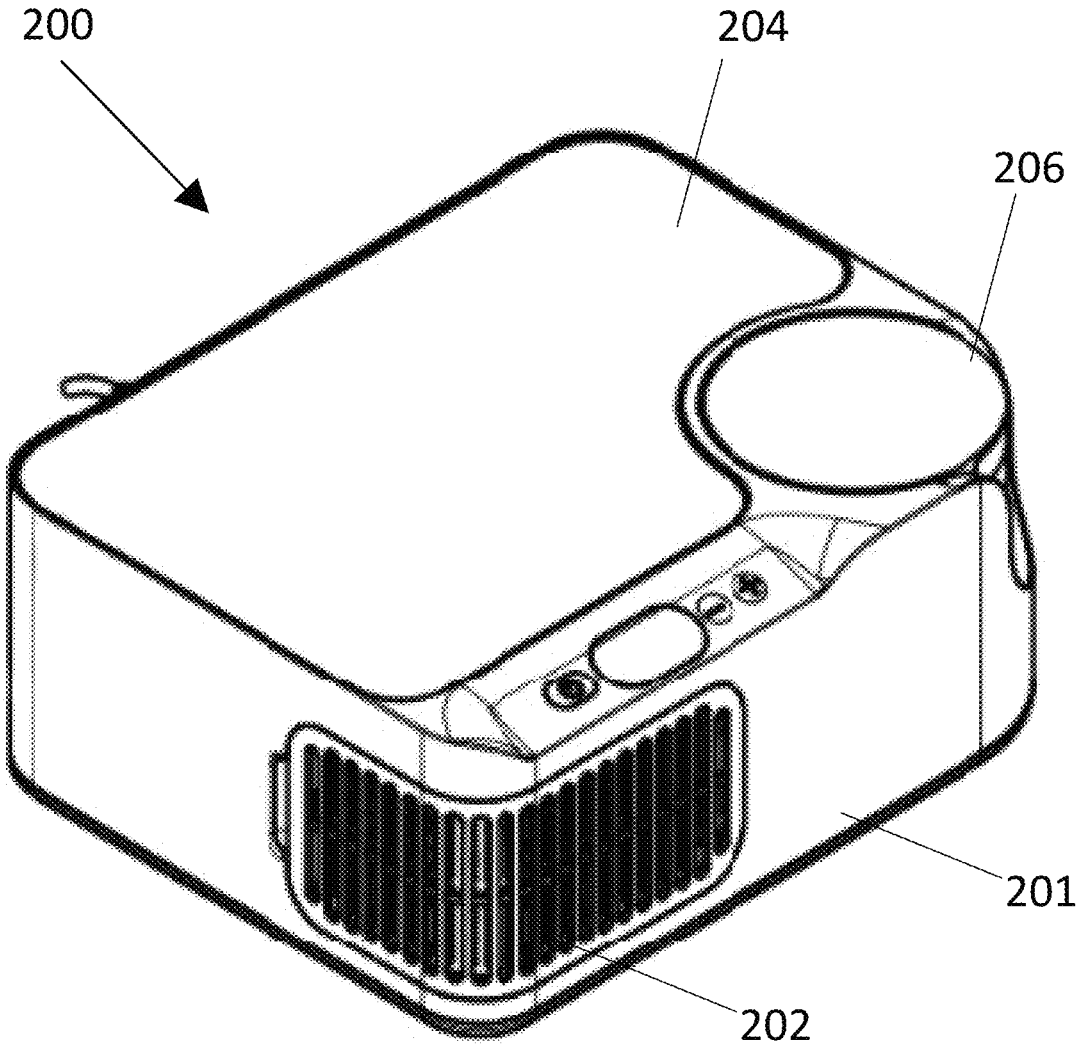
FIG. 6 is an isometric view of a control unit for a climate-control system according to one embodiment of the present invention.
Figure 7:
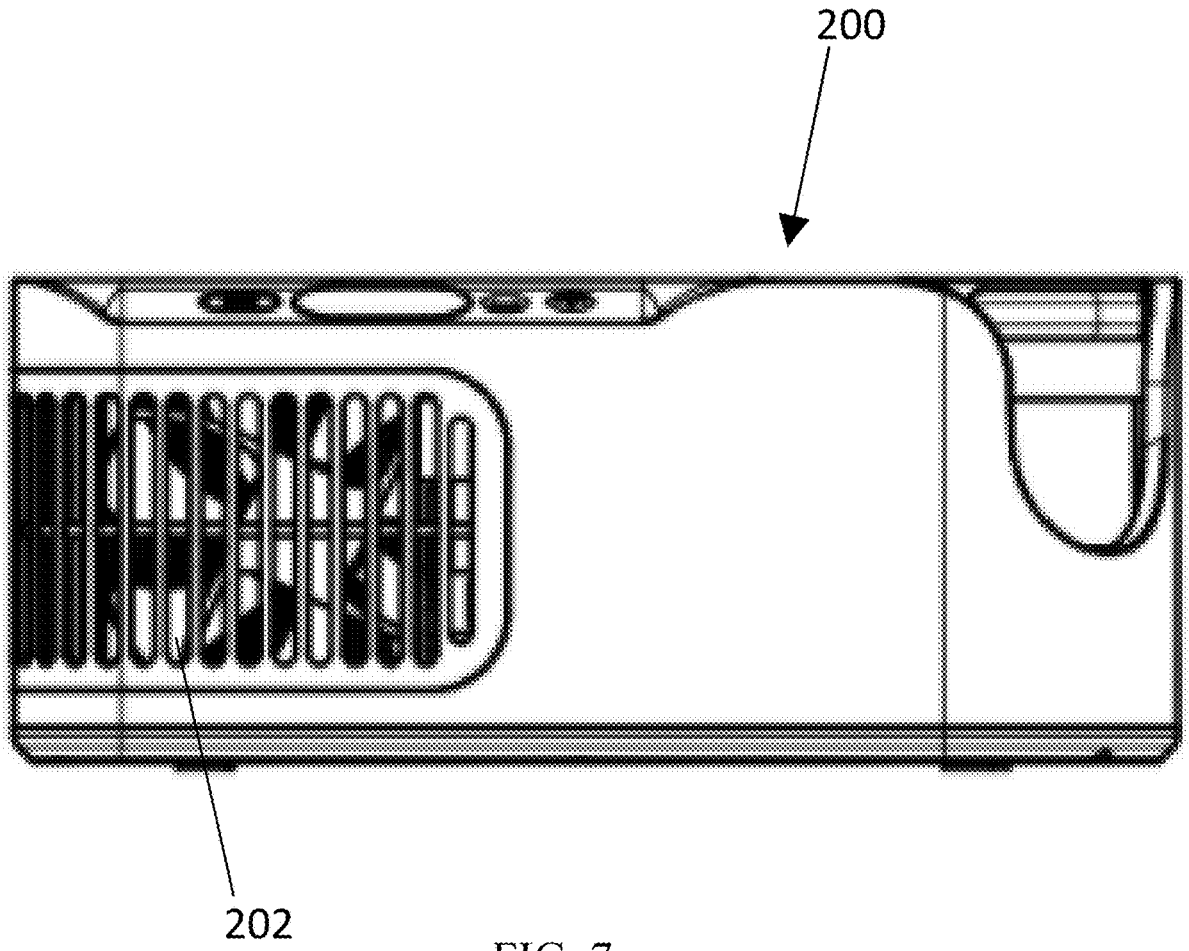
FIG. 7 is a side view of a control unit for a climate-control system according to one embodiment of the present invention.
Figure 8:
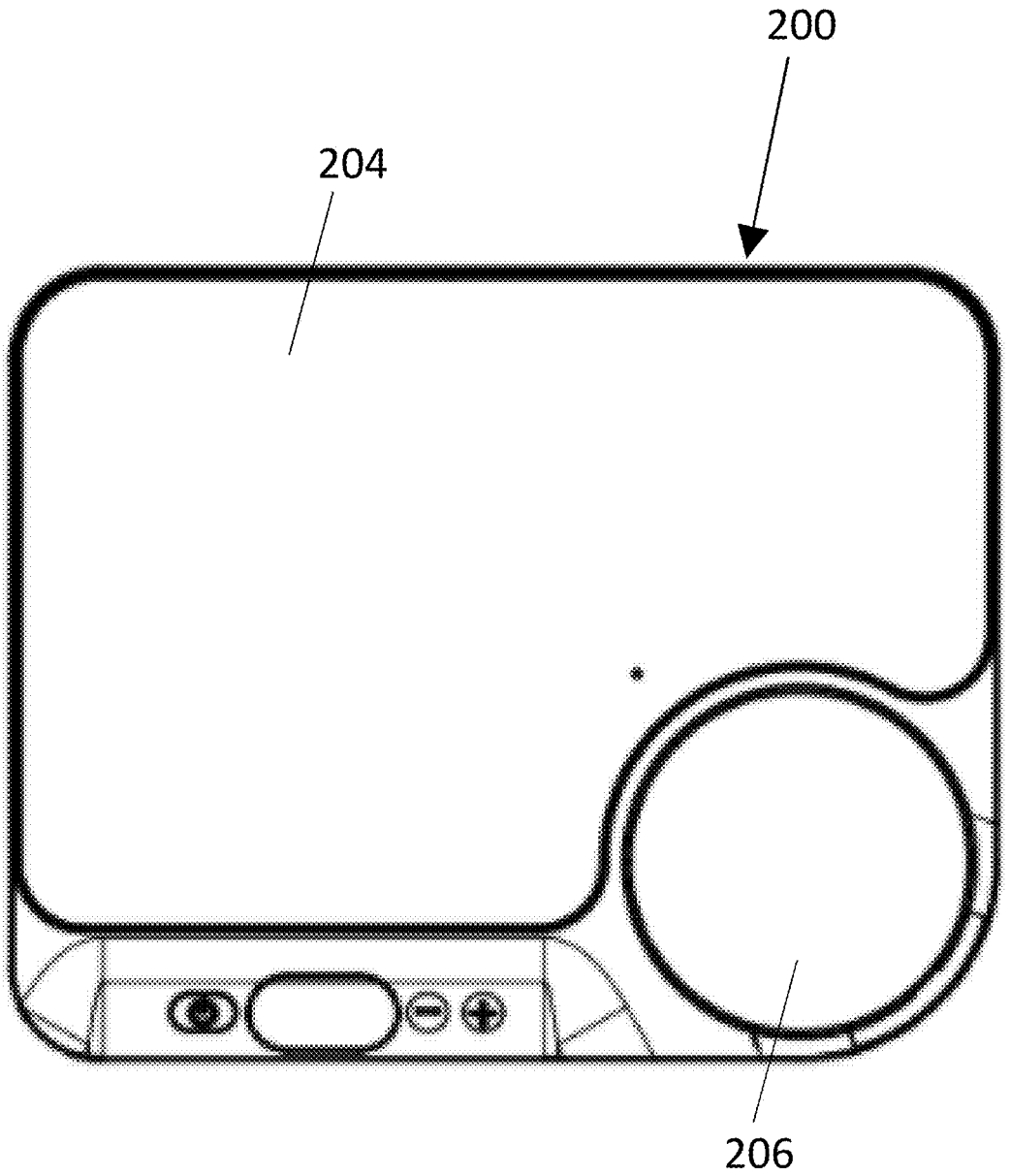
FIG. 8 is a top view of a control unit for a climate-control system according to one embodiment of the present invention.

FIGS. 6-8 show a control unit for a climate-control system according to one embodiment of the present invention. The control unit 200 includes a side wall 201 extending around a perimeter of the control unit 200 and surrounding an interior of the control unit 200. The side wall 201 includes at least one grate 202 including a plurality of slits extending through the side wall 201 of the control unit into the interior of the control unit 200. In one embodiment, the at least one grate 202 covers only approximately one fourth of the length of the side wall 201 of the control unit 200. The control unit 200 includes at least one top plate 204, which forms at least a portion of a top surface of the control unit 200. The control unit 200 further includes at least one fluid reservoir 206. In one embodiment, the at least one fluid reservoir 206 is removable and refillable without opening the control unit 200 or taking apart the control unit 200.

Figure 9:
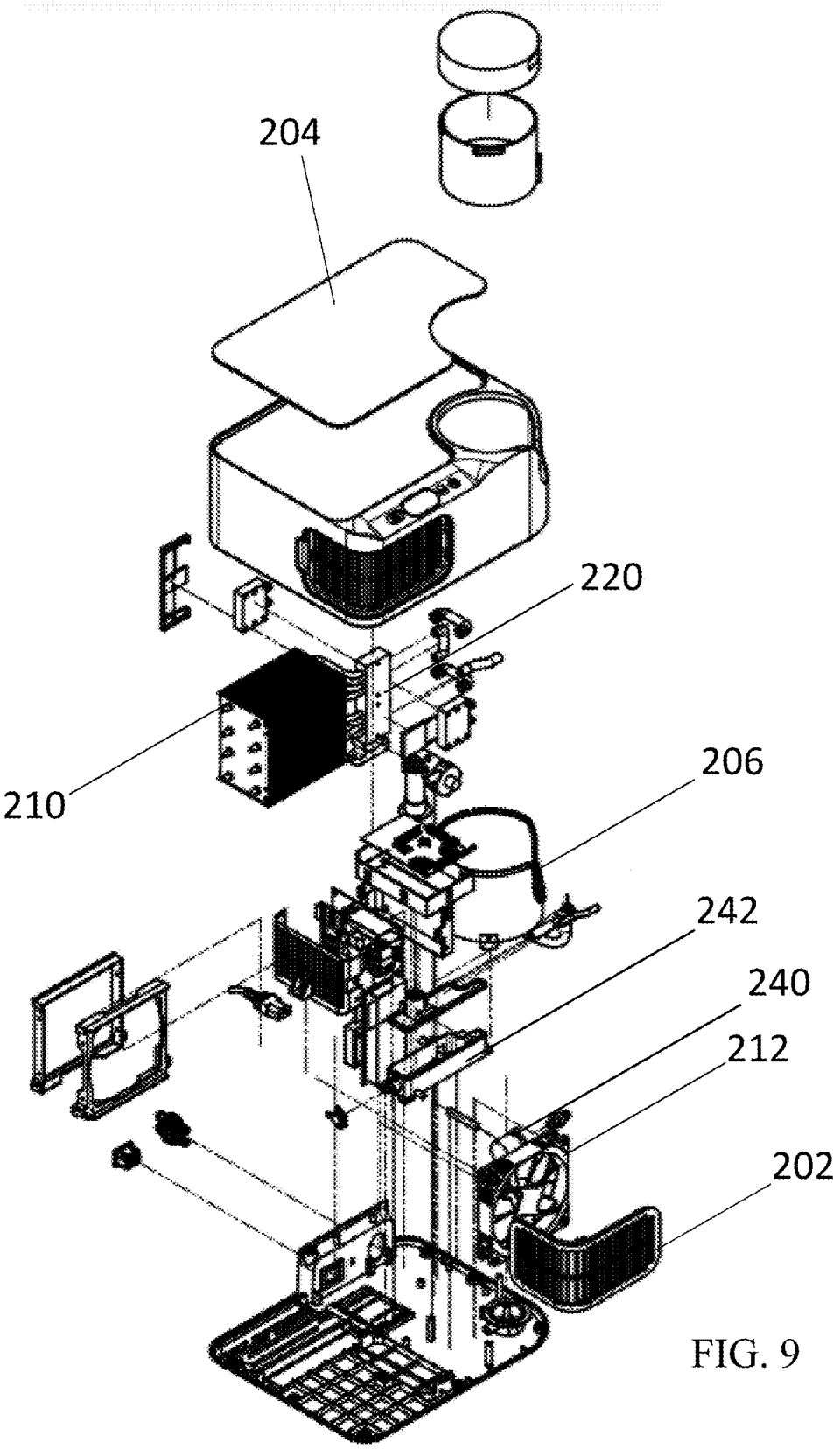
FIG. 9 is an exploded view of a control unit for a climate-control system according to one embodiment of the present invention.

FIG. 9 is an exploded view of a control unit for a climate-control system according to one embodiment of the present invention. The control unit 200 includes at least one heat sink 210 connected to at least one thermoelectric module 220 by a plurality of heat tubes. In one embodiment, the at least one thermoelectric module 220 includes four Peltier chips. In one embodiment, the four Peltier chips include two primary Peltier chips and two secondary Peltier chips, wherein the two primary Peltier chips heat a first water source and the two secondary Peltier chips heat a second water source. The first water source is entirely isolated from the second water source, such that each are connected to separate fluid circuits both originating from the at least one fluid reservoir 206. By independently heating or cooling two separate water sources, the control unit 200 is able to provide fluid at different temperatures to two different articles or to two separate sections of a single article.

The at least one heat sink 210 helps to remove excess heat from the at least one thermoelectric module 220, increasing the thermal efficiency of the control unit 200. The interior of the control unit 200 includes at least one fan 212 positioned directly adjacent to the at least one grate 202. The at least one fan 212 is operable to suck air into the control unit 200 and push air out of the control unit 200. By creating an air path with the at least one fan 212, heat from the at least one heat sink 210 is able to be efficiently removed.

Figure 10:
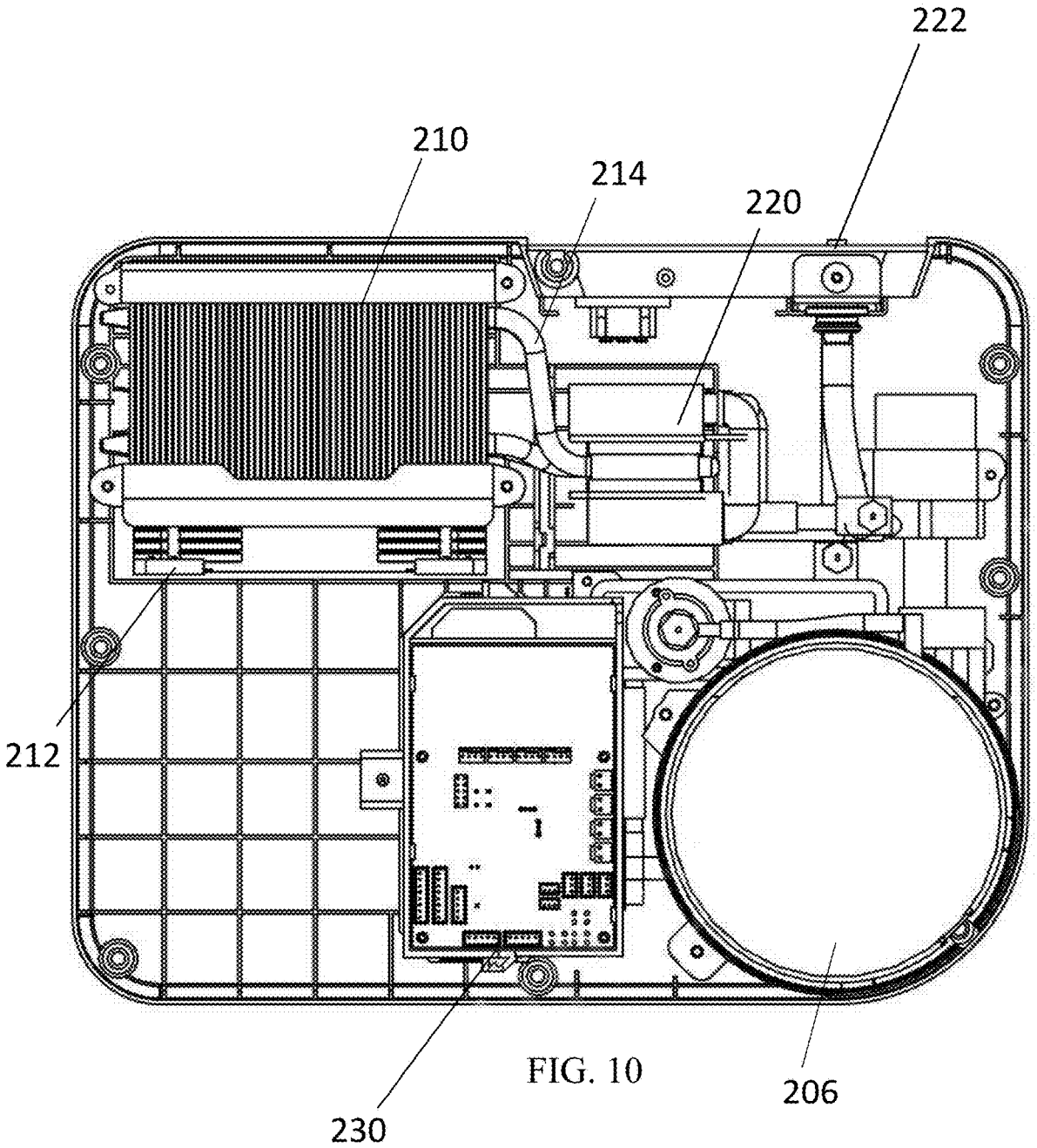
FIG. 10 is a section view of a control unit for a climate-control system according to one embodiment of the present invention.

FIG. 10 shows a section view of a control unit according to one embodiment of the present invention. A partition 230 extends from one end of the at least one fan 212 to a back end of the control unit 200, dividing the control unit 200 into two separate sections. The at least one fan 212 and the at least one heat sink 210 are positioned in a first section of the control unit 200, on one side of the partition 230. The at least one thermoelectric module 220, the at least one fluid reservoir 206, and at least one fluid outlet tube 222 are positioned in a second section of the control unit 200, on the other side of the partition 230. The plurality of heat tubes 214 extend from the at least one heat sink 210 to the at least one thermoelectric module 220. The partition 230 ensures that the air path generated by the at least one fan 212 is substantially isolated from the at least one thermoelectric module 220 and the rest of a water heating and cooling path located on the opposite side of the partition 230. By isolating the air path from the water heating and cooling path, the thermal efficiency of the thermoelectric module 220 is increased, as the temperature of the air does not directly interfere with the heating or cooling provided by the at least one thermoelectric module 220.

In one embodiment, the control unit 200 includes at least one pump connected to the at least one fluid reservoir 206. The at least one pump is operable to increase or decrease the flow of fluid out of the at least one fluid reservoir 206 to the at least one thermoelectric module 220. Including at least one pump helps the control unit 200 to control the flow of fluid even if the control unit 200 is turned on its side. By contrast, gravity-assisted systems are often unable to achieve sufficient fluid flow if they are tilted relative to the ground, resulting in a less robust system. Furthermore, because gravity-assisted systems require a fluid reservoir to be placed at a high point and other components of the system to be placed at a point lower than the fluid reservoir, such systems often require more space vertically. Therefore, it is a benefit of the present system that it is able to maintain a relatively lower profile compared to gravity-assisted systems. Maintaining a relatively lower profile helps the control unit 200 to more easily fit under a bed for easy storage and use. Accordingly, the present invention does not include a gravity-assisted system in one embodiment.

Figure 11:
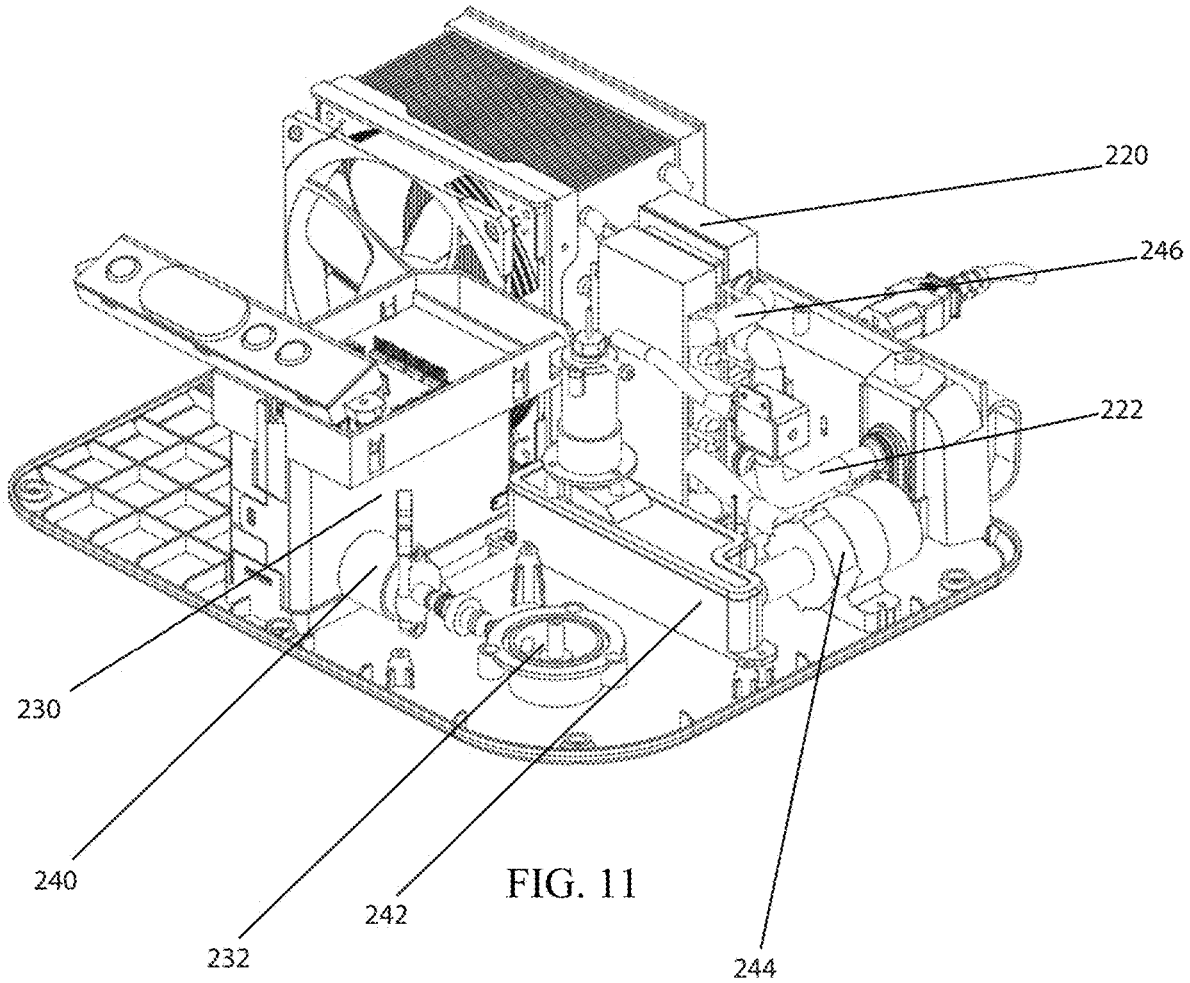
FIG. 11 is an isometric section view of a control unit for a climate-control system according to one embodiment of the present invention.

FIG. 11 is an isometric section view of a control unit for a climate-control system according to one embodiment of the present invention. For ease of visualization, the at least one fluid reservoir has been removed from the view shown in FIG. 11. The at least one fluid reservoir is attached to and positioned on top of at least one fluid reservoir stand 232. The at least one fluid reservoir stand 232 includes at least one tube connecting the fluid within the at least one fluid reservoir to the rest of the fluid circulation system in the control unit 200. After fluid exits the at least one fluid reservoir, it enters into a first pump 240, which pushes the fluid into an accumulator 242. Fluid is extracted from the accumulator 242 by a second pump 244, which pushes the fluid through a plurality of tubes 246 entering, exiting, and reentering the at least one thermoelectric module 220. In another embodiment, fluid is extracted from the at least one fluid reservoir by at least one pump and directly moved to the at least one thermoelectric module, without first passing through an accumulator.

After passing through the at least one thermoelectric module 220, the fluid exits the control unit 200 through at least one fluid outlet tube 222. Although not visible in FIG. 11, fluid reenters the control unit 200 through at least one fluid inlet tube, which is connected to the second pump 244. The second pump 244 then pushes the fluid back through the at least one thermoelectric module 220, allowing the fluid to be again cooled or heated before reexiting the control unit 200. By having the reentering fluid never return to the at least one fluid reservoir, new fluid from the at least one fluid reservoir is able to be entirely separated from reentering fluid. This is useful, as it allows the fluid in the at least one fluid reservoir to be replaced less frequently, as the fluid in the at least one fluid reservoir will always be entirely unused.

In one embodiment, the accumulator 242 is also attached to a third pump. Fluid that is extracted and pushed by the third pump enters, exits, and reenters the at least one thermoelectric module 220 through an entirely independent and separate plurality of tubes than the plurality of tubes 246 connected to the second pump 244. Furthermore, fluid extracted by the third pump exits the control unit 200 through a second outlet tube, which is independent and separate from the at least one fluid outlet tube 222. After the fluid enters and exits at least one article, it reenters the control unit 200 through a second inlet tube, which is independent and separate from the at least one inlet tube, and then reenters the third pump.

Figure 13:
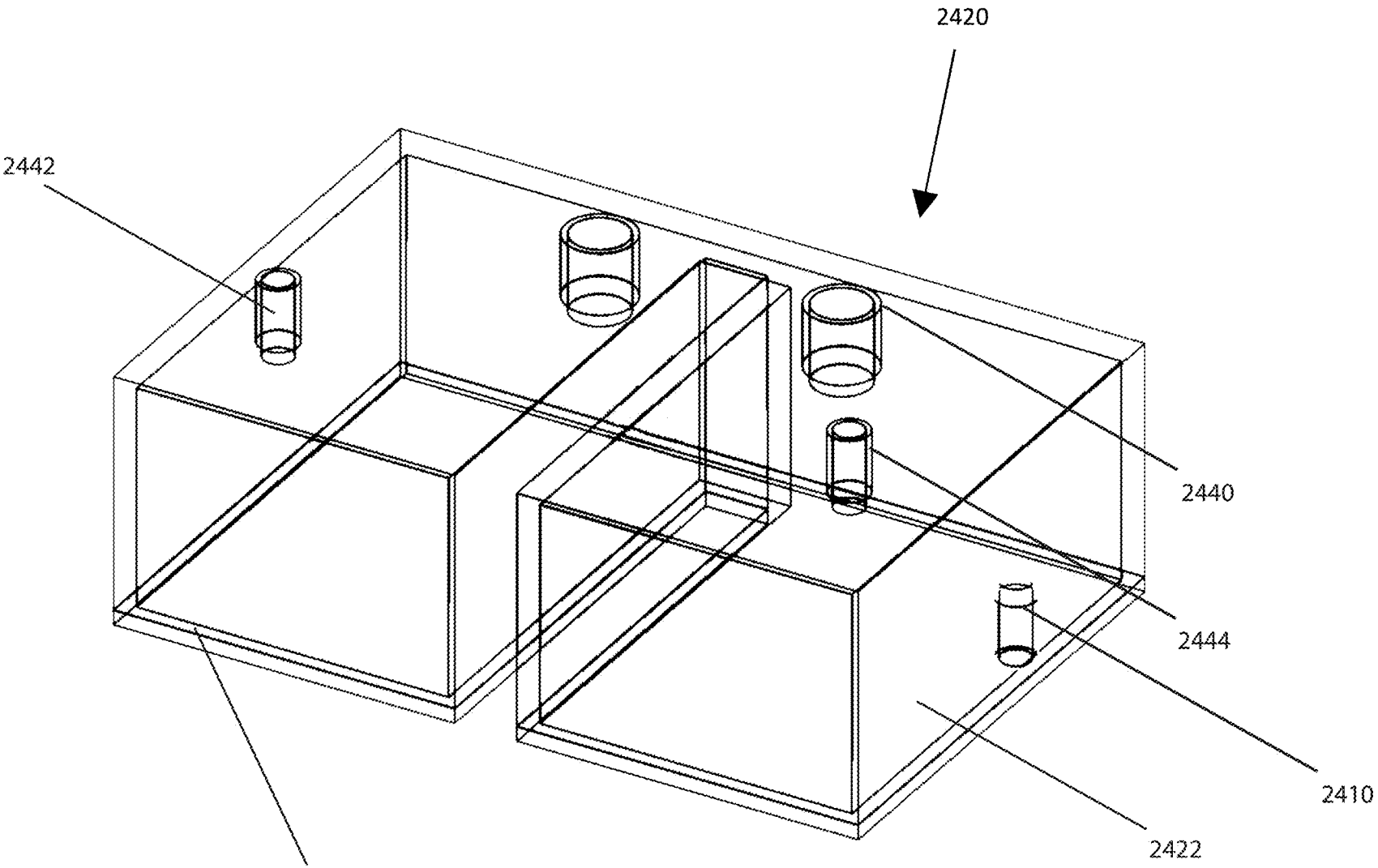
FIG. 13 is an isometric view of a split accumulator according to one embodiment of the present invention.

In another embodiment, as shown in FIG. 13 the control unit 200 includes an accumulator 2420 having two sections 2422, 2424. The first section 2422 includes an opening 2440 for attachment of the second pump to extract water and pump it into the at least one thermoelectric module, and the second section 2424 includes an opening 2442 for attachment of the third pump to extract water and pump it into the at least one thermoelectric module. In one embodiment, the first section 2422 includes an attachment point 2410 for a line from the first pump to push water into the accumulator 2420 from the at least one fluid reservoir. Because the attachment point 2410 for the line from the first pump is on the first section 2422, the first section 2422 will fill with water sequentially before the second section 2424. Furthermore, the first section 2422 includes a return point 2444 for water flowing from an article back into the control unit. The second section 2424 includes a return point 2442 for water flowing from an article back into the control unit.

Figure 14:
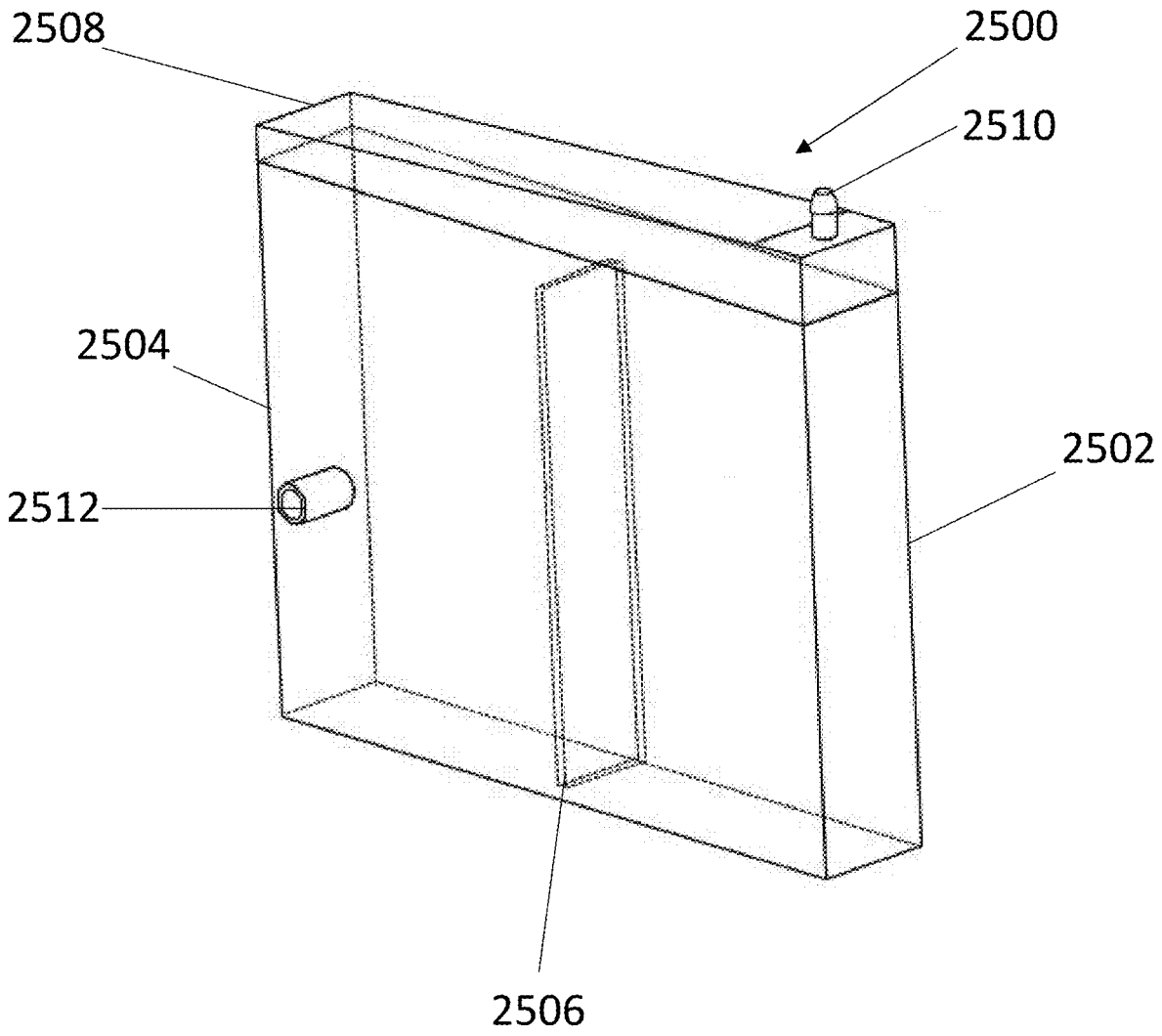
FIG. 14 is an isometric front view of a split accumulator according to one embodiment of the present invention.
Figure 15:
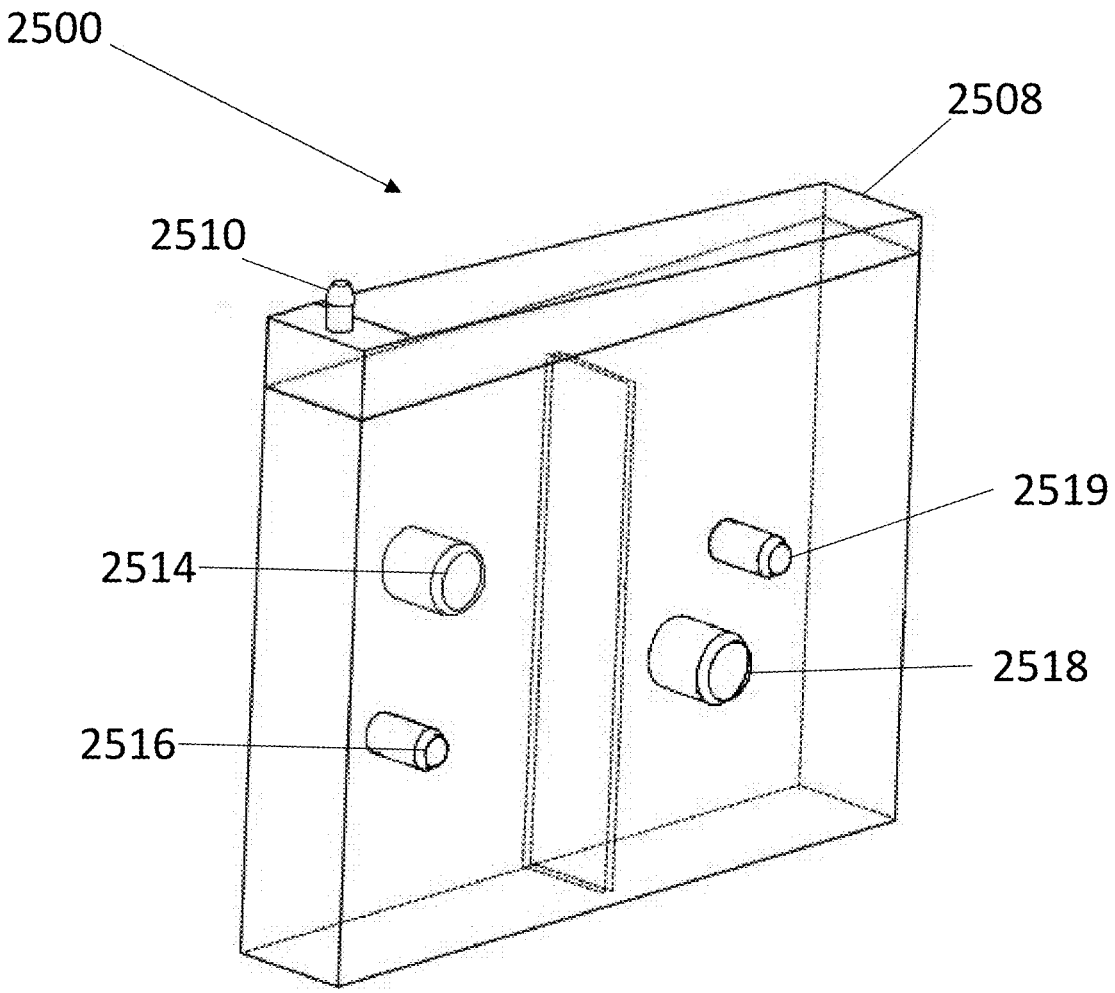
FIG. 15 is an isometric back view of the split accumulator of FIG. 13.

FIGS. 14 and 15 illustrate a split accumulator according to another embodiment of the present invention. In one embodiment, the split accumulator 2500 includes a first chamber 2502 and a second chamber 2504 with an internal divider 2506 disposed between the first chamber 2502 and the second chamber 2504. The first chamber 2502 and the second chamber 2504 are topped with a cap 2508 including an air release valve 2510. In one embodiment, the height of the cap 2508 is tapered, in order to facilitate movement of air within the split accumulator 2500 toward the air release valve 2510. The split accumulator includes a front face, shown in FIG. 14, which faces the reservoir of the control unit, and a back face, shown in FIG. 15, which faces thermoelectric modules of the control unit. In one embodiment, the front face of the second chamber 2504 includes an intake valve 2512 adapted to connect with and receive fluid from at least one reservoir via tubing. In one embodiment, the internal divider 2506 does not fully separate the first chamber 2502 from the second chamber 2504, such that fluid is able to flow between the two chambers, thereby allowing both chambers to be filled via an intake valve connected to only one chamber. In one embodiment, the internal divider 2506 is connected to a base of the split accumulator 2500, but does not extend up the full height of the split accumulator 2500 into the cap 2508, therefore allowing fluid to flow over the internal divider 2506. In this embodiment, the second chamber 2504 fills before the first chamber 2502. In another embodiment, a gap exists between a bottom end of the internal divider 2506 and the base of the split accumulator 2500, allowing fluid to flow underneath the internal divider 2506. In another embodiment, each of the first chamber 2502 and the second chamber 2504 include intake valves adapted to connect with and receive fluid from the at least one reservoir via tubing.

In one embodiment, the back face of the first chamber 2502 includes at least one discharge port 2514 operable to connect to a pump via tubing, wherein the pump is operable to move fluid from the first chamber 2502 into a thermoelectric module via tubing. In one embodiment, the back face of the first chamber 2502 includes at least one return port 2516 operable to receive fluid returning from a thermally-controlled article via tubing. In one embodiment, the back face of the second chamber 2504 includes at least one discharge port 2518 operable to connect to a pump via tubing, wherein the pump is operable to move fluid from the second chamber 2504 into a thermoelectric module via tubing. In one embodiment, the back face of the second chamber 2504 includes at least one return port 2519 operable to receive fluid returning from a thermally-controlled article via tubing.

Figure 16:
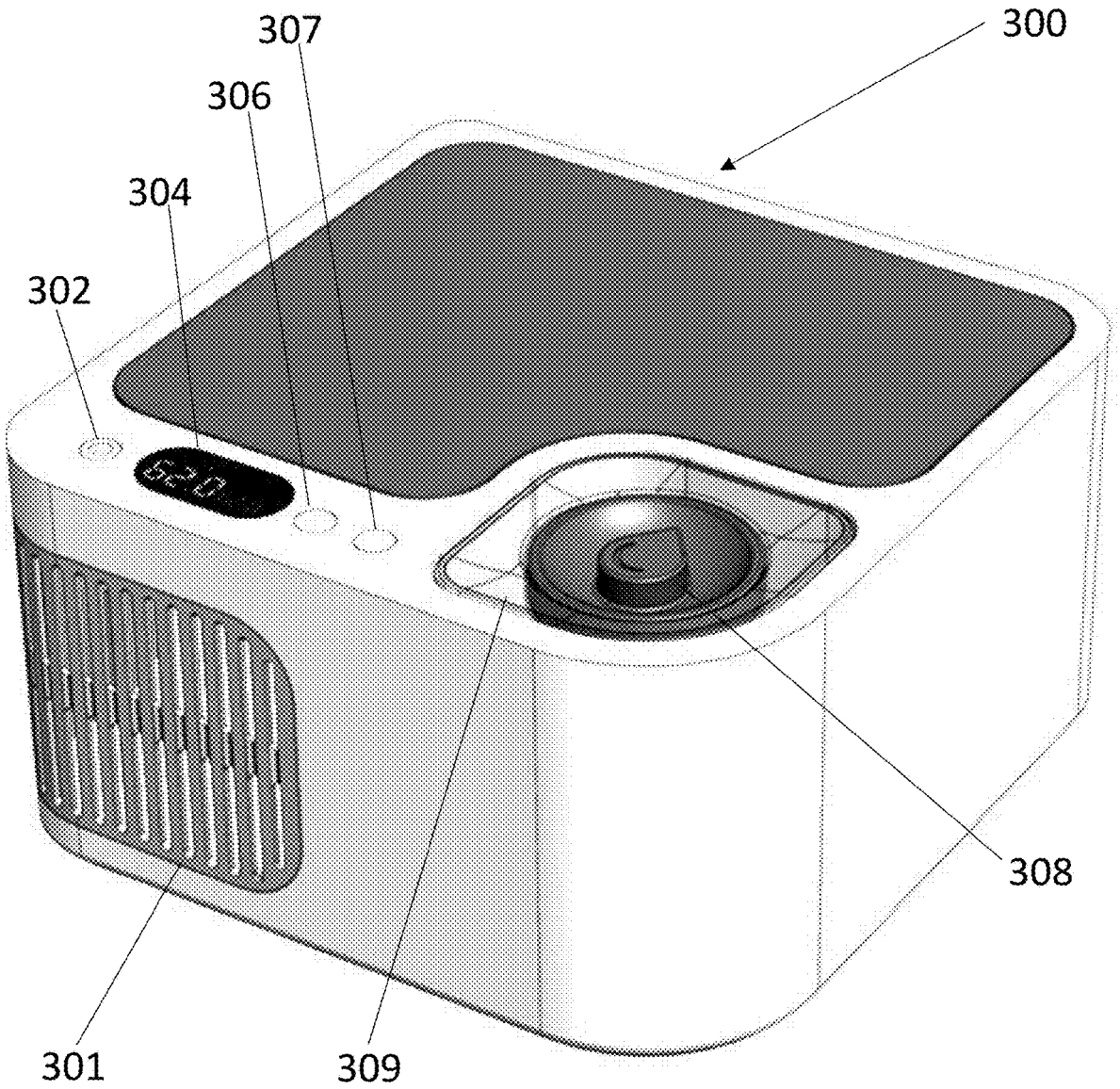
FIG. 16 is an isometric view of a control unit for a climate-control system according to one embodiment of the present invention.
Figure 17:
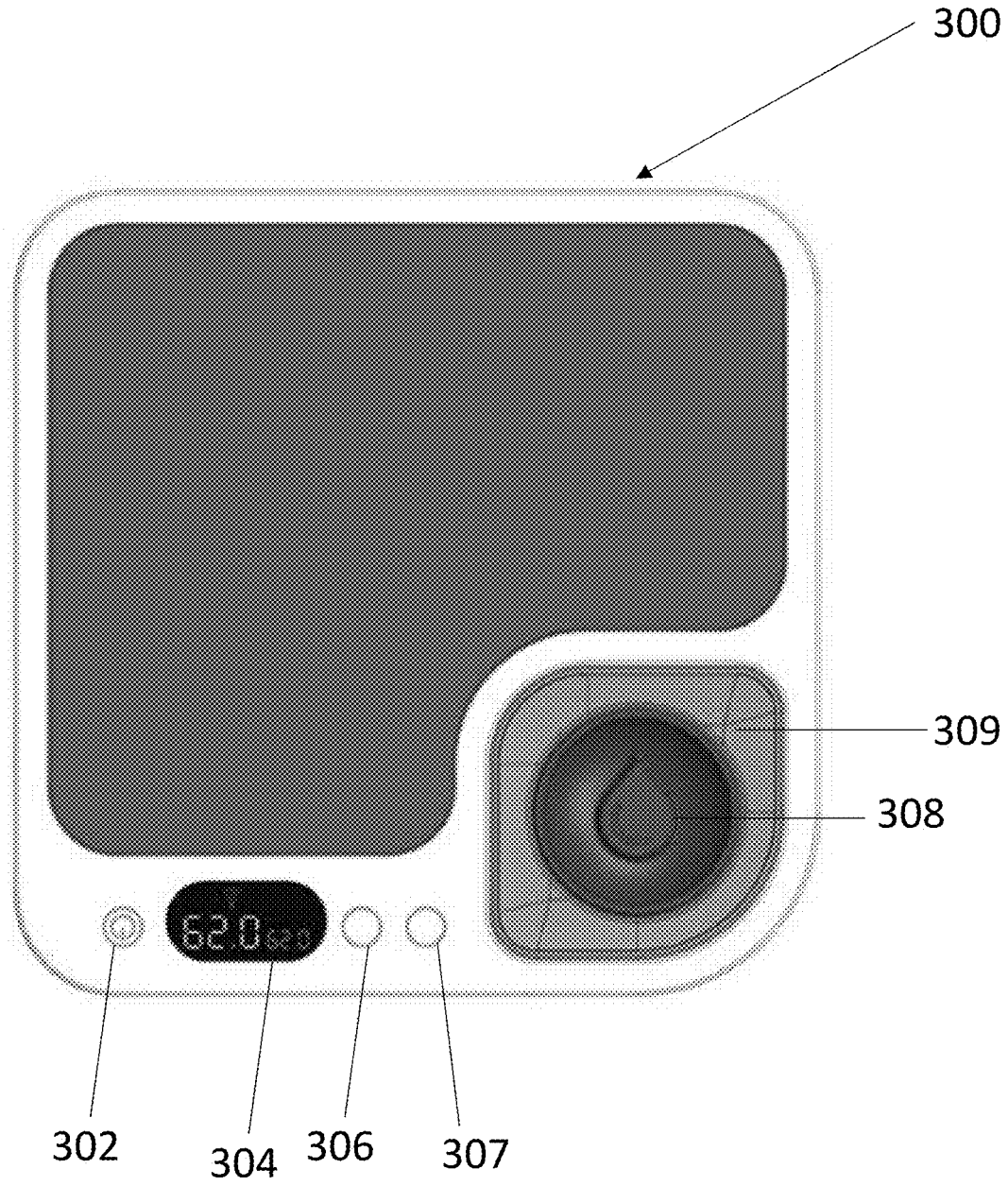
FIG. 17 is a top view of the control unit for a climate-control system of FIG. 16.
Figure 18:
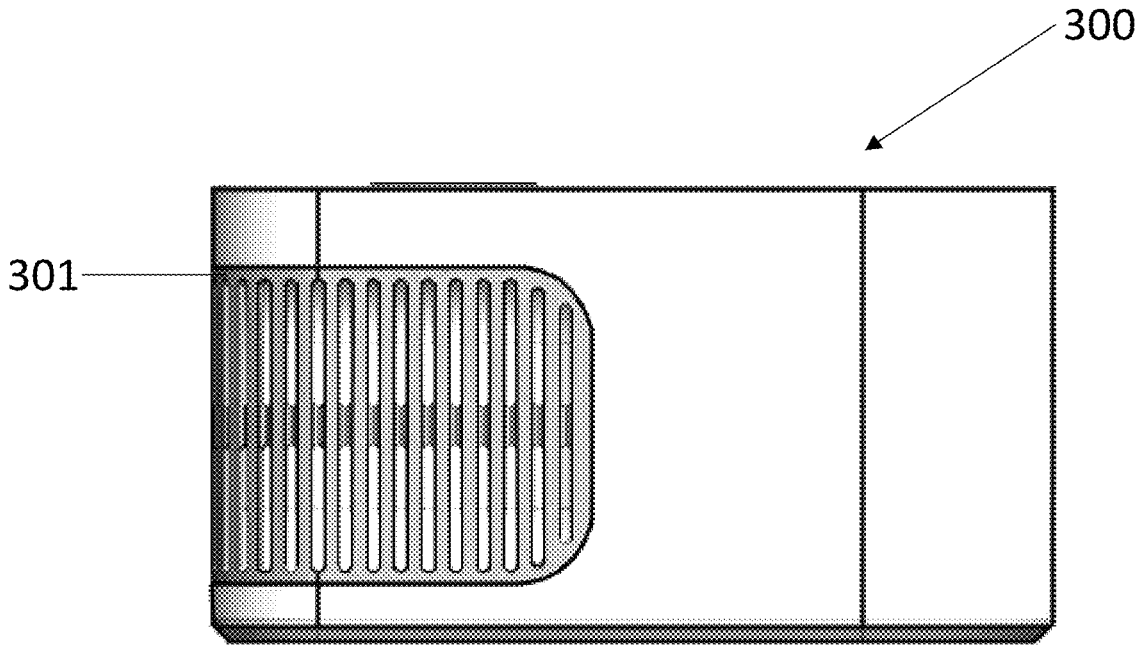
FIG. 18 is a front view of the control unit for a climate-control system of FIG. 16.

Many different designs of a chassis for a control unit and a reservoir for the control unit are contemplated herein. For example, FIGS. 16-18 show a control unit 300 having a top face including a power button 302, a display 304, a temperature decrease button 306, and a temperature increase button 307. In one embodiment, the display 304 is operable to show a current temperature of fluid passing into a thermally-controlled article and/or a setpoint temperature for fluid passing into the thermally-controlled article. A side wall of the control unit 300 includes an opening configured to receive a vent plate 301. The vent plate 301 includes a plurality of openings allowing heat to escape from the interior of the control unit 300. The control unit 301 includes a reservoir for fluid topped by a cap 308. In the embodiment shown in FIGS. 16-18, the cap 308 includes a central teardrop-shaped knob. In one embodiment, rotation of the teardrop-shaped knob causes the cap 308 to disconnect from the reservoir, such that additional fluid is able to be added to the reservoir. In one embodiment, the top face of the reservoir 309 surrounding the central teardrop-shaped knob is substantially transparent, such that a user is able to view an amount of remaining fluid in the reservoir without opening the cap 308.

Figure 19:
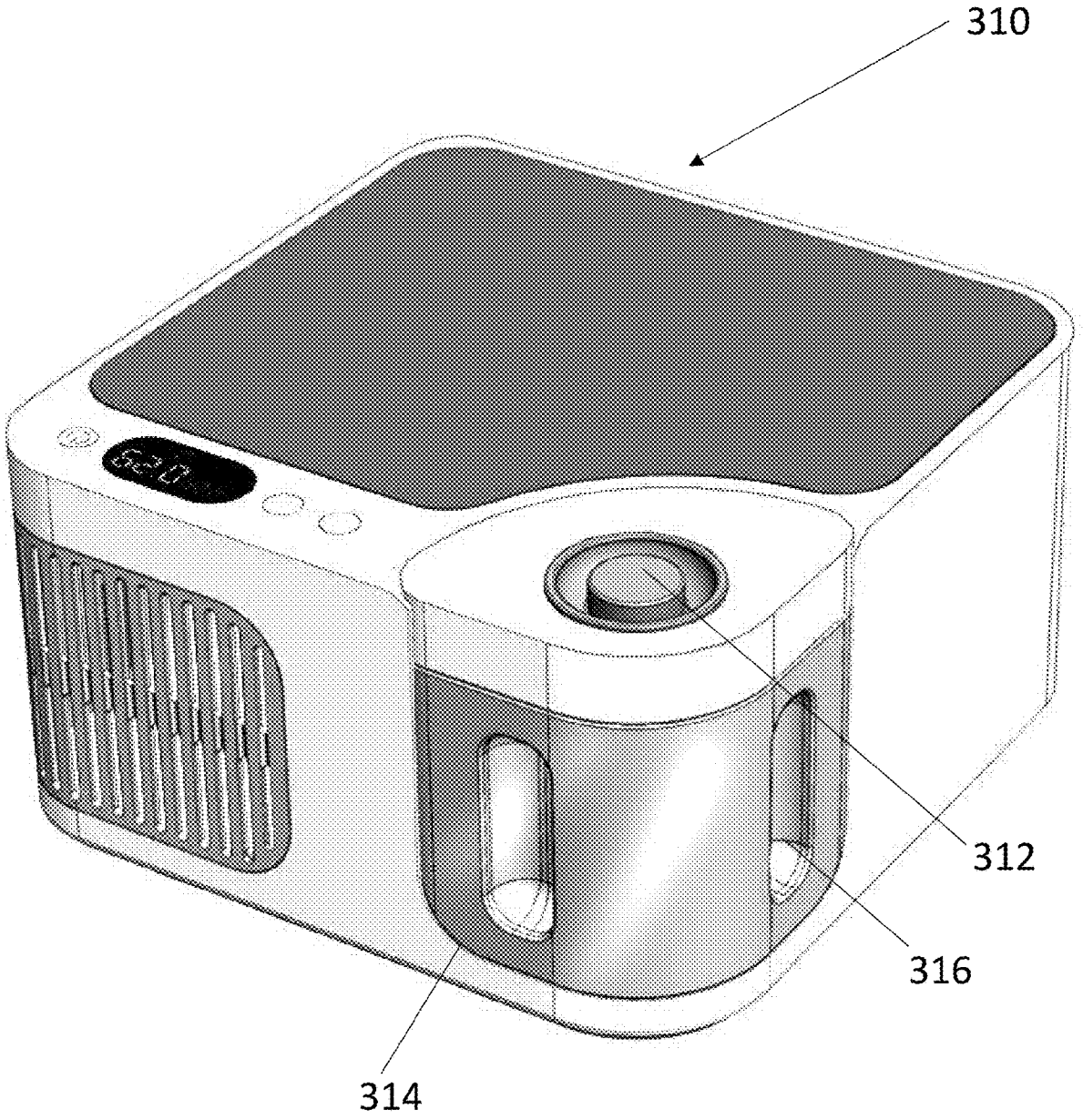
FIG. 19 is an isometric view of a control unit for a climate-control system according to one embodiment of the present invention.
Figure 20:
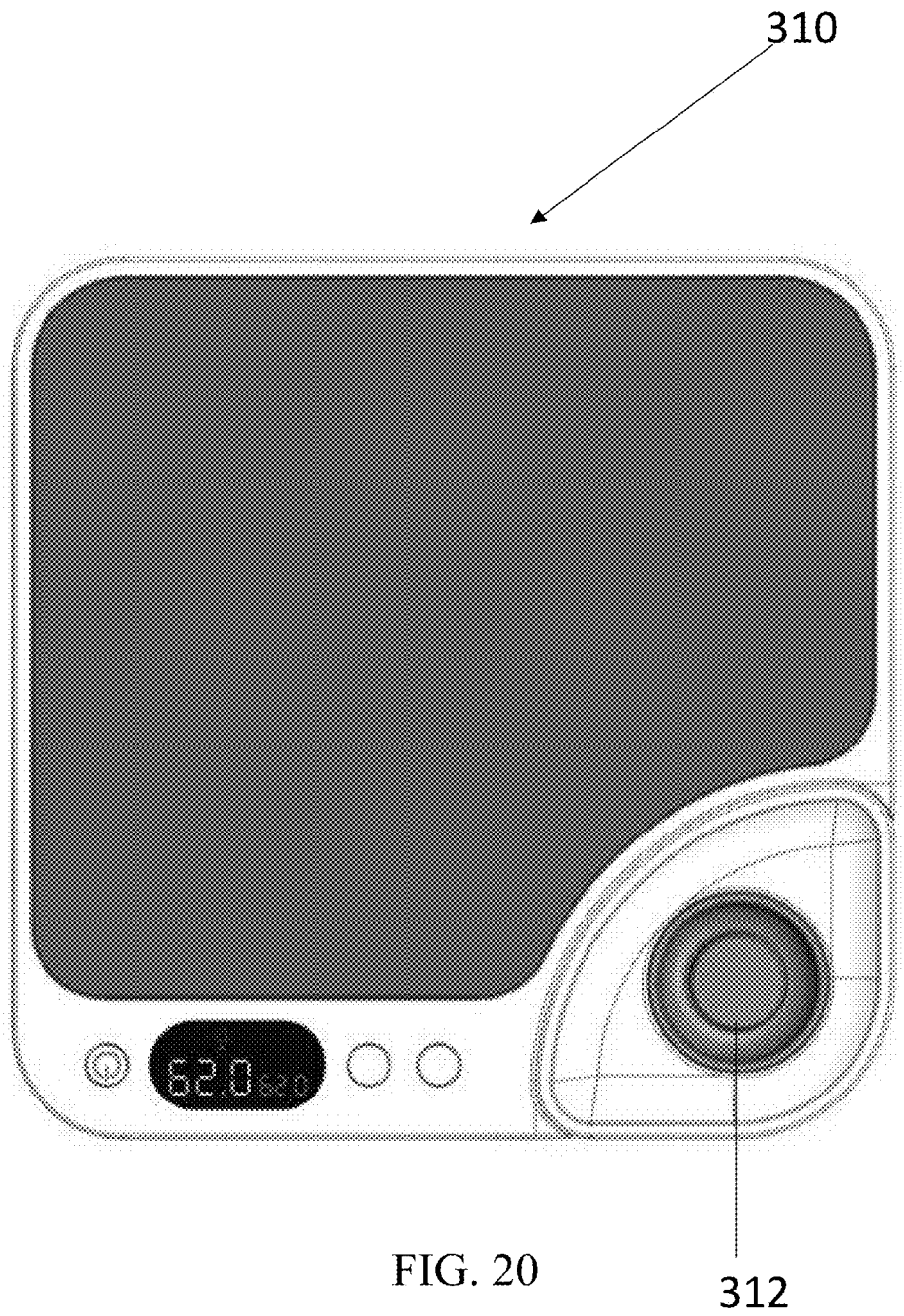
FIG. 20 is a top view of the control unit for a climate-control system of FIG. 19.
Figure 21:
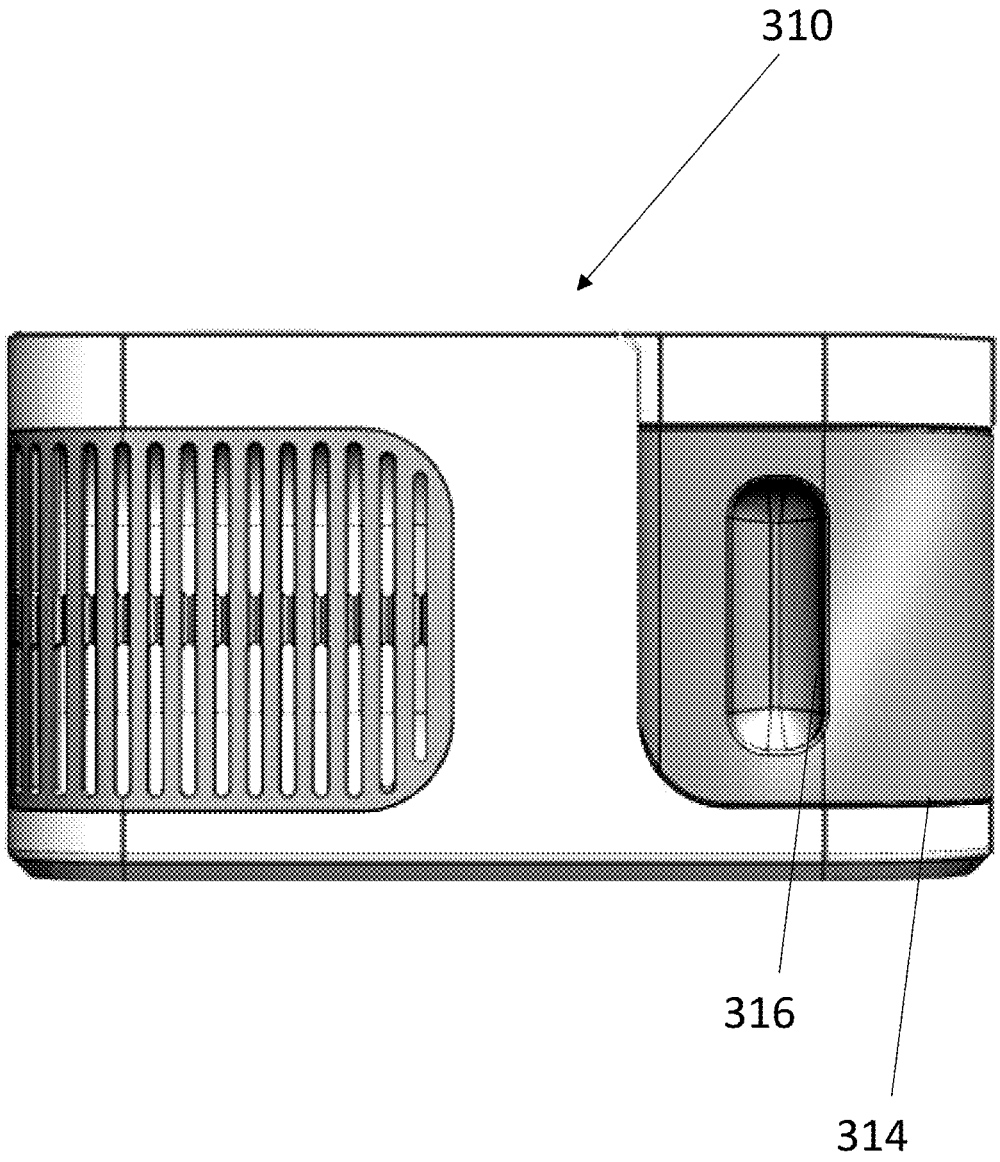
FIG. 21 is a front view of the control unit for a climate-control system of FIG. 19.

FIGS. 19-21 show a control unit 310 wherein the reservoir 314 is removable from the side of the control unit 310. FIG. 19 shows that a corner of the control unit 310 includes a carve out configured to receive the reservoir 314. The reservoir 314 includes grips 316 for ease of use in removing the reservoir 314. In some cases, the ability to remove the reservoir 314 entirely allows a user to more easily clean the reservoir 314 and fully replace the fluid in the reservoir 314. However, in one embodiment, the control unit 310 still includes a cap 312 covering an access port to the reservoir 314, for adding fluid to the reservoir 314 without removing the reservoir 314.

Figure 22:
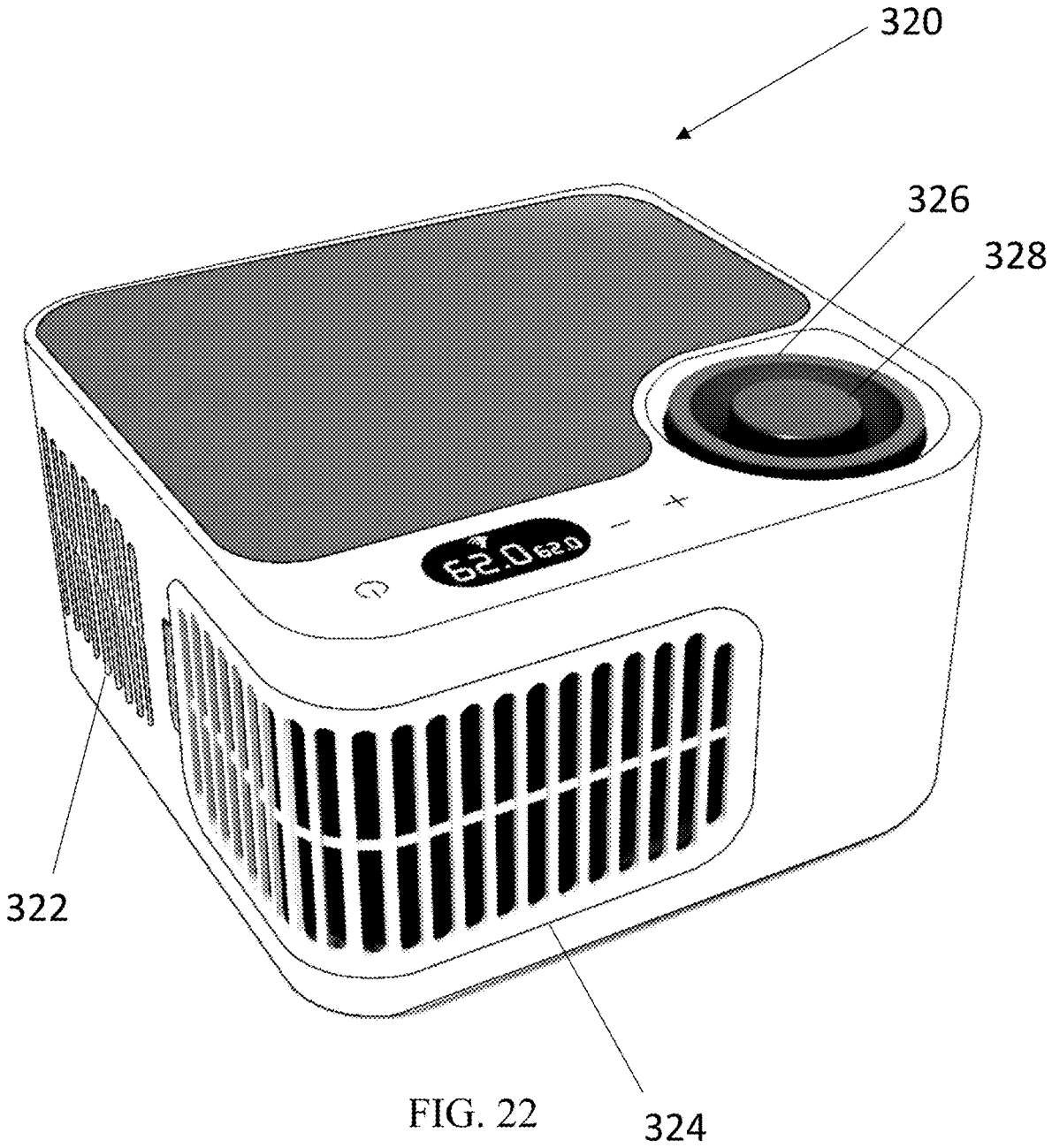
FIG. 22 is an isometric view of a control unit for a climate-control system according to one embodiment of the present invention.
Figure 23:
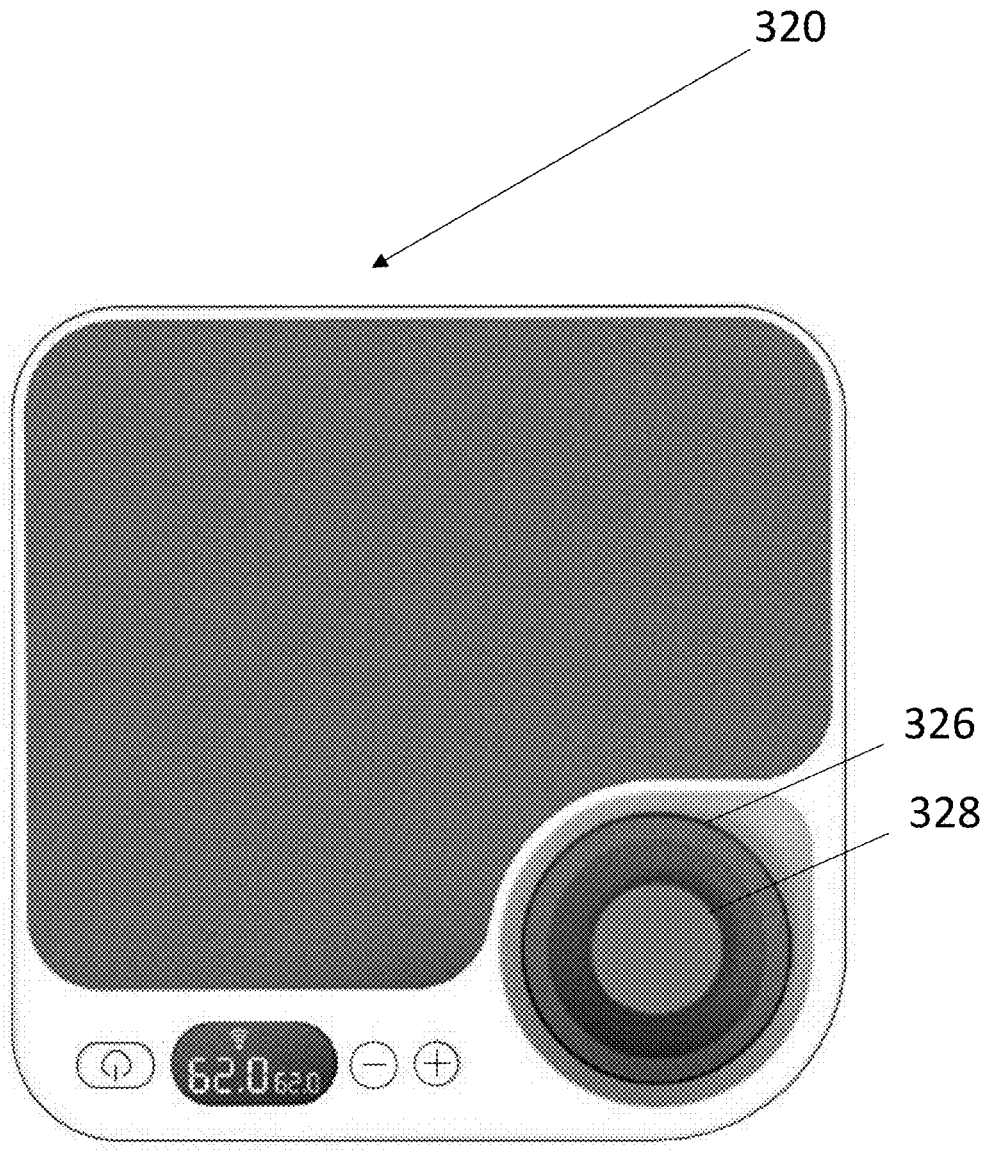
FIG. 23 is a top view of the control unit for a climate-control system of FIG. 22.
Figure 24:
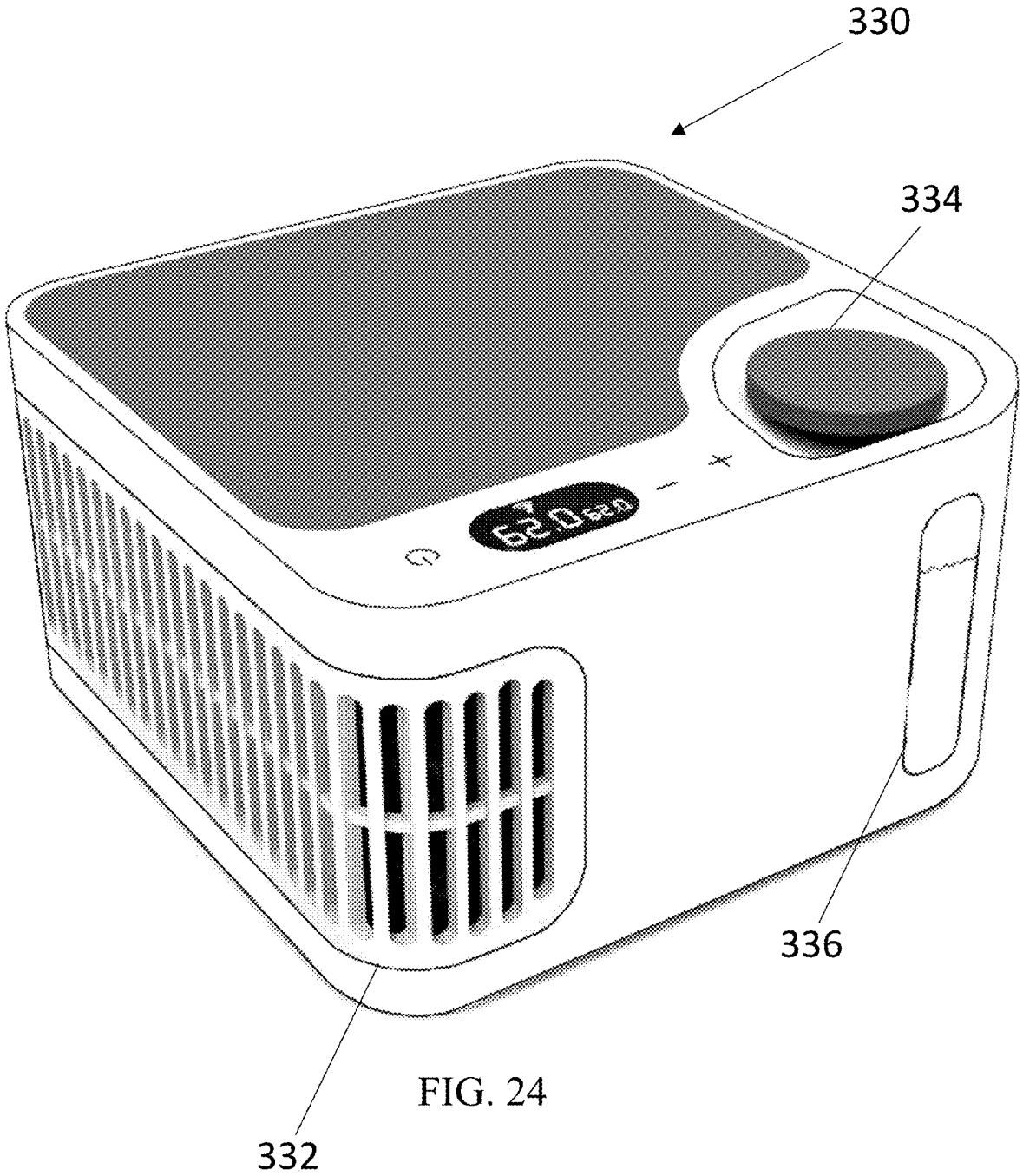
FIG. 24 is an isometric view of a control unit for a climate-control system according to one embodiment of the present invention.

FIGS. 22-23 show a control unit 320 including a vent plate 324 inserted into one corner of the control unit 320. Additionally, the control unit 320 includes a plurality of vent ports 322 covering another corner of the control unit 320. FIGS. 22-24 illustrate that vents able to be used for the present invention are not necessarily attached to a removable vent plate, but also are able to include perforations in the side wall of the chassis itself. Additionally, the control 320 includes a cap covering an access port to a reservoir. In one embodiment, the cap includes an outer rim 326 and a circular central knob 328, with a gap between the outer rim 326 and the circular central knob 328. Providing a gap between the outer rim 326 and the circular central knob 328 allows the cap to be more easily gripped and removed from the control unit 320.

Figure 25:
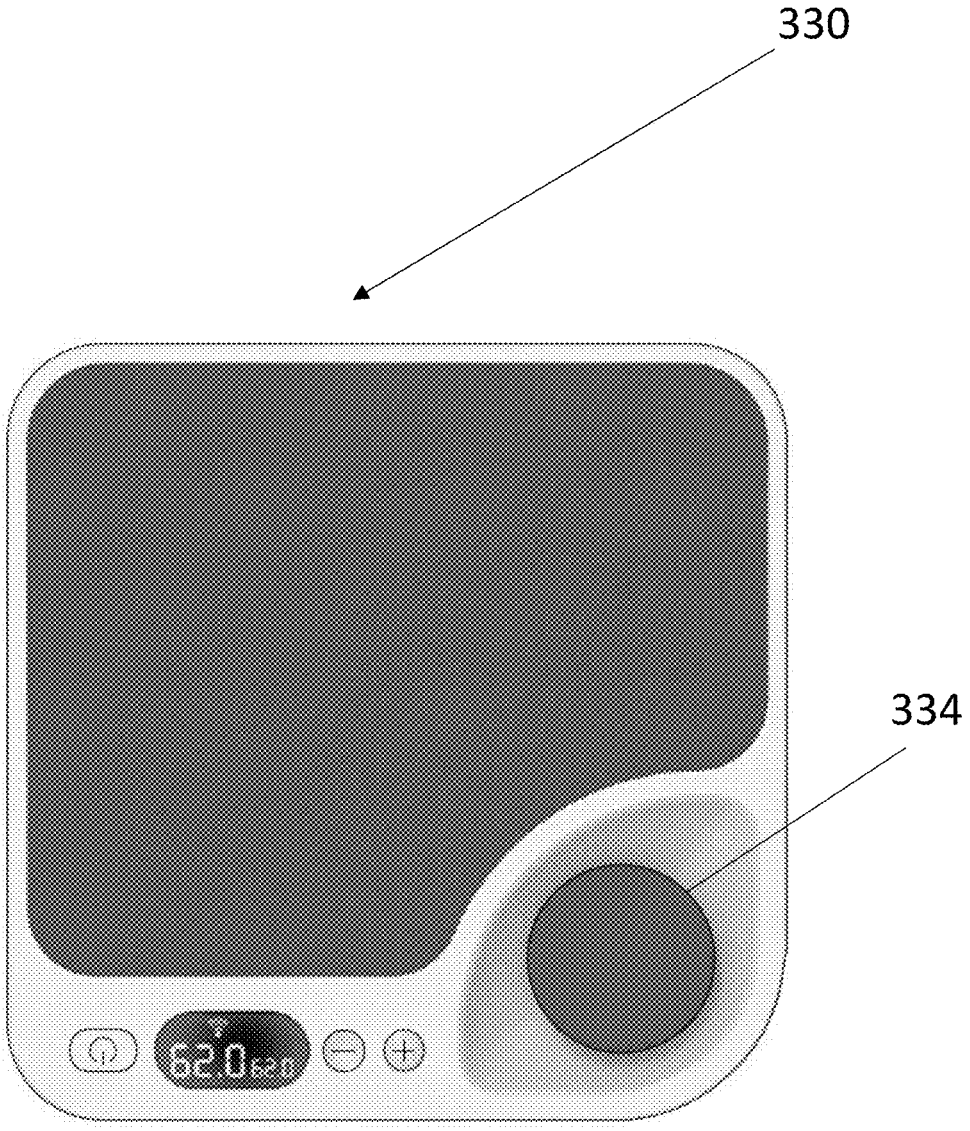
FIG. 25 is a top view of the control unit for a climate-control system of FIG. 24.
Figure 26:
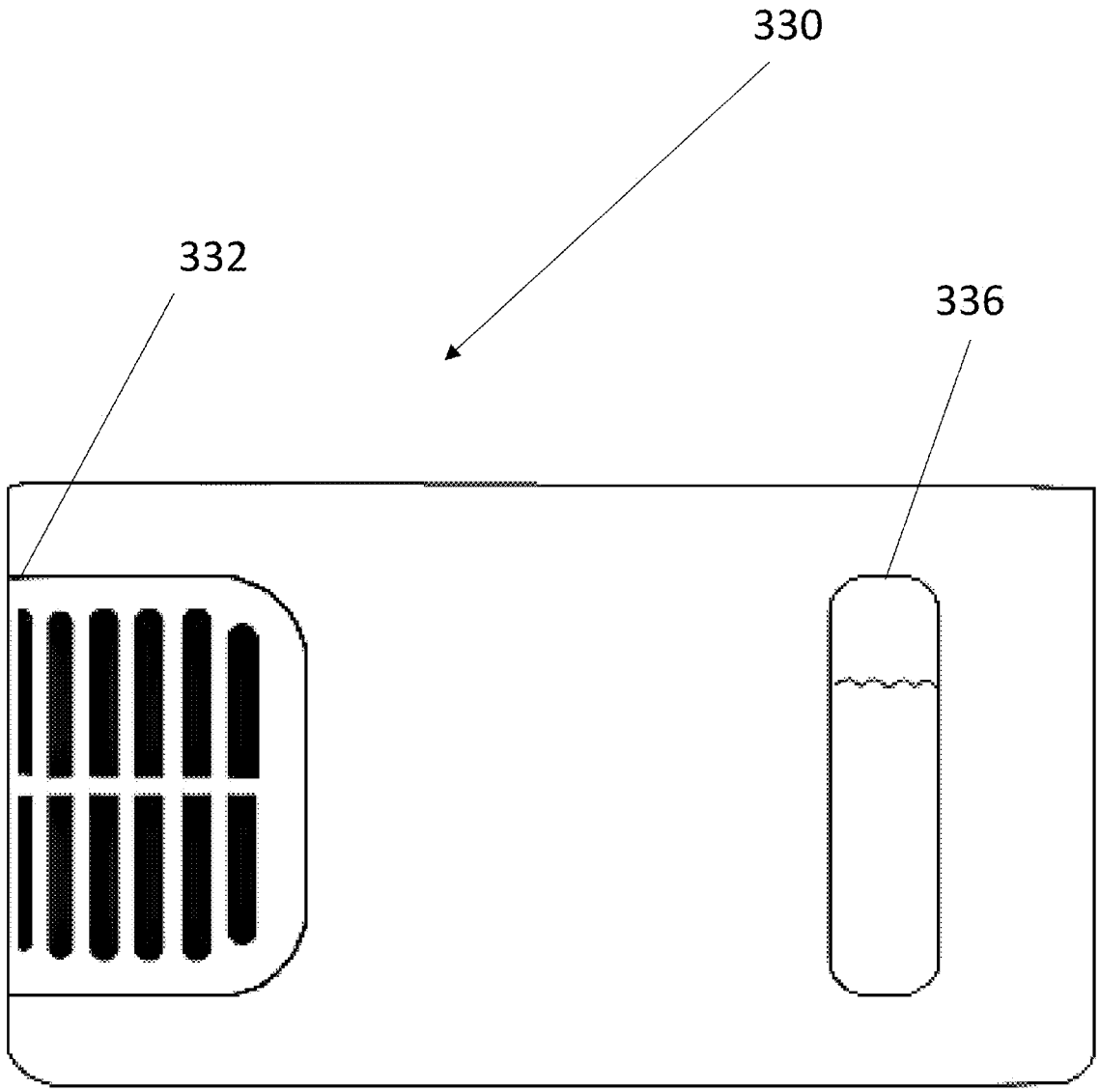
FIG. 26 is a front view of the control unit for a climate-control system of FIG. 24.

FIGS. 24-26 show a control unit 330 having a single vent plate 332 spanning multiple corners of the control unit 330. Comparing FIGS. 24-26 to FIGS. 22-23 shows that the relative size and length of the vent plate 332 for the control unit 330 is able to be varied. In one embodiment, the control unit 330 includes a cap 334 covering an access port to a fluid reservoir. In one embodiment, a side wall of the control unit 330 includes a window 336 proximate to the fluid reservoir. The window 336 is substantially transparent such that an amount of remaining fluid in the fluid reservoir is visible.

Figure 27:
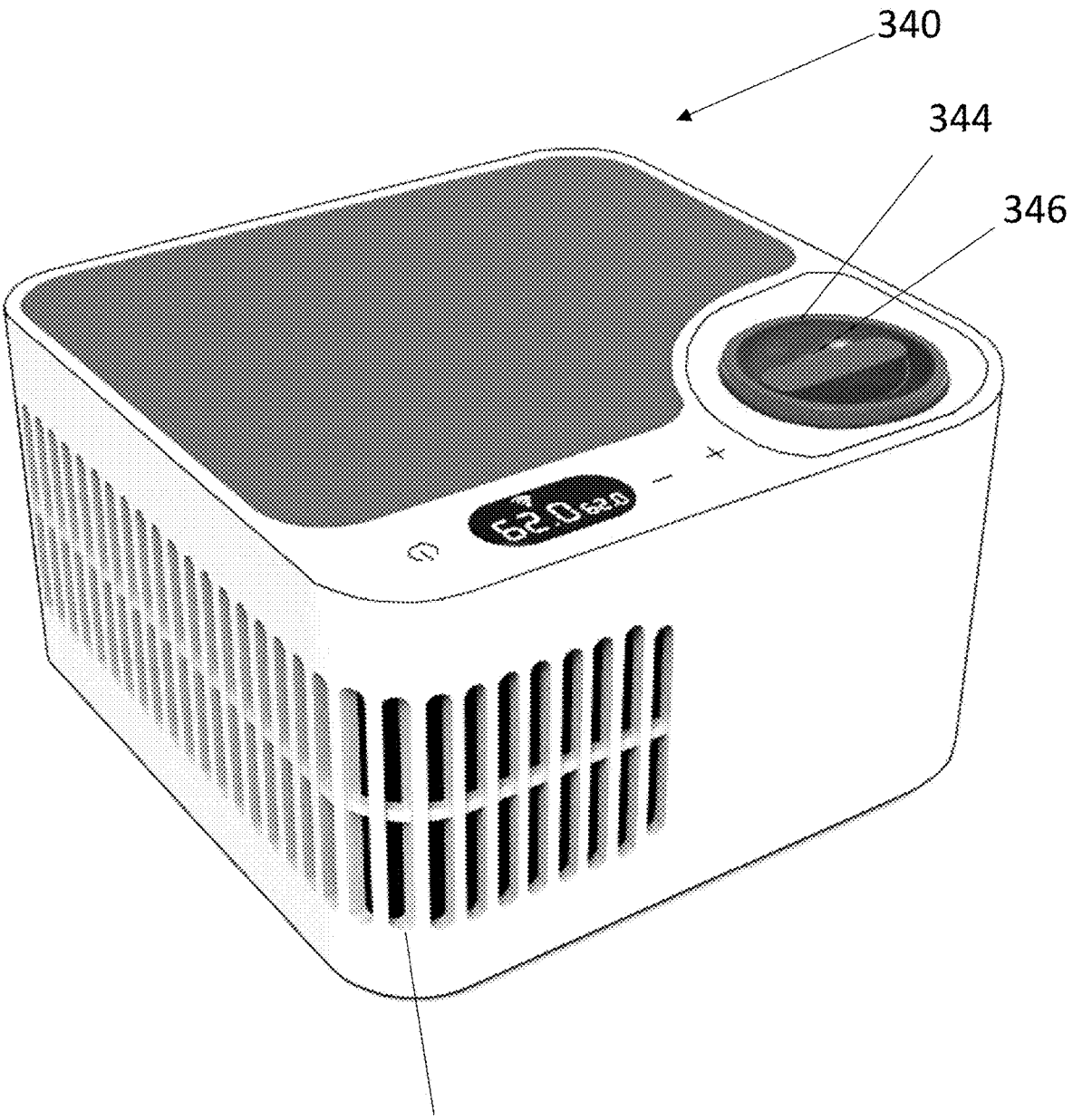
FIG. 27 is an isometric view of a control unit for a climate-control system according to one embodiment of the present invention.
Figure 28:
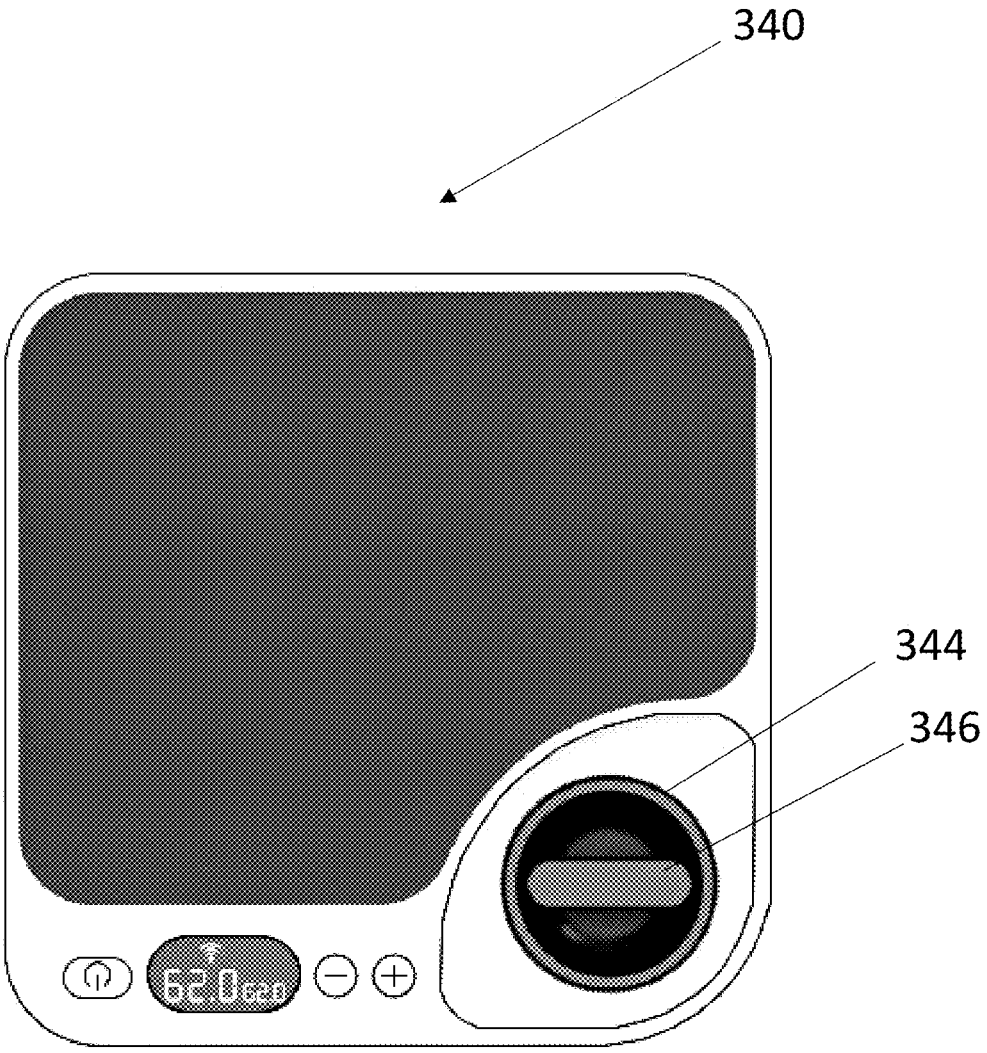
FIG. 28 is a top view of the control unit for a climate-control system of FIG. 27.
Figure 29:
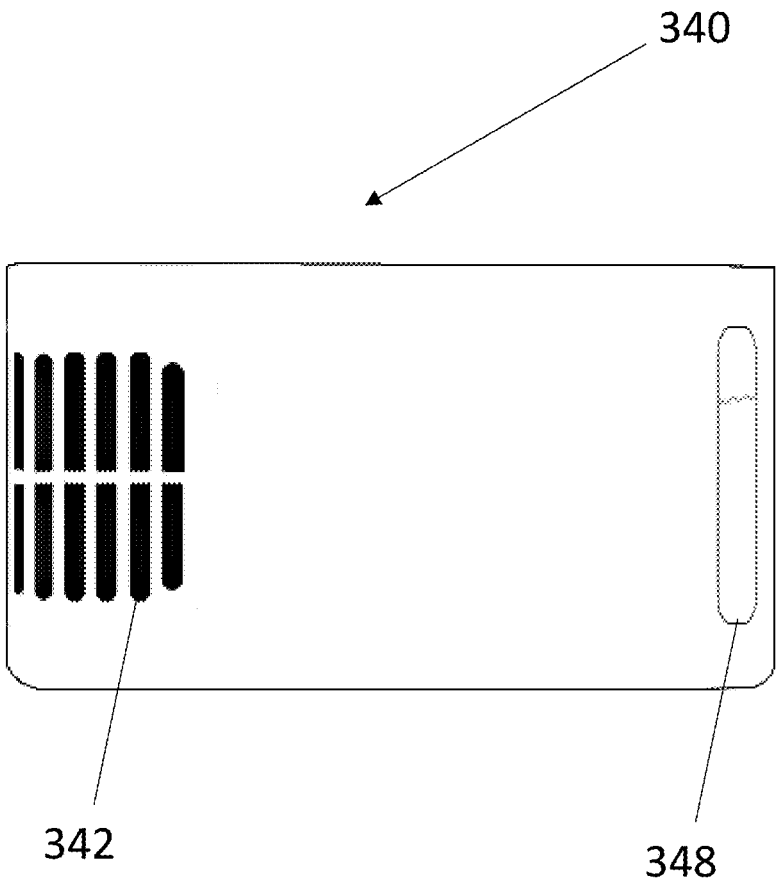
FIG. 29 is a front view of the control unit for a climate-control system of FIG. 27.

FIGS. 27-29 show a control unit 340, wherein at least one side wall of the control unit 340 includes a plurality of vent openings 342. One of ordinary skill in the art will understand that the use of detachable vent plates or integrally formed vent openings are substantially interchangeable for the control unit 340, as well as the size and grouping of any detachable vent plates or groups of integrally formed vent openings. In one embodiment, the control unit 340 includes a cap 344 having a central knob 346. As shown in FIGS. 16, 22, and 27, the shape of the central knob 346 is able to be varied. Additionally, as shown in FIG. 29, in one embodiment, the control unit includes a substantially transparent window 348. In one embodiment, the substantially transparent window 348 integrally formed with a portion of the side wall of the control unit 340 and is located at a corner of the control unit 340 proximate to the reservoir.

Figure 30:
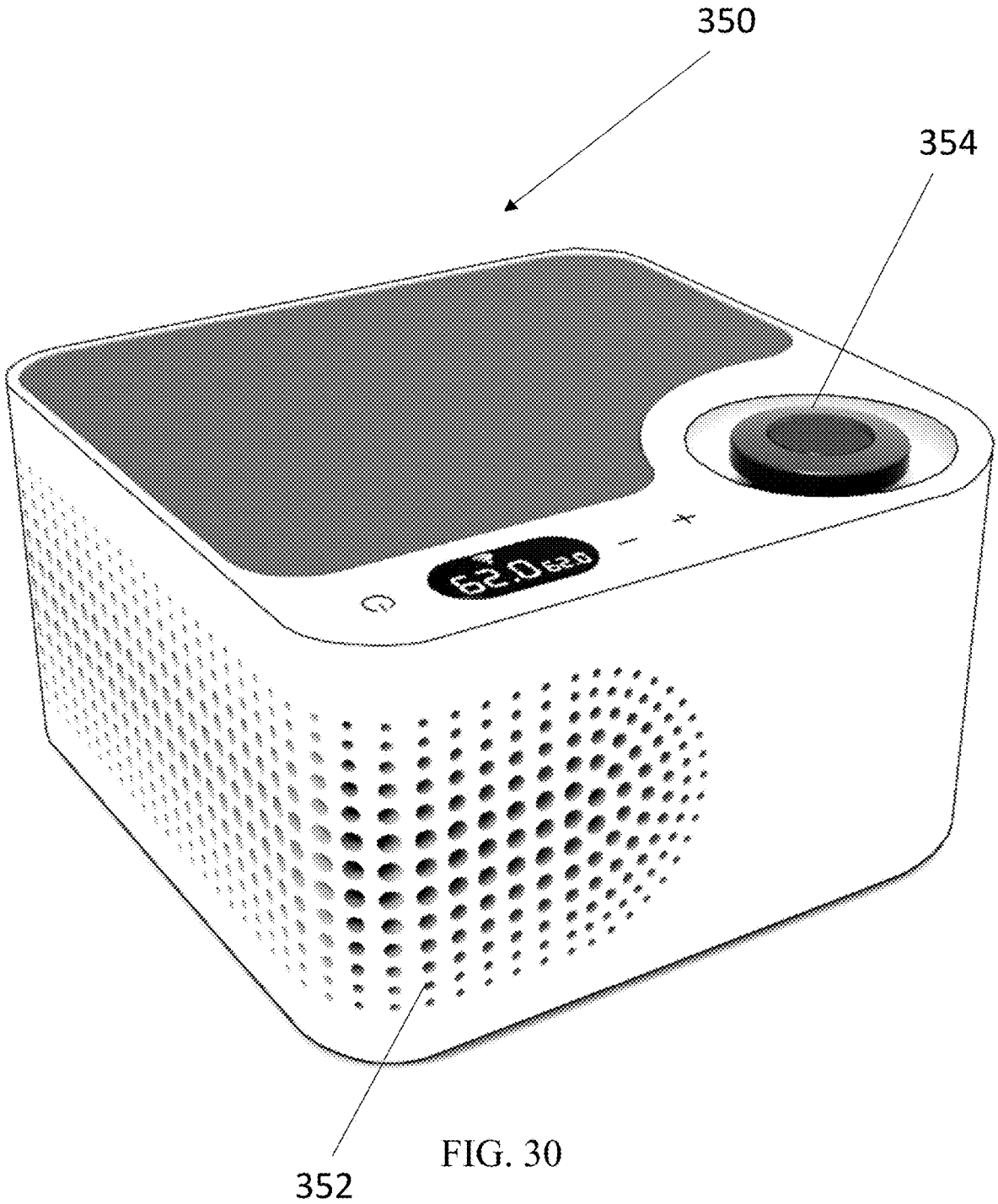
FIG. 30 is an isometric view of a control unit for a climate-control system according to one embodiment of the present invention.
Figure 31:
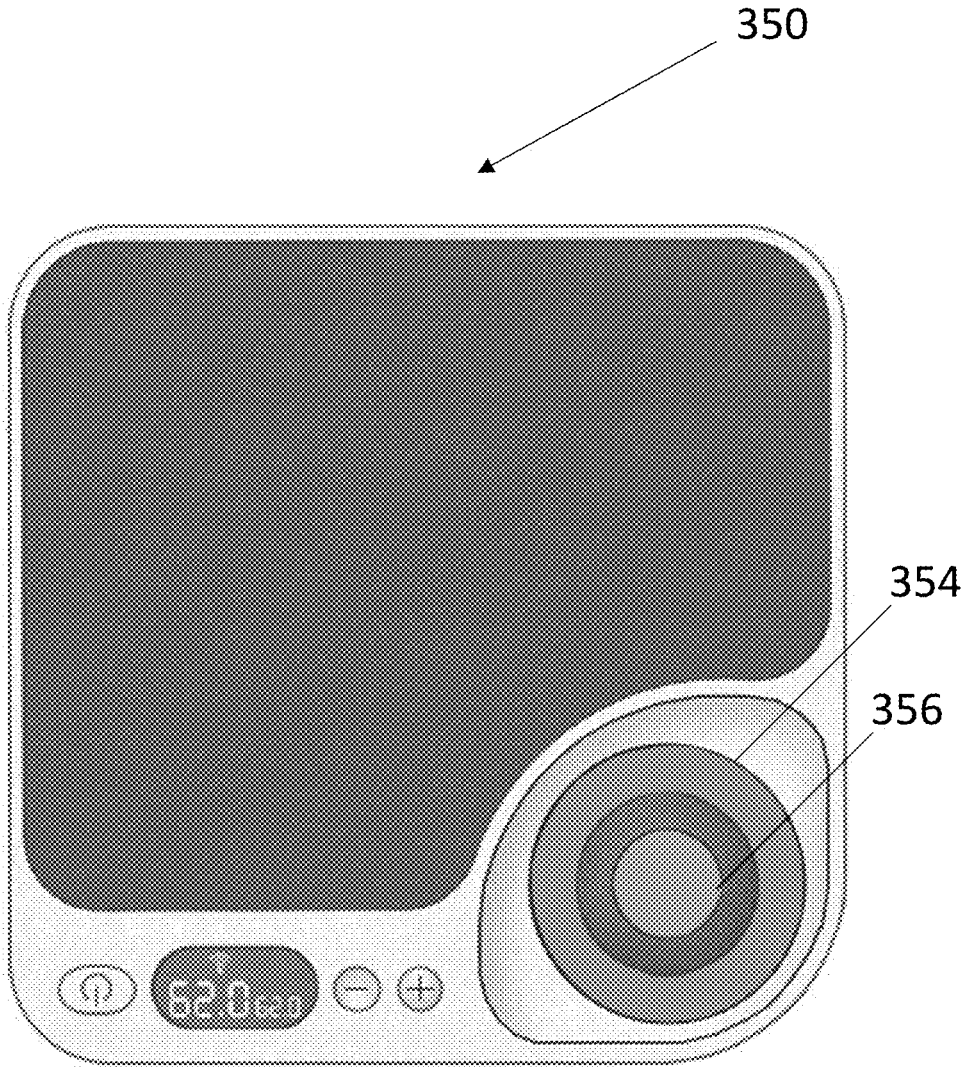
FIG. 31 is a top view of the control unit for a climate-control system of FIG. 30.
Figure 32:
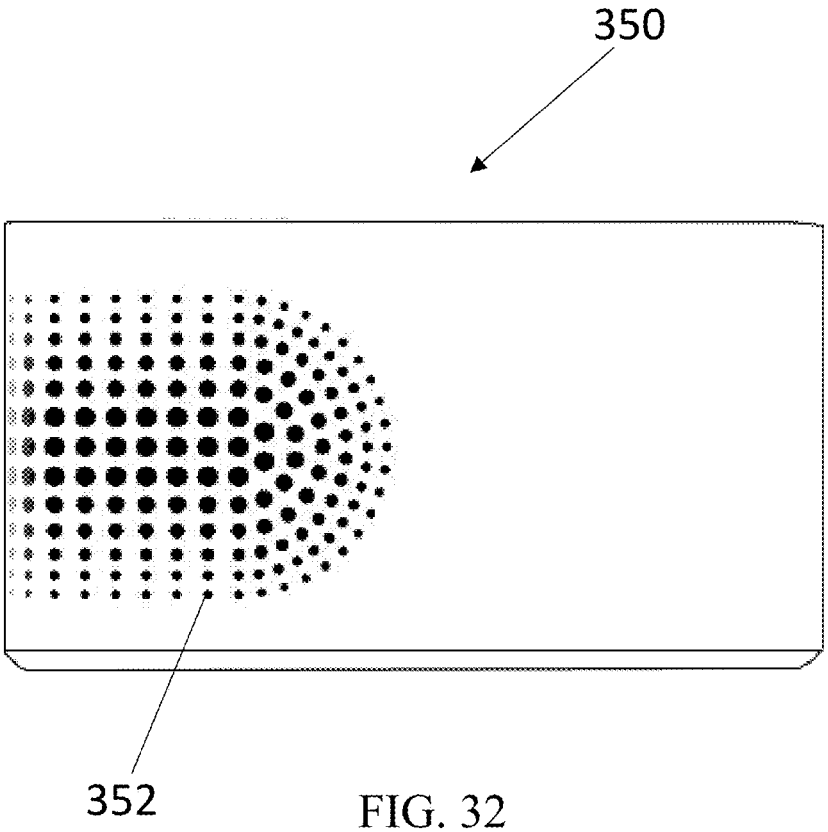
FIG. 32 is a front view of the control unit for a climate-control system of FIG. 30.

FIGS. 30-32 show a control unit 350 having a side wall including a plurality of vent openings 352 organized in a half-tone pattern. A half-tone pattern is defined as a pattern wherein shapes nearer to the center of the pattern are larger than shapes nearer to the periphery of the pattern. FIGS. 30-32 show that the pattern of vent openings is not limited to rounded rectangular vents as shown, for example, in FIGS. 27-29, but is able to include a wide variety of vent opening shapes and patterns. In one embodiment, the control unit 350 includes a cap 354 covering an access port to a fluid reservoir. In one embodiment, a center portion 356 of the cap 354 is substantially transparent such that an amount of fluid remaining in the fluid reservoir is visible.

Figure 33:
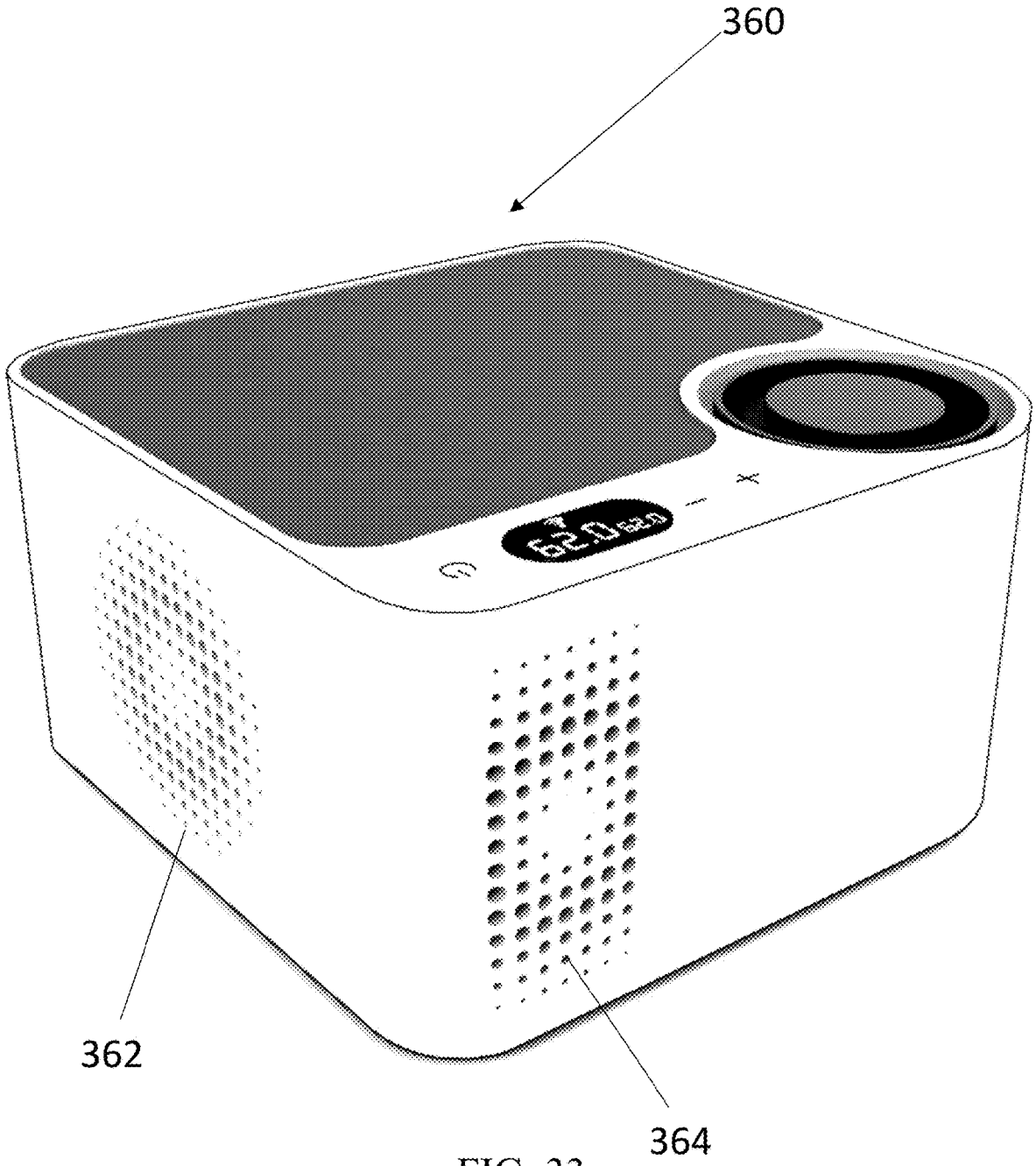
FIG. 33 is an isometric view of a control unit for a climate-control system according to one embodiment of the present invention.
Figure 34:
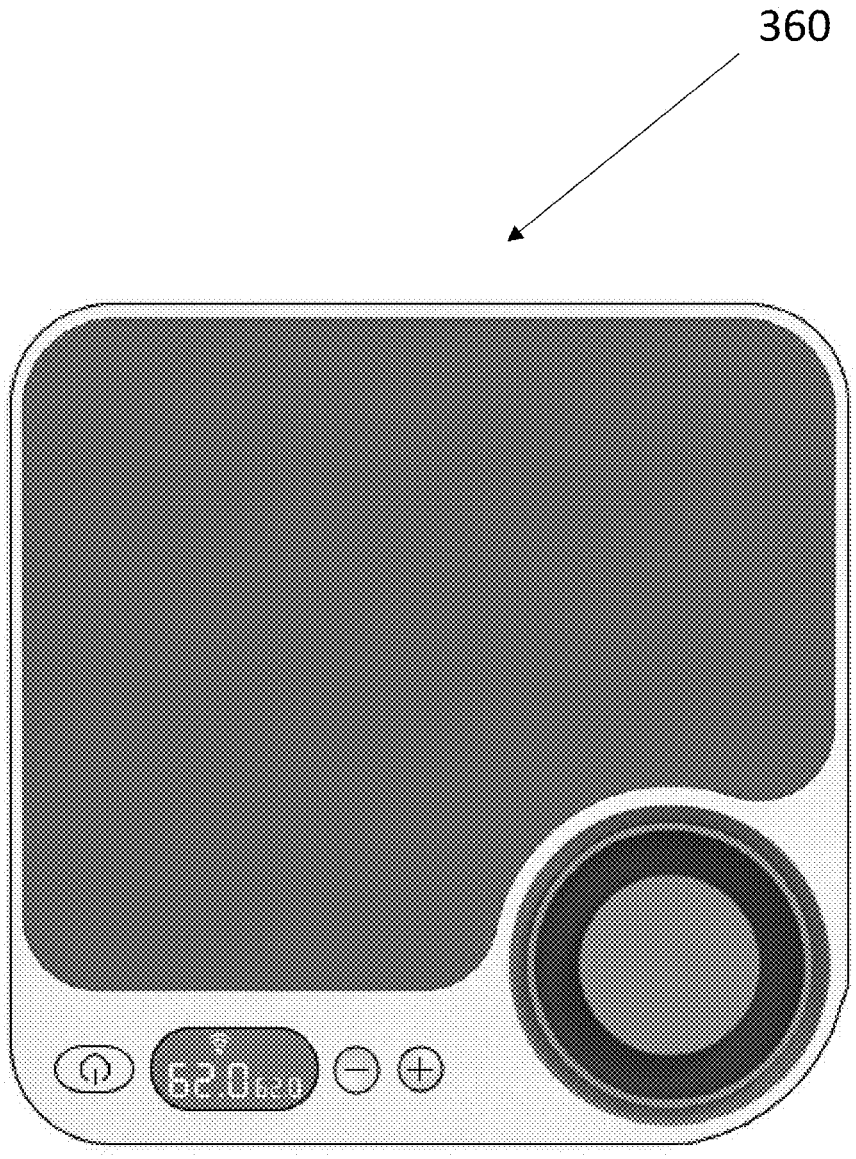
FIG. 34 is a top view of the control unit for a climate-control system of FIG. 33.
Figure 35:
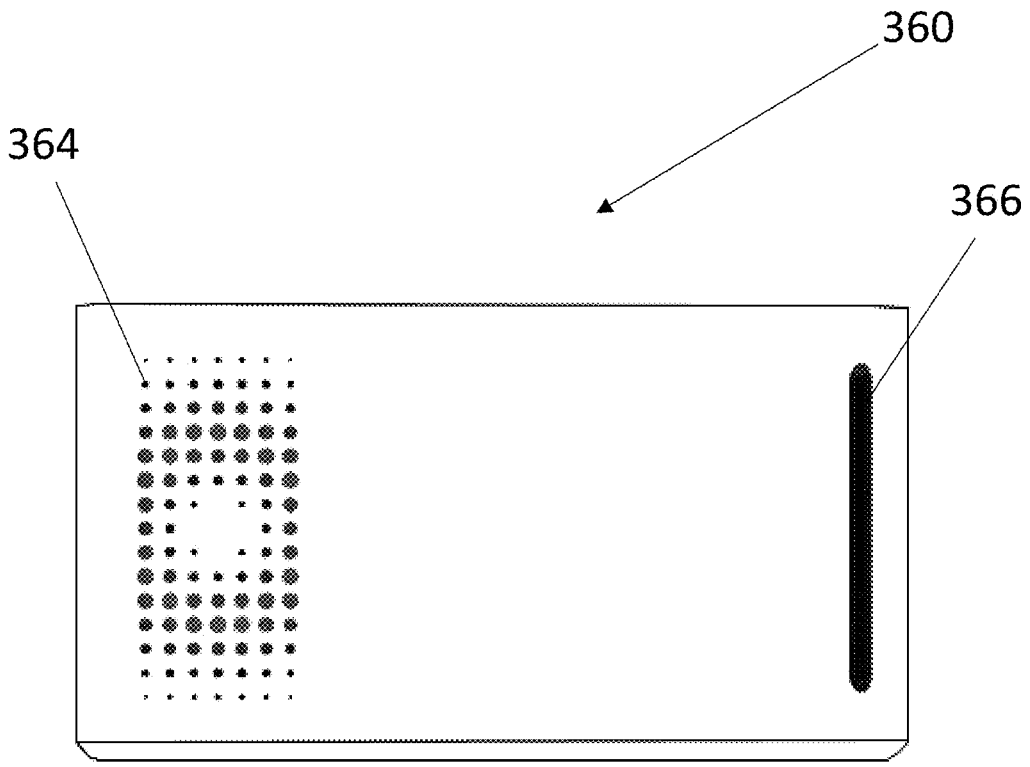
FIG. 35 is a front view of the control unit for a climate-control system of FIG. 33.

FIGS. 33-35 show a control unit 360 having a first plurality of vent openings 362 and a second plurality of vent openings 364. In one embodiment, the first plurality of vent openings 362 is a circular half-tone pattern of vent openings. In one embodiment, the second plurality of vent openings 364 is a rectangular half-tone pattern of vent openings. In one embodiment, the center of the first plurality of vent openings and/or the center of the second plurality of vent openings does not include any vent openings. One of ordinary skill in the art will understand that the pattern of vent openings is able to be varied and is not limited to those patterns shown in FIGS. 33-35. In one embodiment, as shown in FIG. 35, the side wall of the control unit 360 includes at least one substantially transparent window 366.

Figure 36:
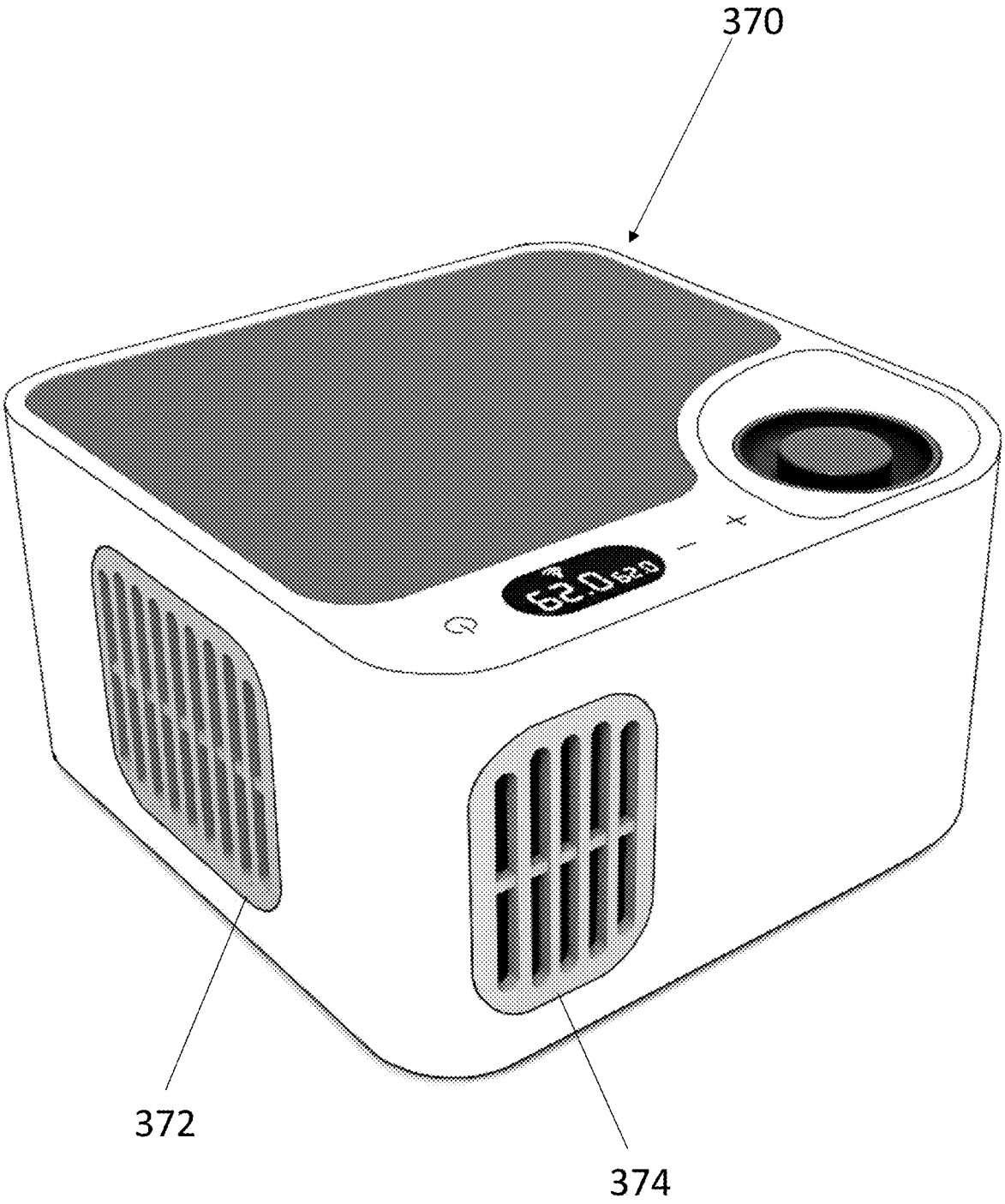
FIG. 36 is an isometric view of a control unit for a climate-control system according to one embodiment of the present invention.
Figure 37:
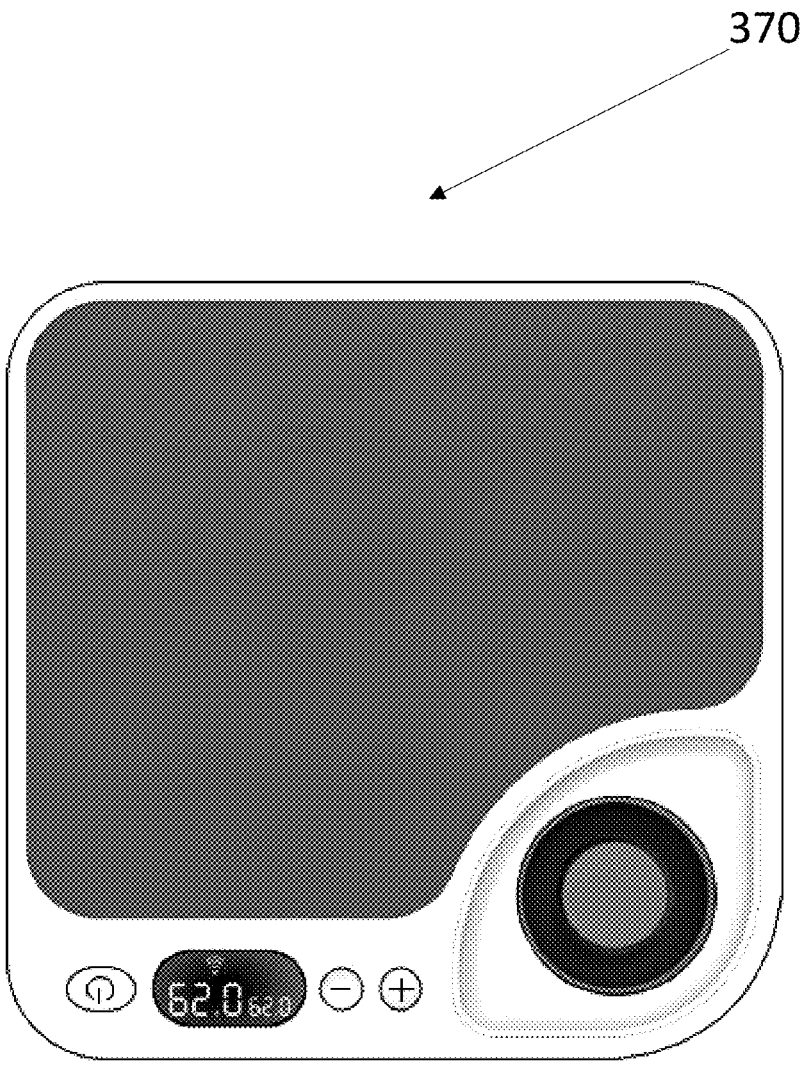
FIG. 37 is a top view of the control unit for a climate-control system of FIG. 36.
Figure 38:
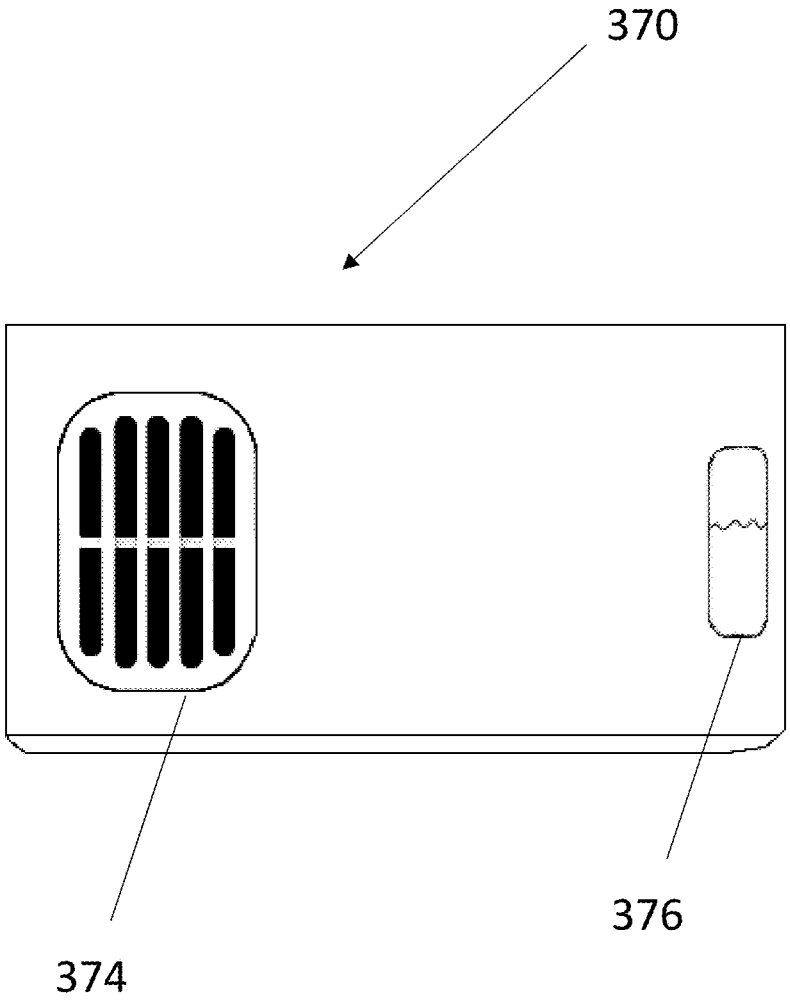
FIG. 38 is a front view of the control unit for a climate-control system of FIG. 36.

FIGS. 36-38 show a control unit 370 having a first vent plate 372 and a second vent plate 374. FIGS. 36-38, as well as FIGS. 33-35, show that vents do not necessarily need to be positioned at corners of the control unit 370, and are able to be placed at other sections of the side wall of the control unit 370 as well. In one embodiment, the control unit 370 includes at least one substantially transparent window 376 such that an amount of fluid remaining in a fluid reservoir is visible.

Figure 39:
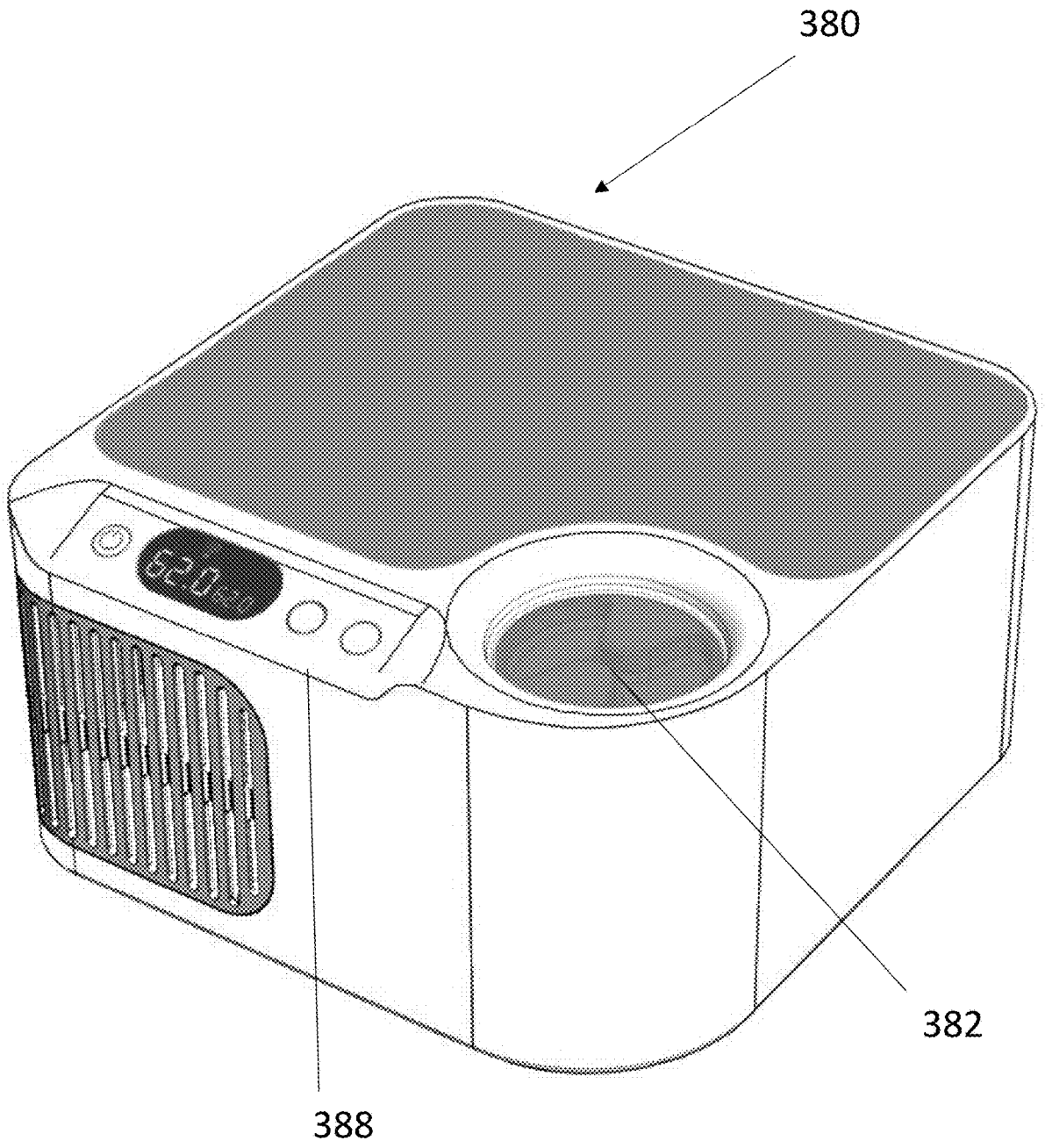
FIG. 39 is an isometric view of a control unit for a climate-control system according to one embodiment of the present invention.
Figure 40:
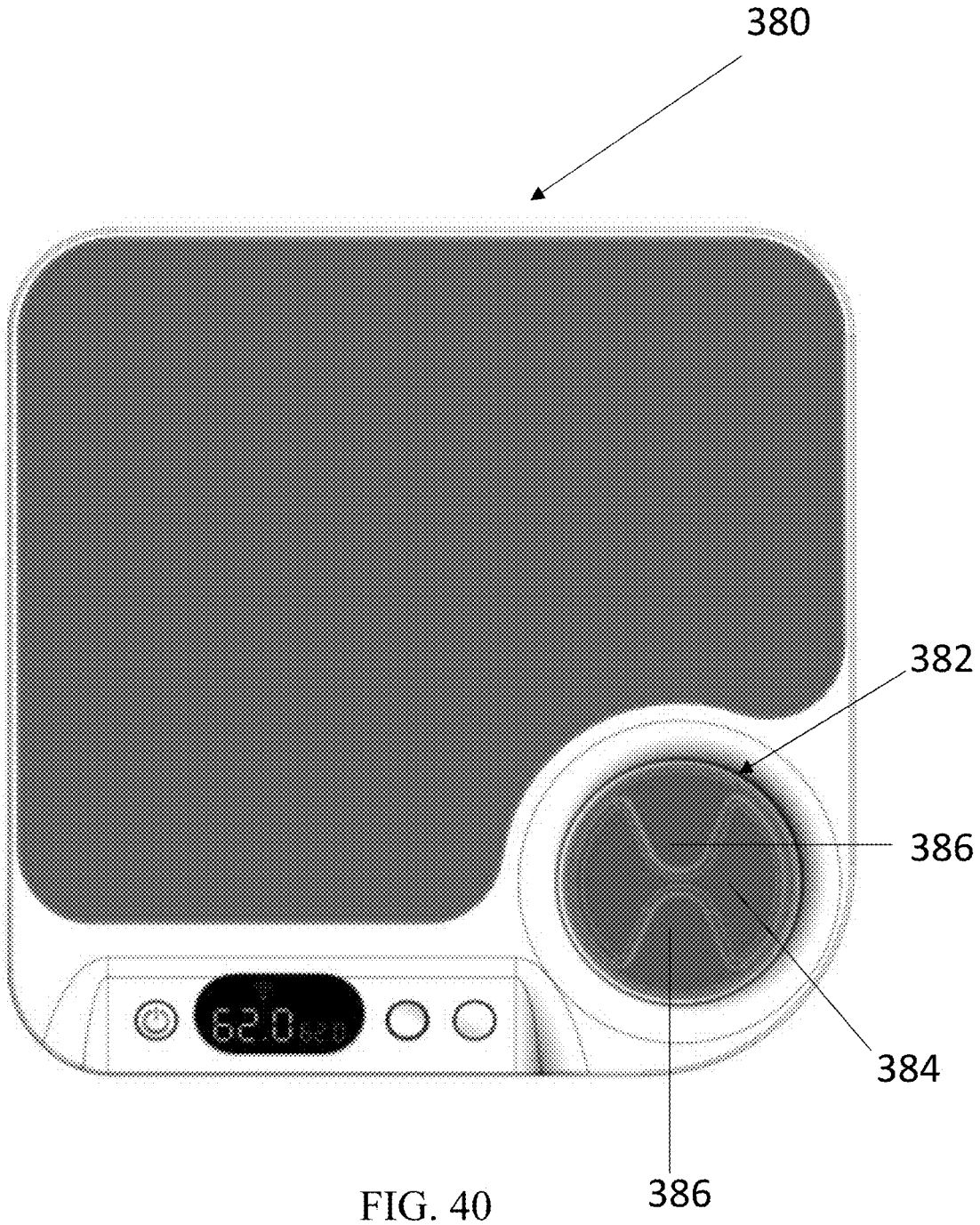
FIG. 40 is a top view of the control unit for a climate-control system of FIG. 39.
Figure 41:
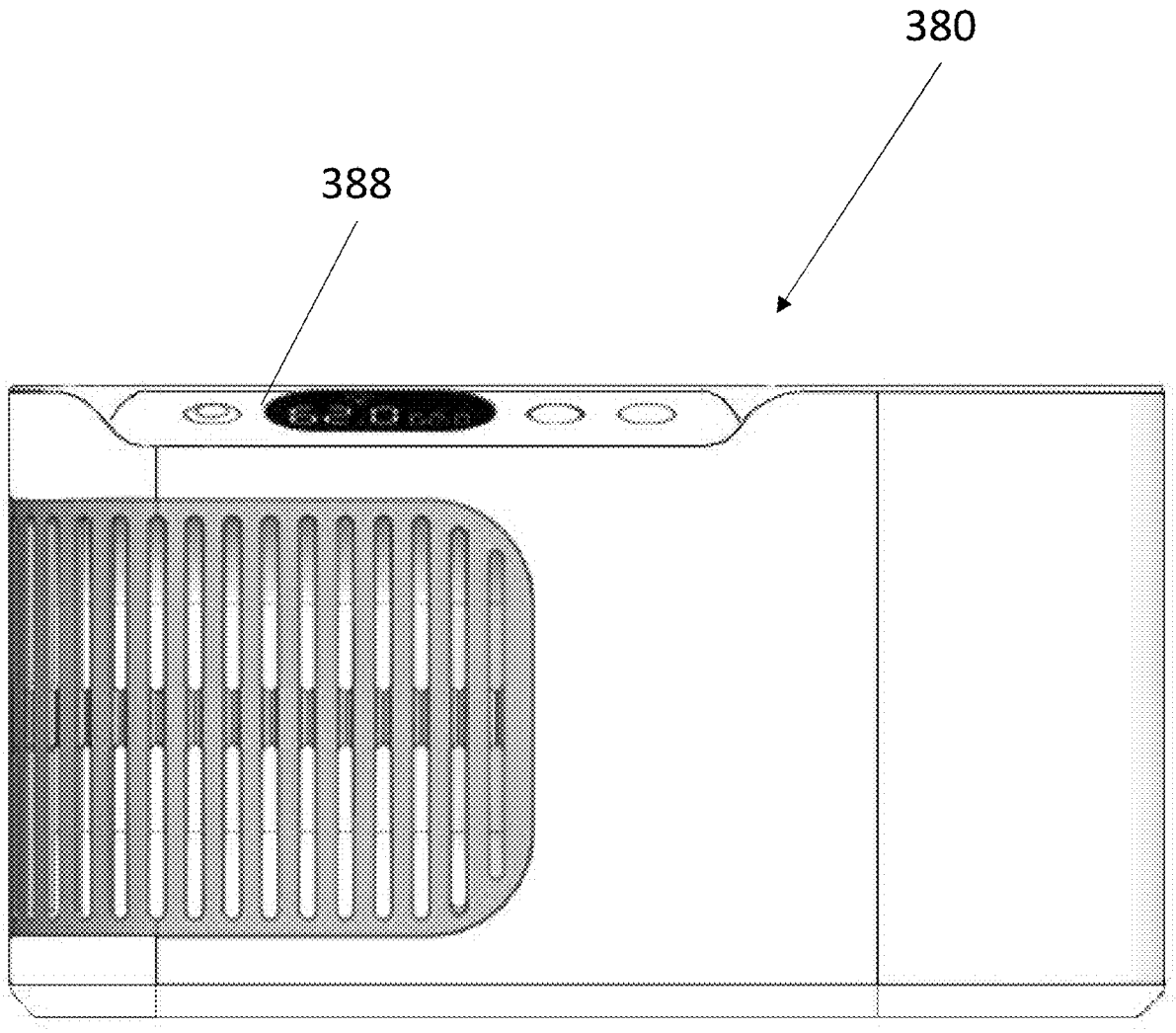
FIG. 41 is a front view of the control unit for a climate-control system of FIG. 39.

FIGS. 39-41 show a control unit 380 having a cap 382 covering an access port to a reservoir. The top surface of the cap 382 includes a recessed portion 384 surrounding a plurality of prongs 386 extending inwardly from a rim of the cap 382. The plurality of prongs 386 provide a grip for rotating and removing the cap 382. Furthermore, in one embodiment, the control unit includes a chamfer 388 between a side wall of the control unit 380 and the top surface of the control unit 380. In one embodiment, the chamfer 388 includes a control panel for the control unit 380 including, for example, a power button, a display, and/or other buttons for operating the control unit 380.

Figure 42:
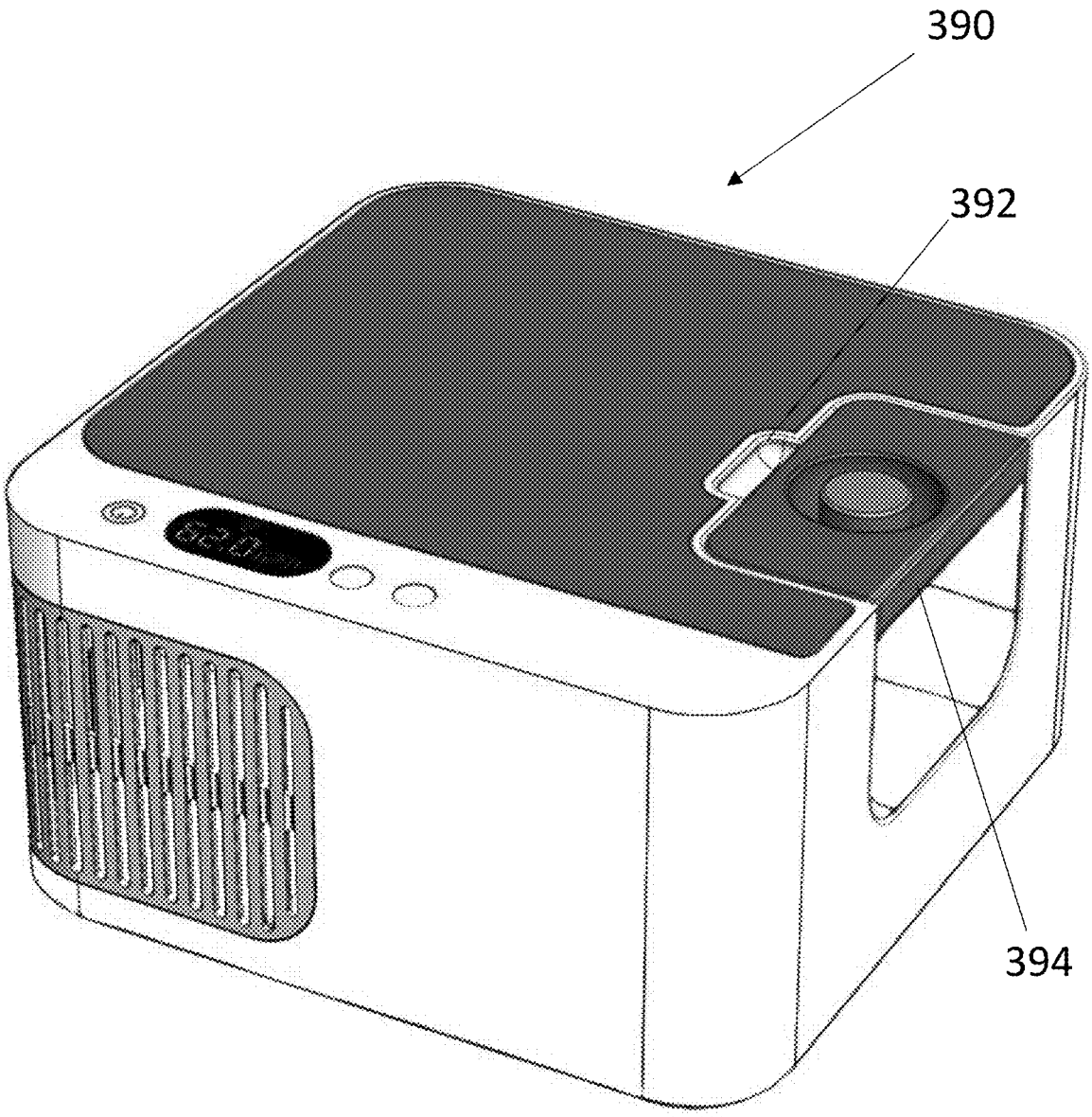
FIG. 42 is an isometric view of a control unit for a climate-control system according to one embodiment of the present invention.
Figure 43:
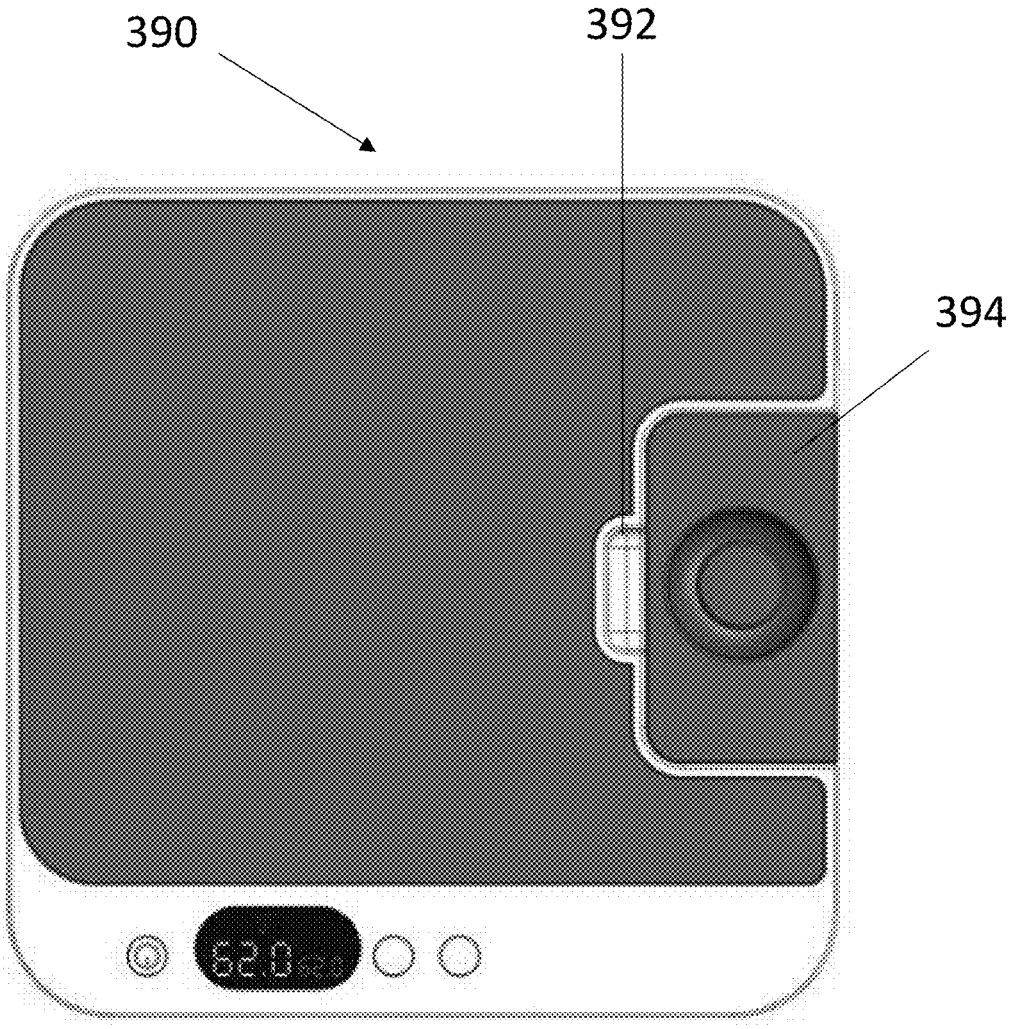
FIG. 43 is a top view of the control unit for a climate-control system of FIG. 42.
Figure 44:
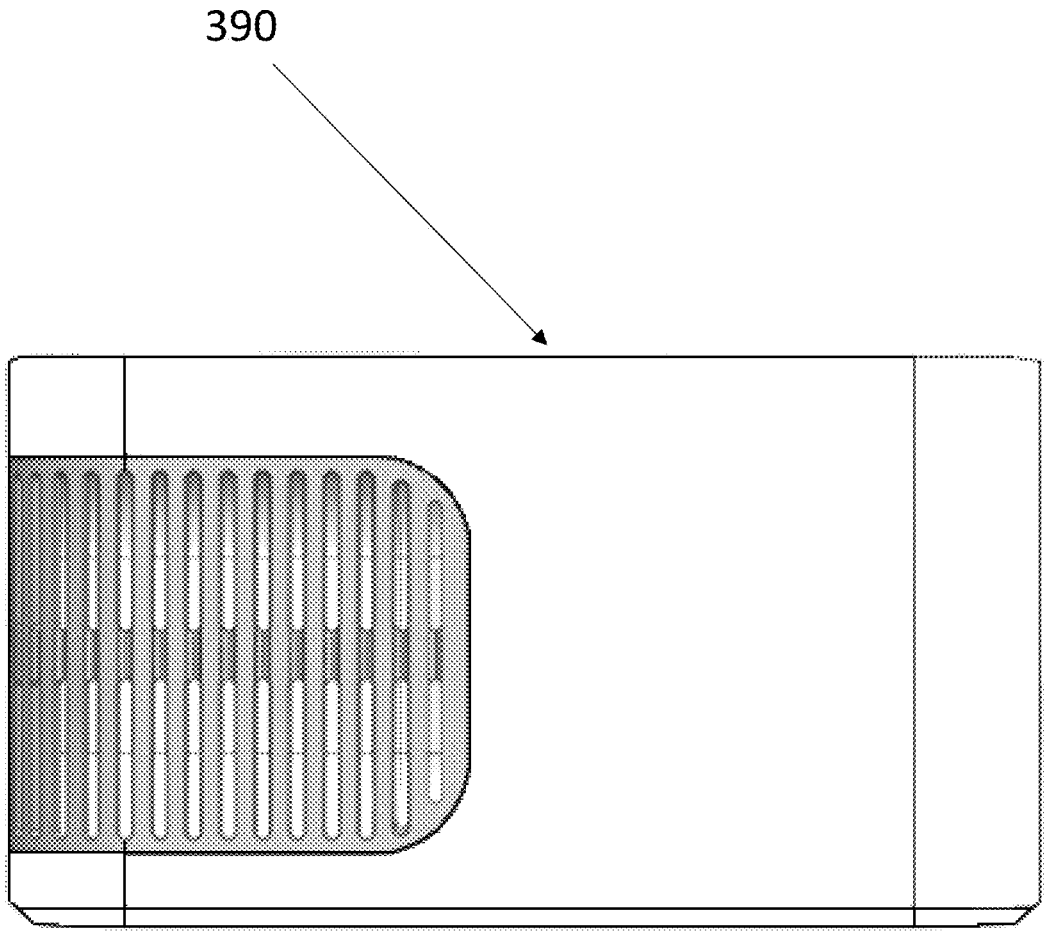
FIG. 44 is a front view of the control unit for a climate-control system of FIG. 42.

FIGS. 42-44 show a control unit 390 wherein a side wall and a top surface of the control 390 include a carveout configured to receive a removable fluid cartridge 394. In one embodiment, an indentation 392 is positioned proximate to the carveout. The indentation 392 assists in removing the fluid cartridge 394 from the control unit 390.

Figure 45:
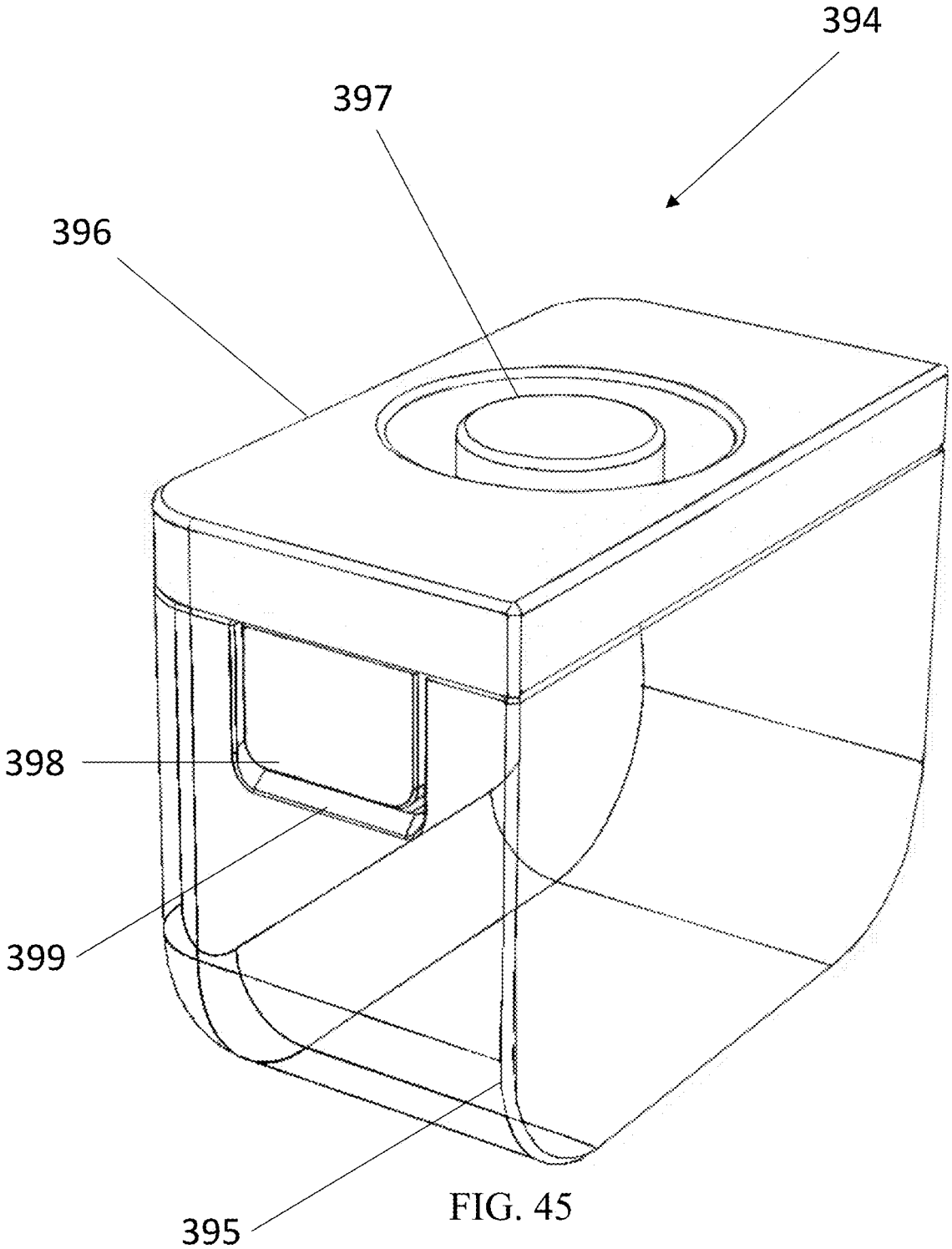
FIG. 45 is an isometric view of a fluid cartridge to be used with the control unit of FIG. 42.

FIG. 45 is an isometric view of a fluid cartridge to be used with the control unit of FIG. 42. In one embodiment, the fluid cartridge 394 includes a cap 396 configured to seal a top opening of a reservoir base 395. In one embodiment, the top surface of the cap 396 includes a circular projection 397 surrounded by a recessed ring. The circular projection 397 provides additional grip for the fluid cartridge 394 in removing the fluid cartridge 394 from the control unit 390. In one embodiment, the cap 396 is attached to at least one flap 398 configured to rest in at least one corresponding recess 399 in side wall of the reservoir base 395. In one embodiment, lifting the at least one flap 398 causes the cap 396 to detach from the reservoir base 395.

Figure 46:
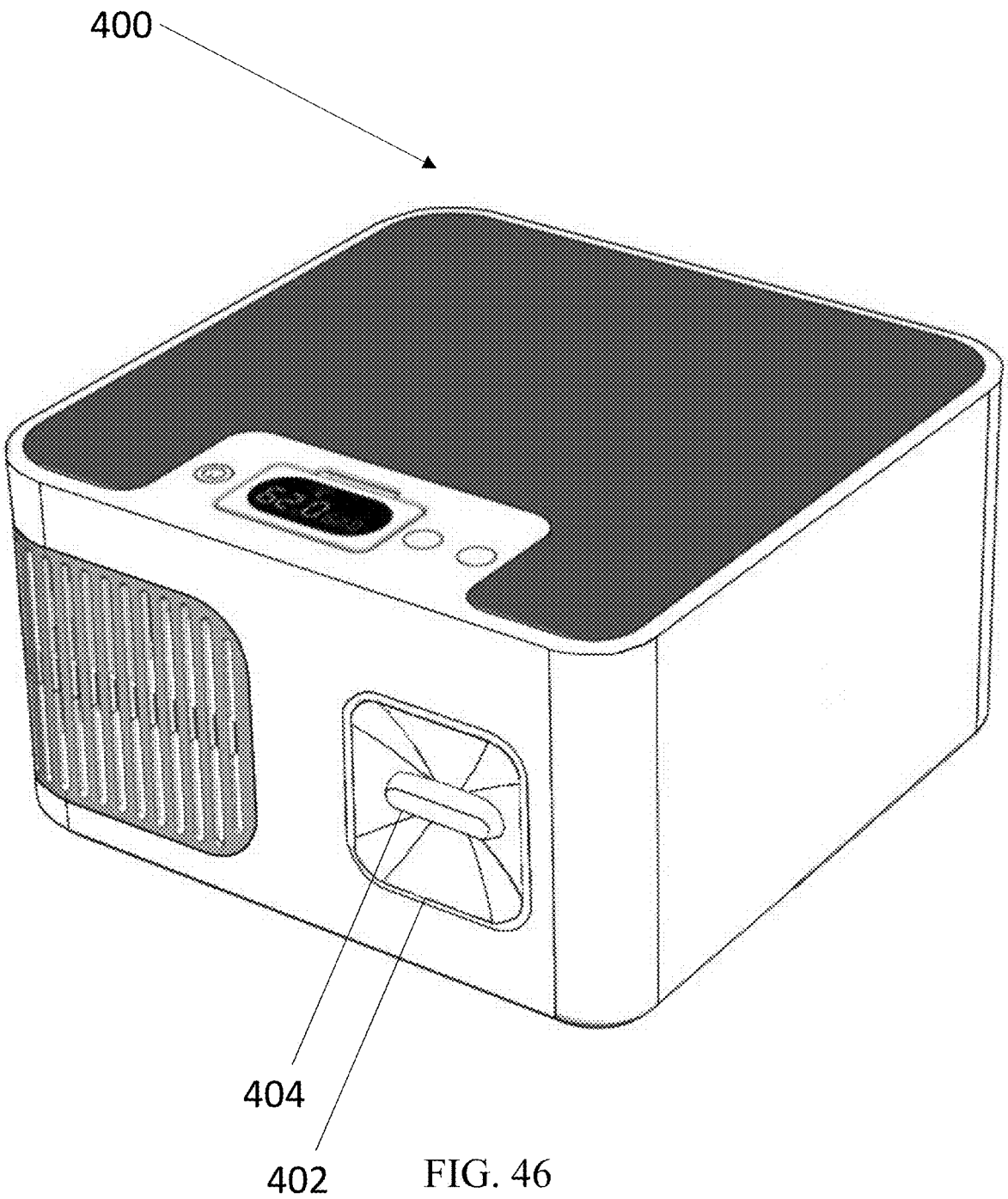
FIG. 46 is an isometric view of a control unit for a climate-control system according to one embodiment of the present invention.
Figure 47:
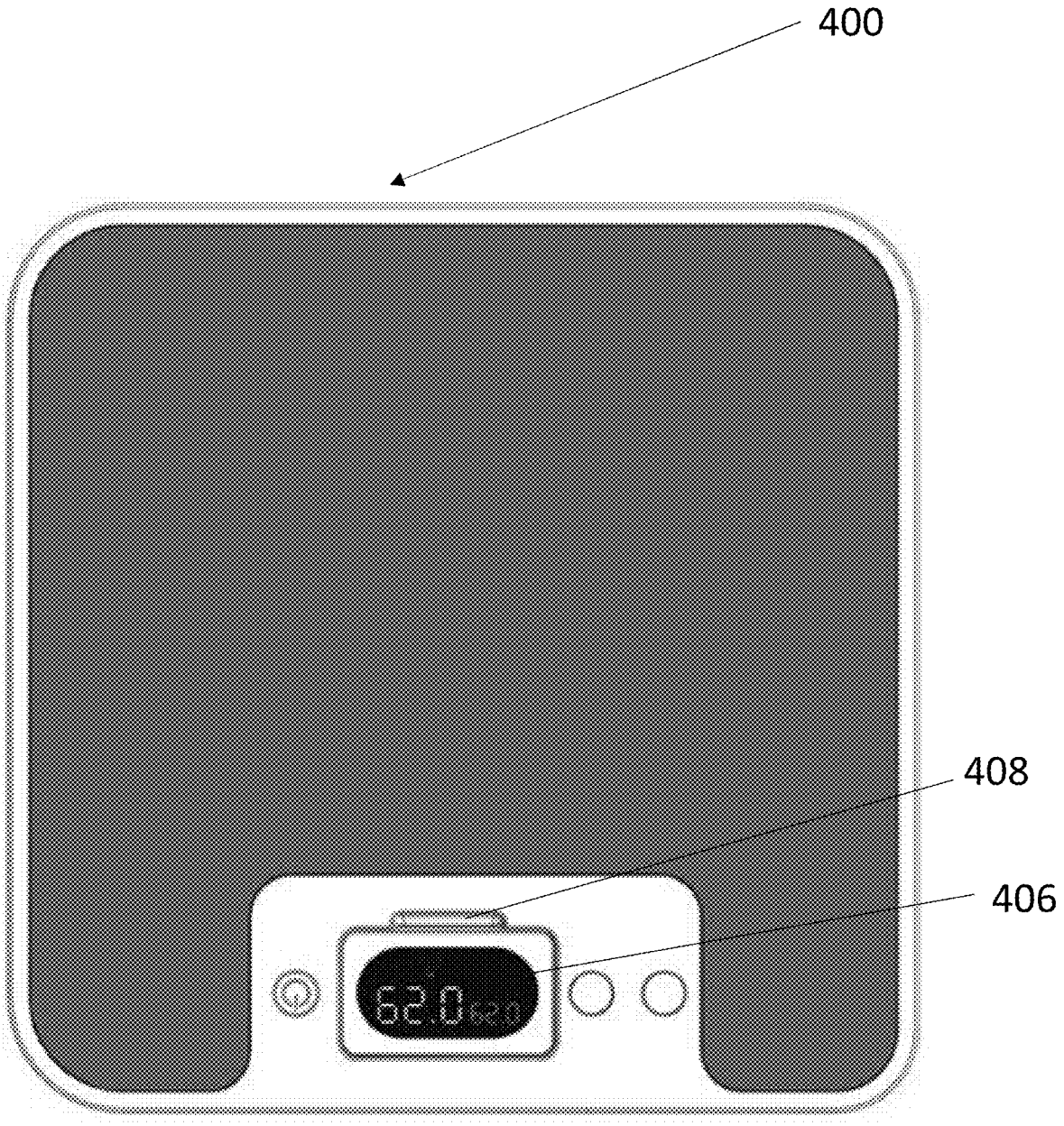
FIG. 47 is a top view of the control unit for a climate-control system of FIG. 46.
Figure 48:
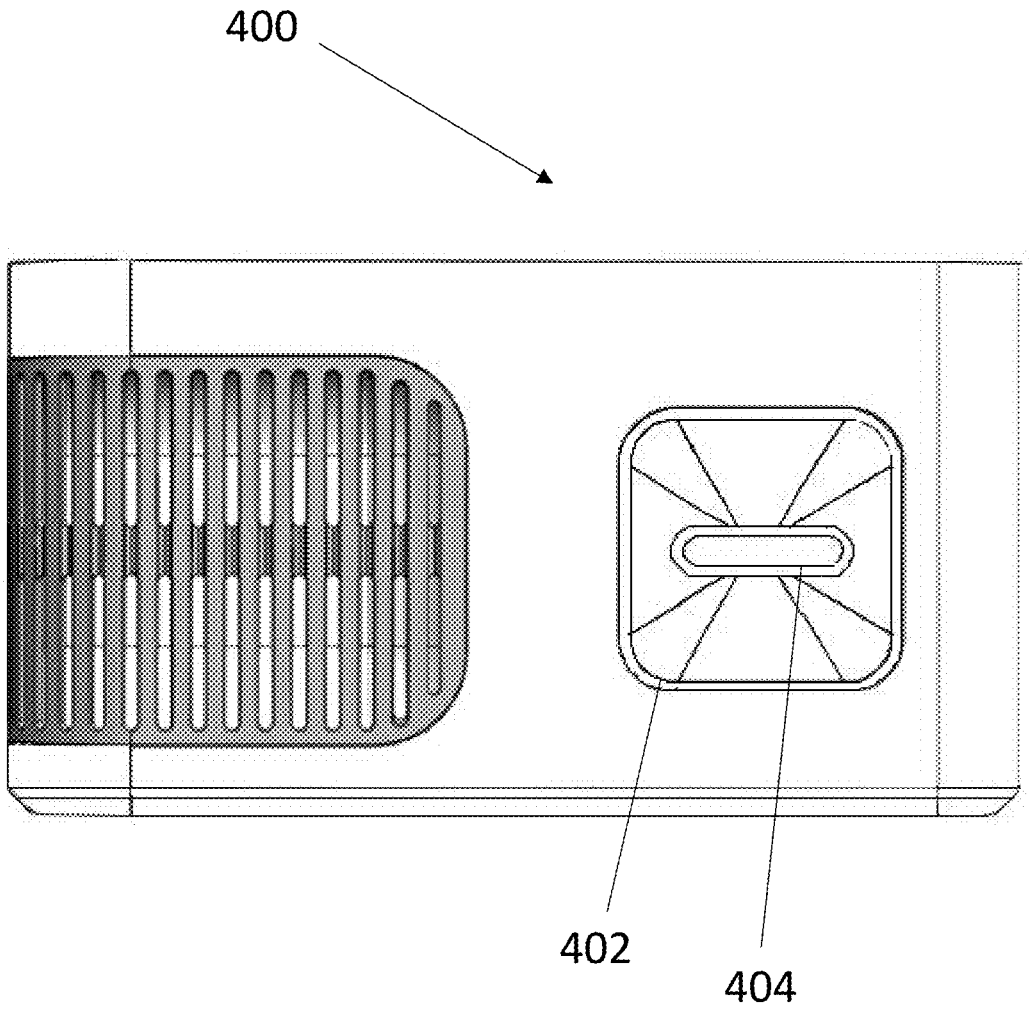
FIG. 48 is a front view of the control unit for a climate-control system of FIG. 46.

FIGS. 46-48 shows a control unit 400 having an opening in a sidewall of the control unit 400 configured to receive a fluid reservoir 402. In contrast to, for example, the control unit shown in FIGS. 16-18, the control unit 400 shown in FIGS. 46-48 does not require any opening in the top surface of the control unit 400 for a cap or reservoir. In one embodiment, a front surface of the fluid reservoir 402 includes a grip handle 404, allowing the fluid reservoir 402 to be pulled out of the control unit 400 to be refilled and/or cleaned. Additionally, FIG. 47 shows that the control unit includes a display 406 proximate to an indentation 408 in the top surface of the control unit 400. In one embodiment, the display 406 is able to lie flush with the top surface of the control unit 400. However, the display 406 is able to be lifted using the indentation 408 such that the display is at an angle (e.g., a 45 degree angle, a 90 degree angle, etc.) to the top surface of the control unit 400. This allows the display 406 to be more easily read from further away.

Figure 49:
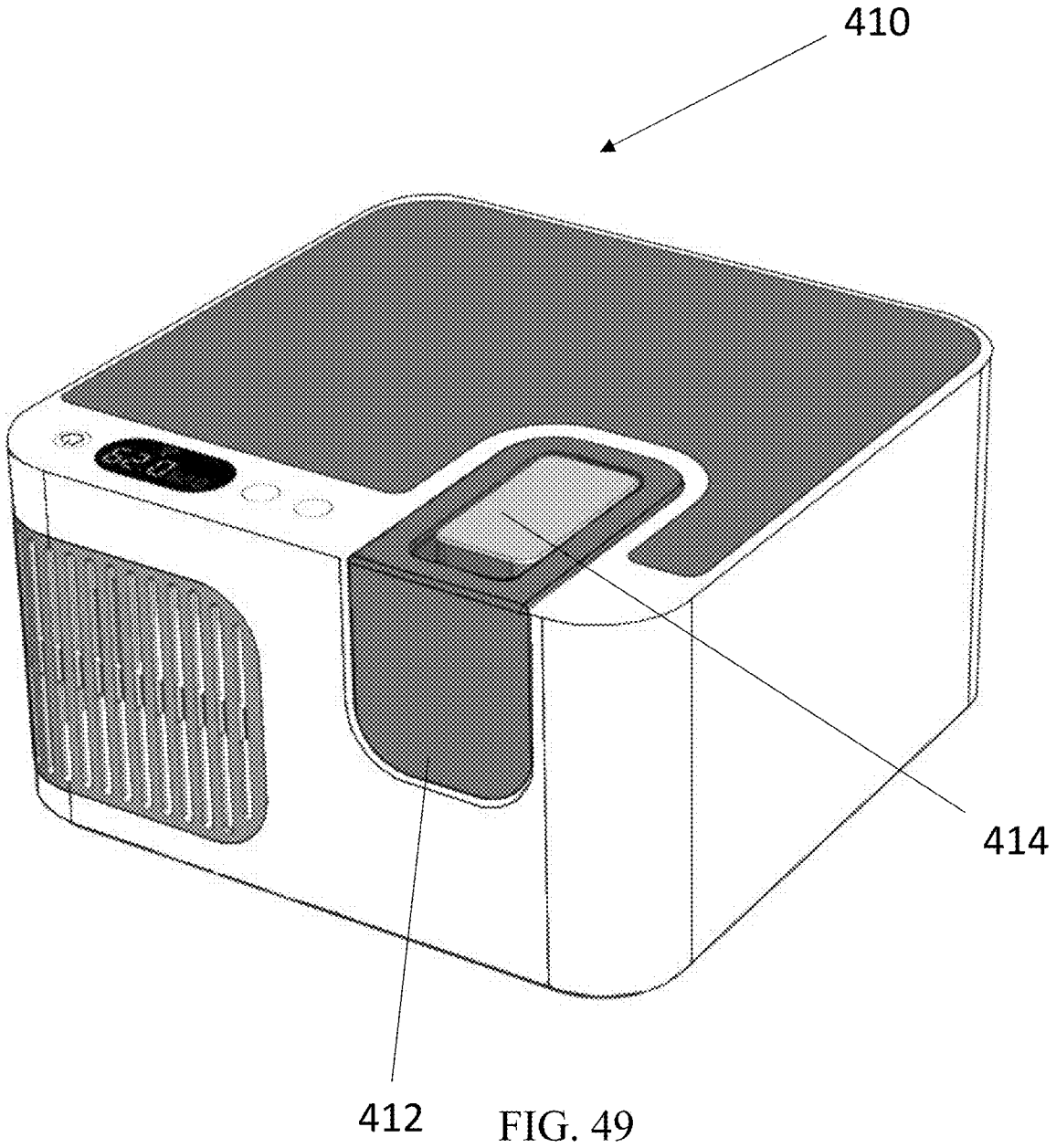
FIG. 49 is an isometric view of a control unit for a climate-control system according to one embodiment of the present invention.
Figure 50:
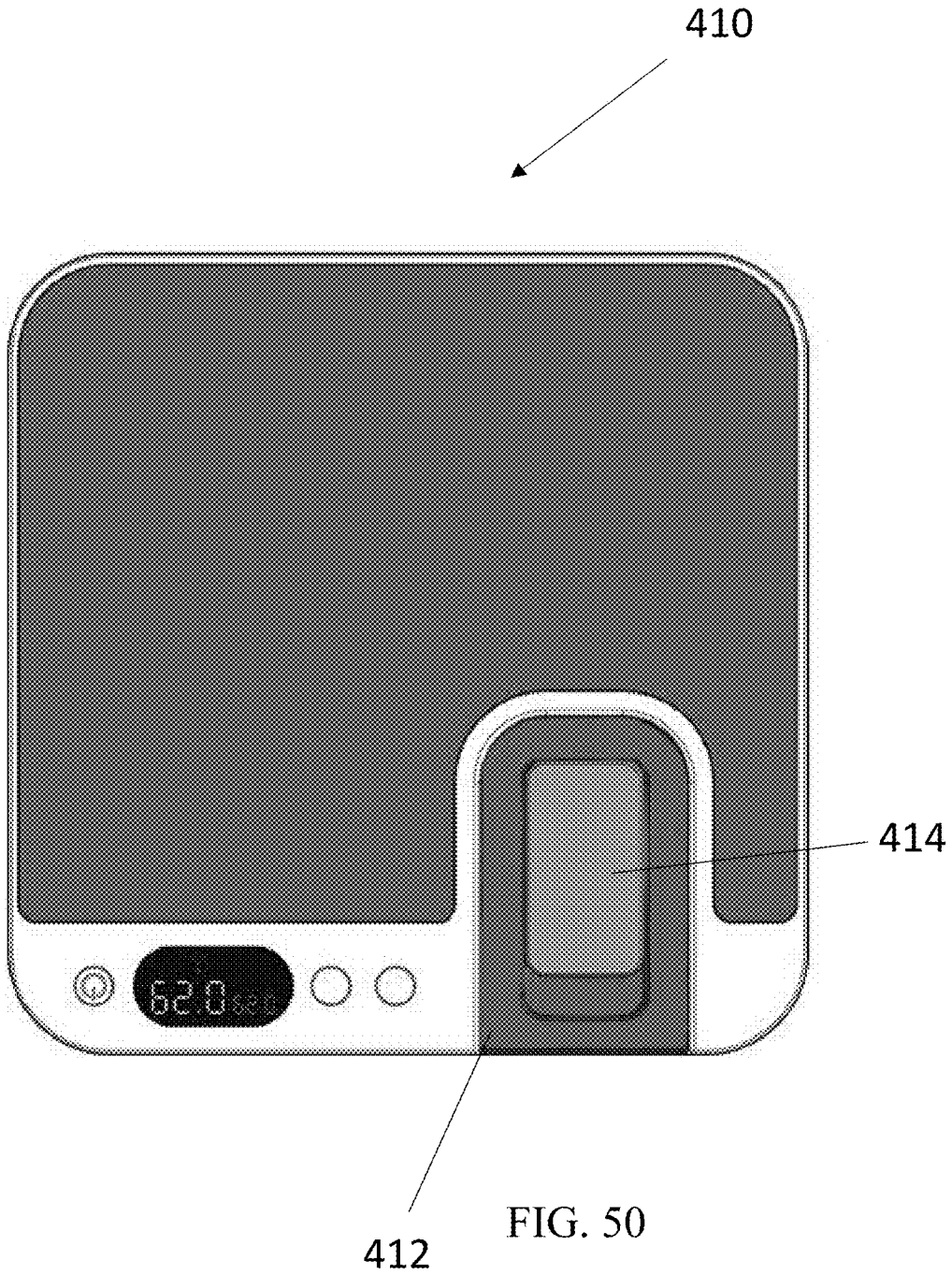
FIG. 50 is a top view of the control unit for a climate-control system of FIG. 49.
Figure 51:
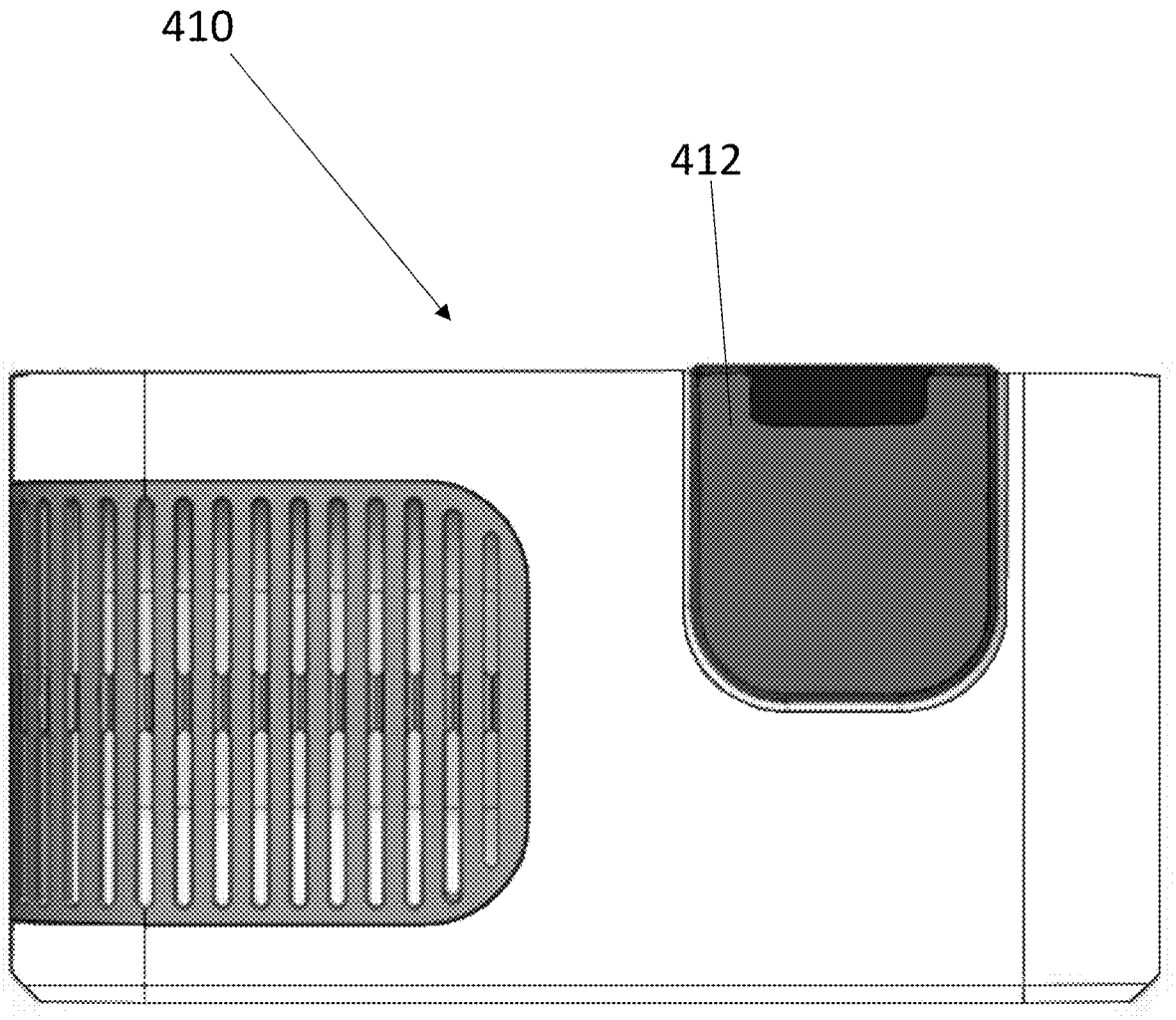
FIG. 51 is a front view of the control unit for a climate-control system of FIG. 49.

FIGS. 49-51 show a control unit 410 having a removable fluid reservoir 412. In one embodiment, the fluid reservoir 412 is able to be removed when a sliding element 414 attached to the fluid reservoir 412 is moved forward. One of ordinary skill in the art will understand that understand that the mechanisms used to remove the fluid reservoir 412 from the control unit 410 are not intended to be limiting according to the present invention.

Figure 52:
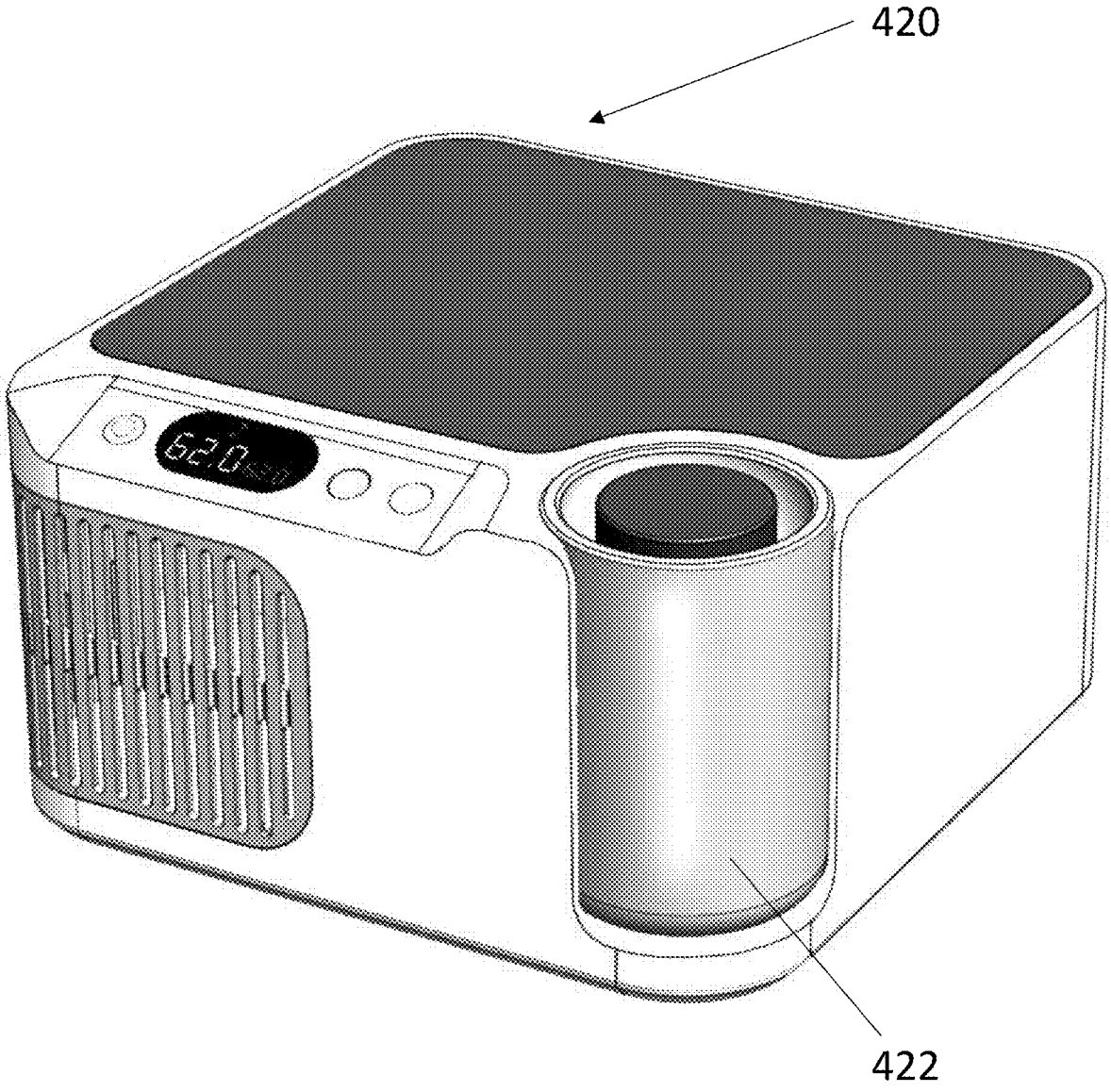
FIG. 52 is an isometric view of a control unit for a climate-control system according to one embodiment of the present invention.
Figure 53:
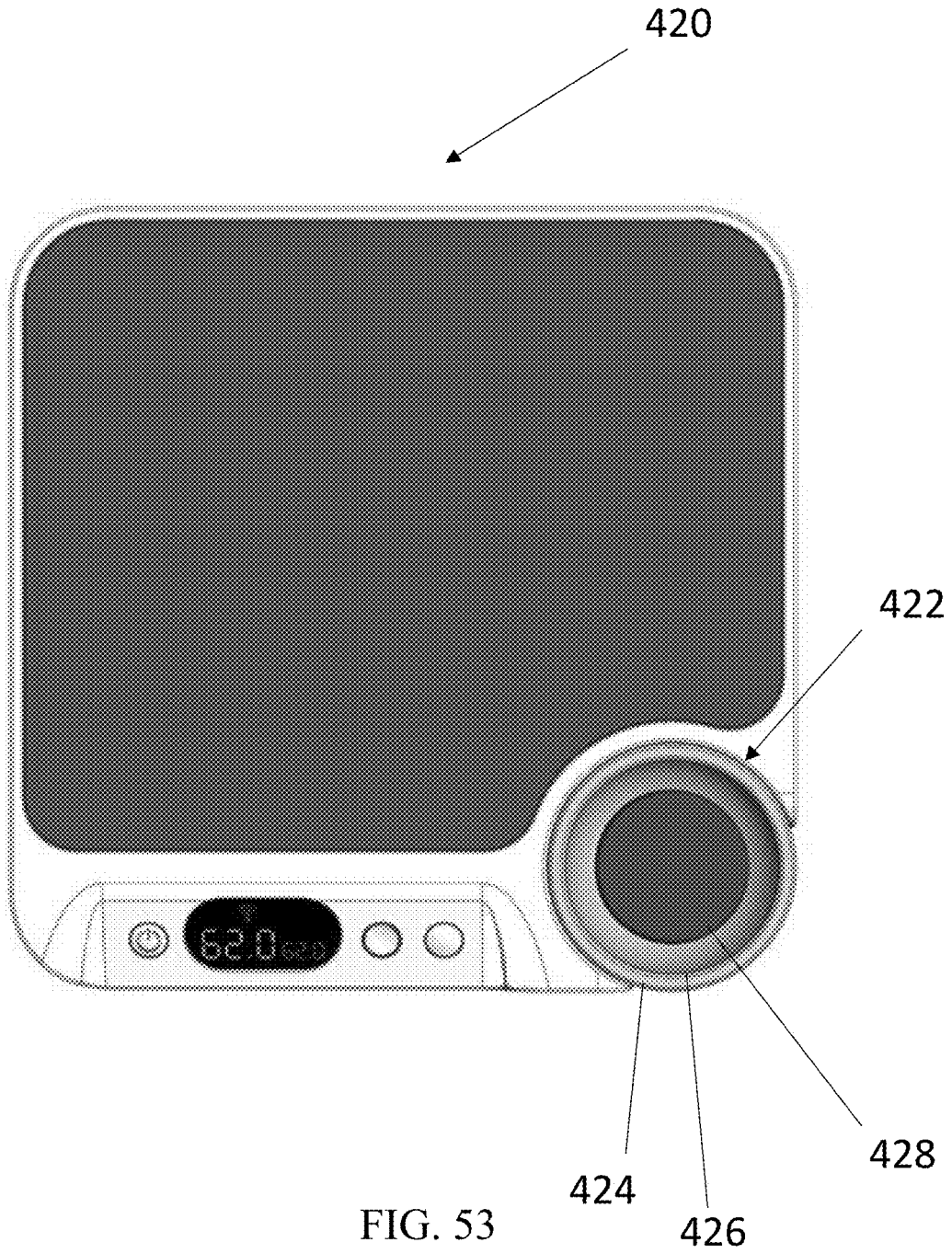
FIG. 53 is a top view of the control unit for a climate-control system of FIG. 52.
Figure 54:
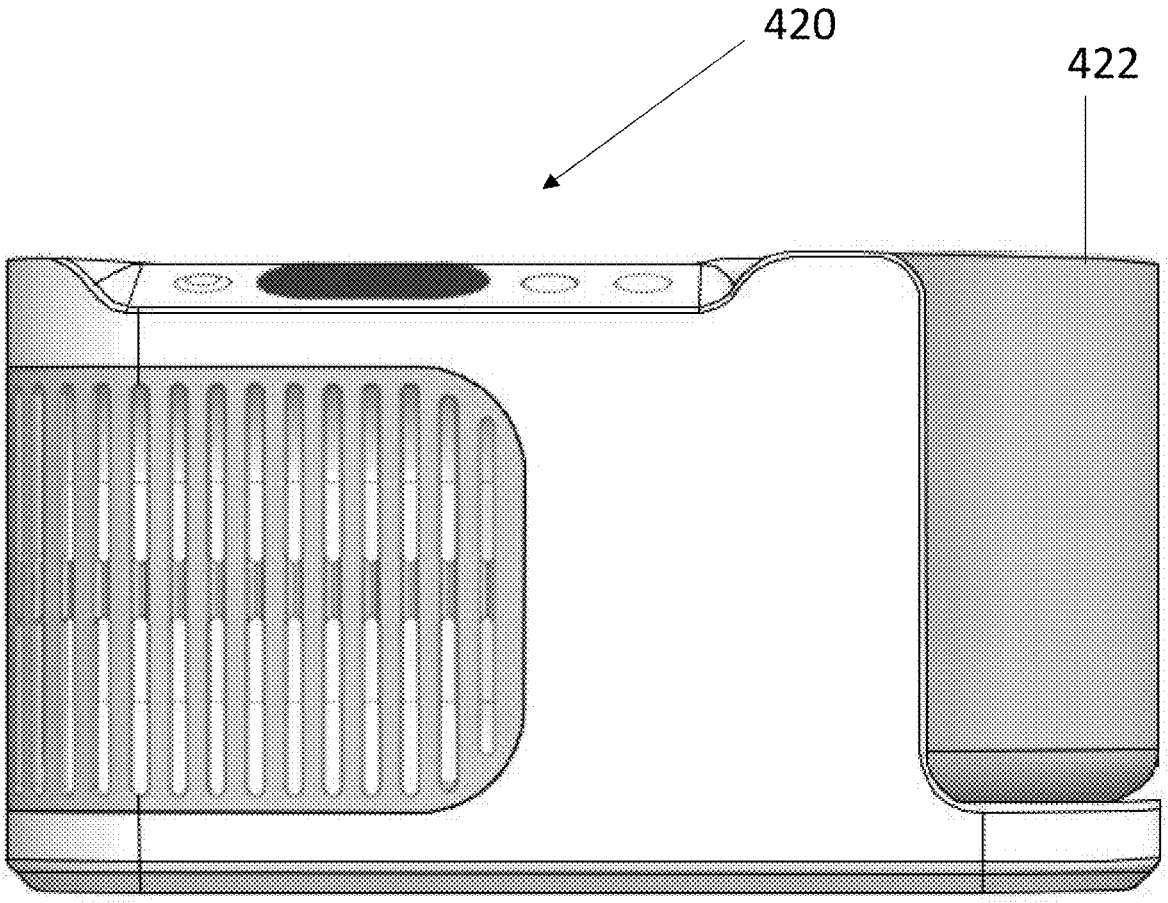
FIG. 54 is a front view of the control unit for a climate-control system of FIG. 52.

FIG. 52-54 shows a control unit 420 including a fluid reservoir 422. As shown in FIG. 53, the top surface of the fluid reservoir 422 includes a perimeter rim 424 and a central circular knob 428 separated by a recessed ring 426. In one embodiment, the central circular knob 428 is a removable cap covering an opening in the top surface of the fluid reservoir 422. The control unit 420 includes a substantially cylindrical carveout operable to reserve the fluid reservoir 422, but unlike the control unit shown, for example, in FIGS. 16-18, the control unit 420 shown in FIGS. 52-54 is not surrounded on all sides by a side wall of the control unit 420. Therefore, the fluid reservoir 422 is more easily removable by the control unit 420, as the fluid reservoir 422 does not need to be lifted vertically out of the control unit 420 in order to be removed.

Figure 55:
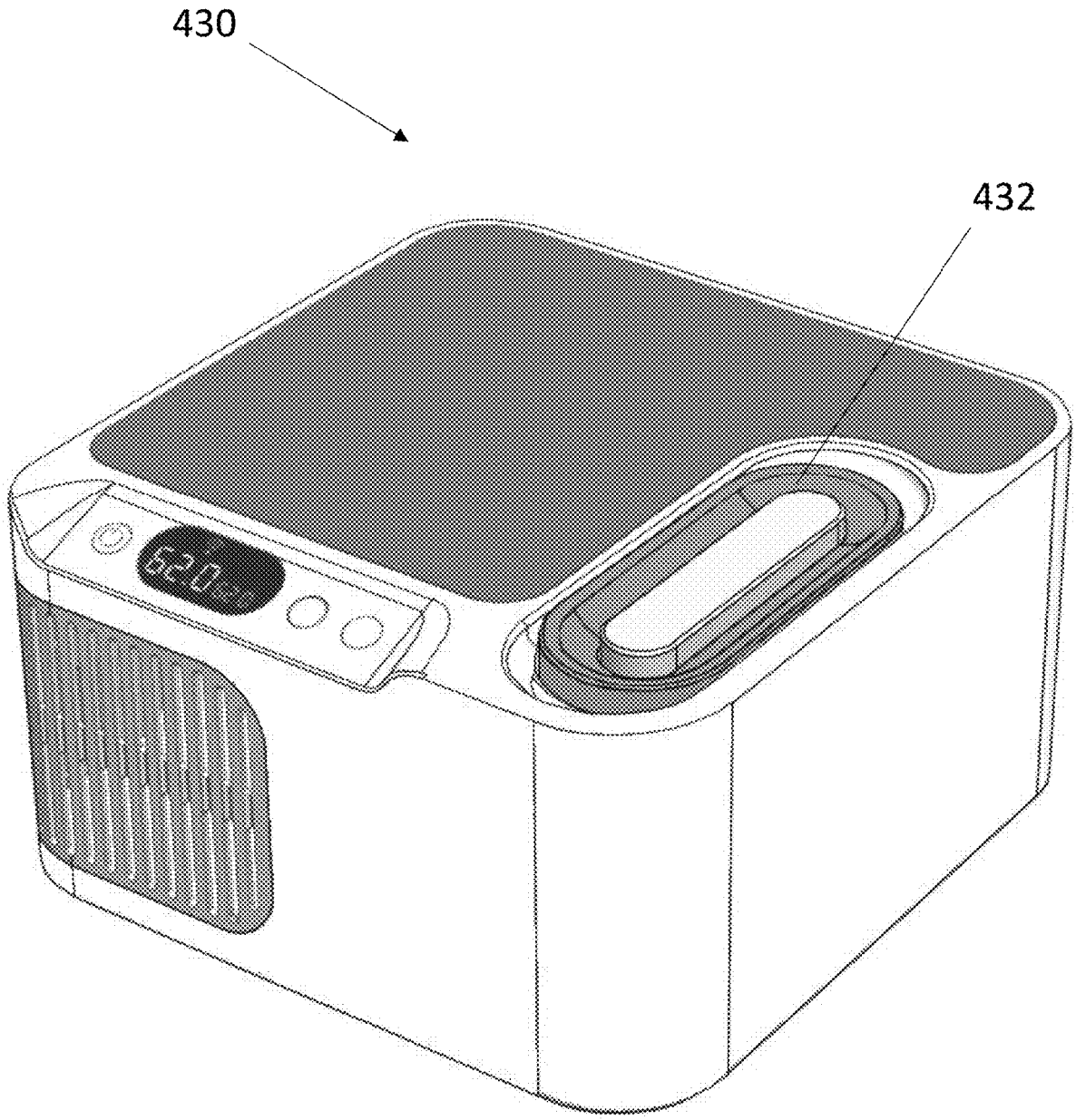
FIG. 55 is an isometric view of a control unit for a climate-control system according to one embodiment of the present invention.
Figure 56:
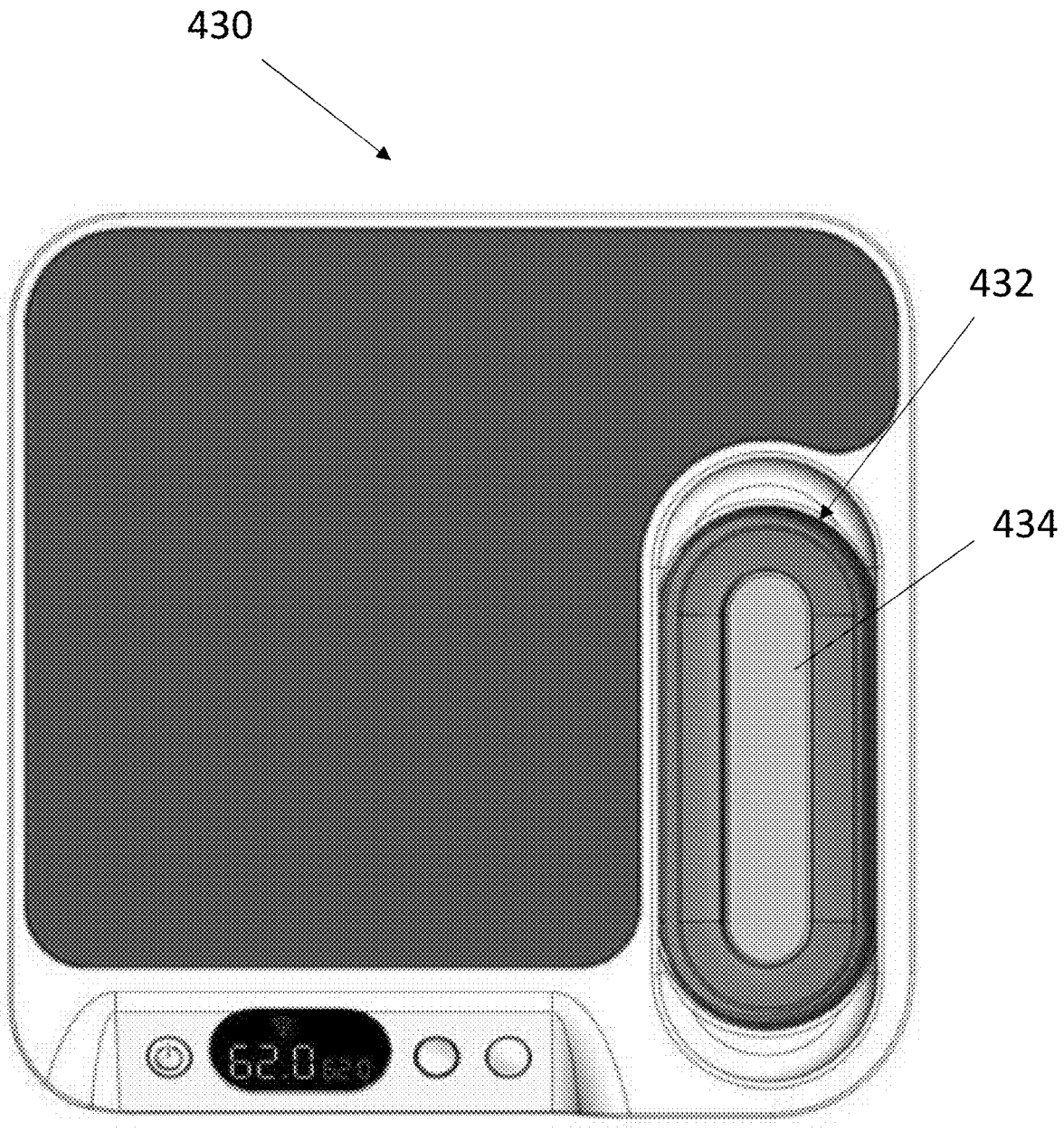
FIG. 56 is a top view of the control unit for a climate-control system of FIG. 55.

One of ordinary skill in the art will understand that the shape of the cap and the shape of the fluid reservoir covered by the cap are not intended to be limiting according to the present invention. For example, the control unit 430 shown in FIGS. 55-56 shows a cap 432 having an oblong shape and a corresponding oblong-shaped grip 434.

Figure 57:
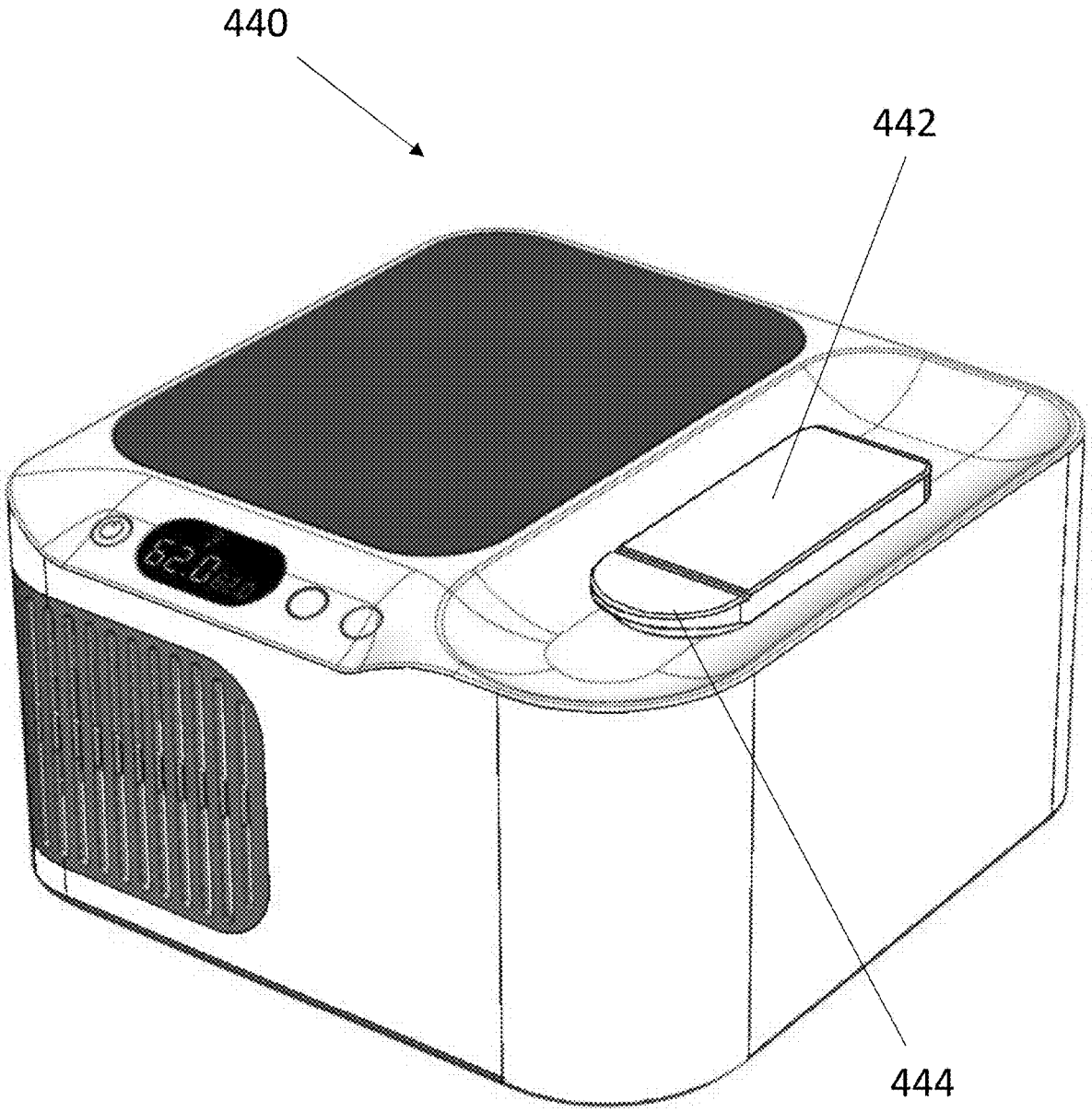
FIG. 57 is an isometric view of a control unit for a climate-control system according to one embodiment of the present invention.
Figure 58:
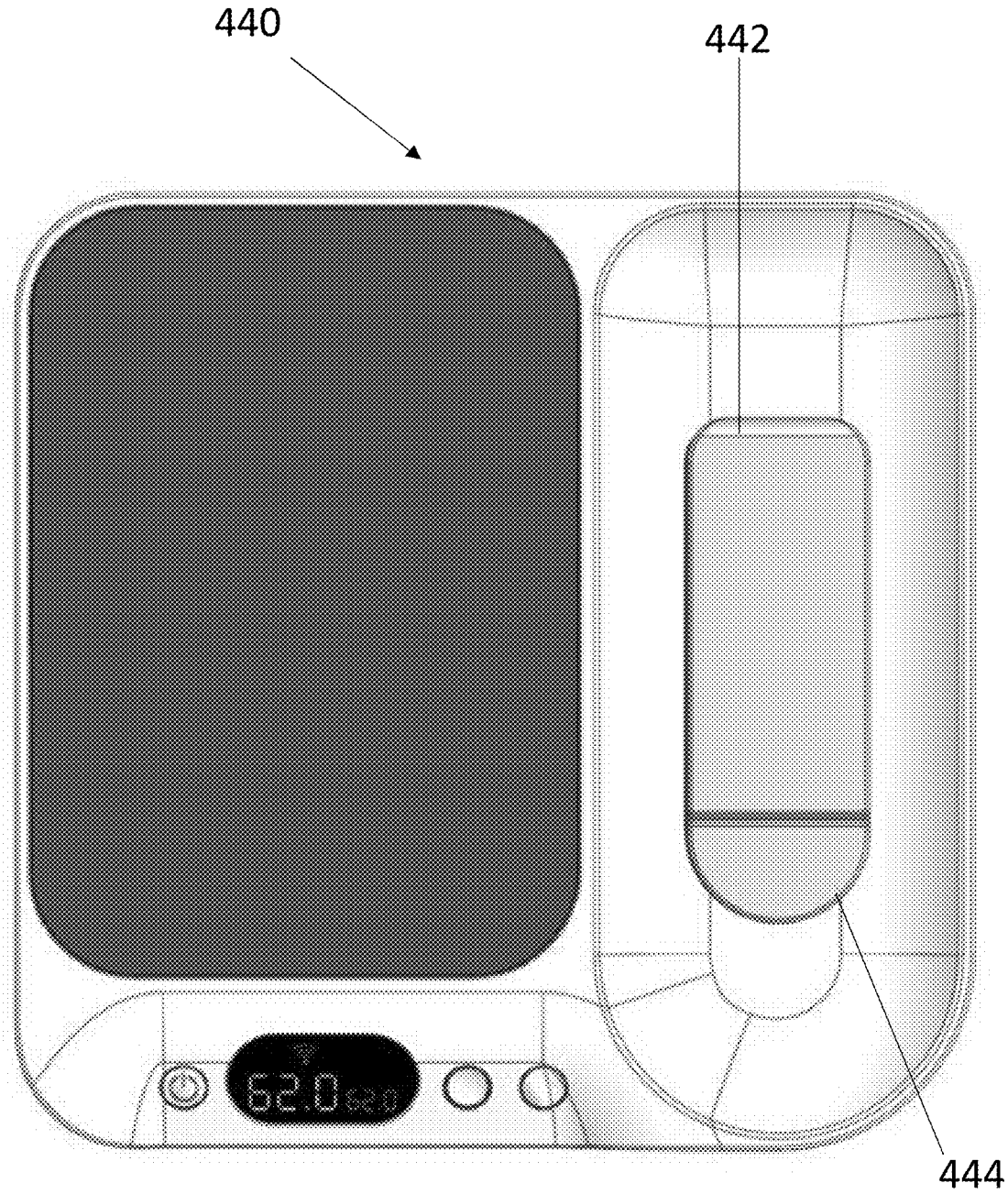
FIG. 58 is a top view of the control unit for a climate-control system of FIG. 57.

FIGS. 57-58 show a control unit 440 having a cap 442 pivotably attached to a top surface of the control unit 440. The cap 442 includes an overhang tab 444 operable to be lifted such that an opening to a fluid reservoir is able to be accessed for refilling and/or cleaning.

Figure 59:
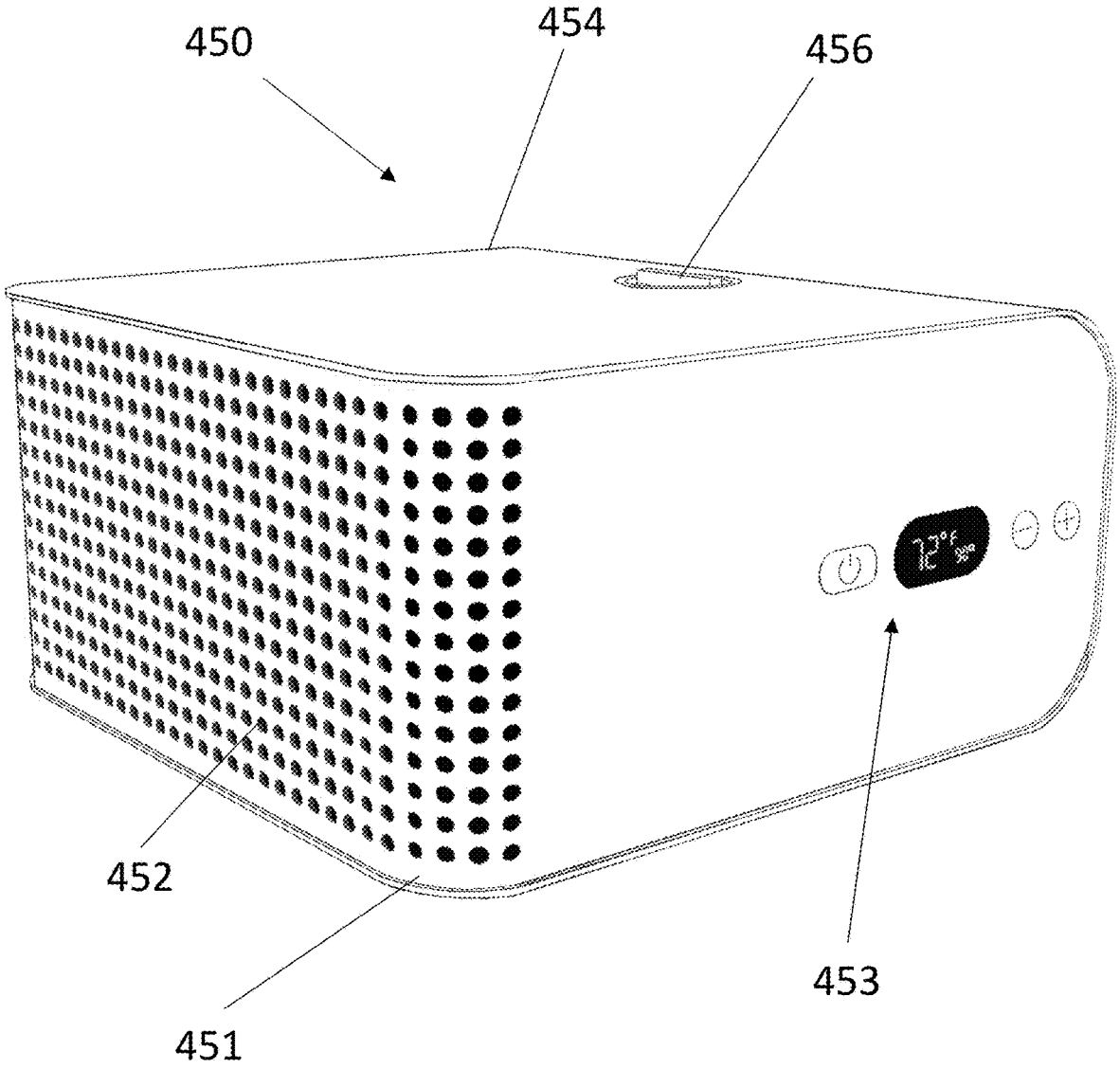
FIG. 59 is an isometric view of a control unit for a climate-control system according to one embodiment of the present invention.
Figure 60:
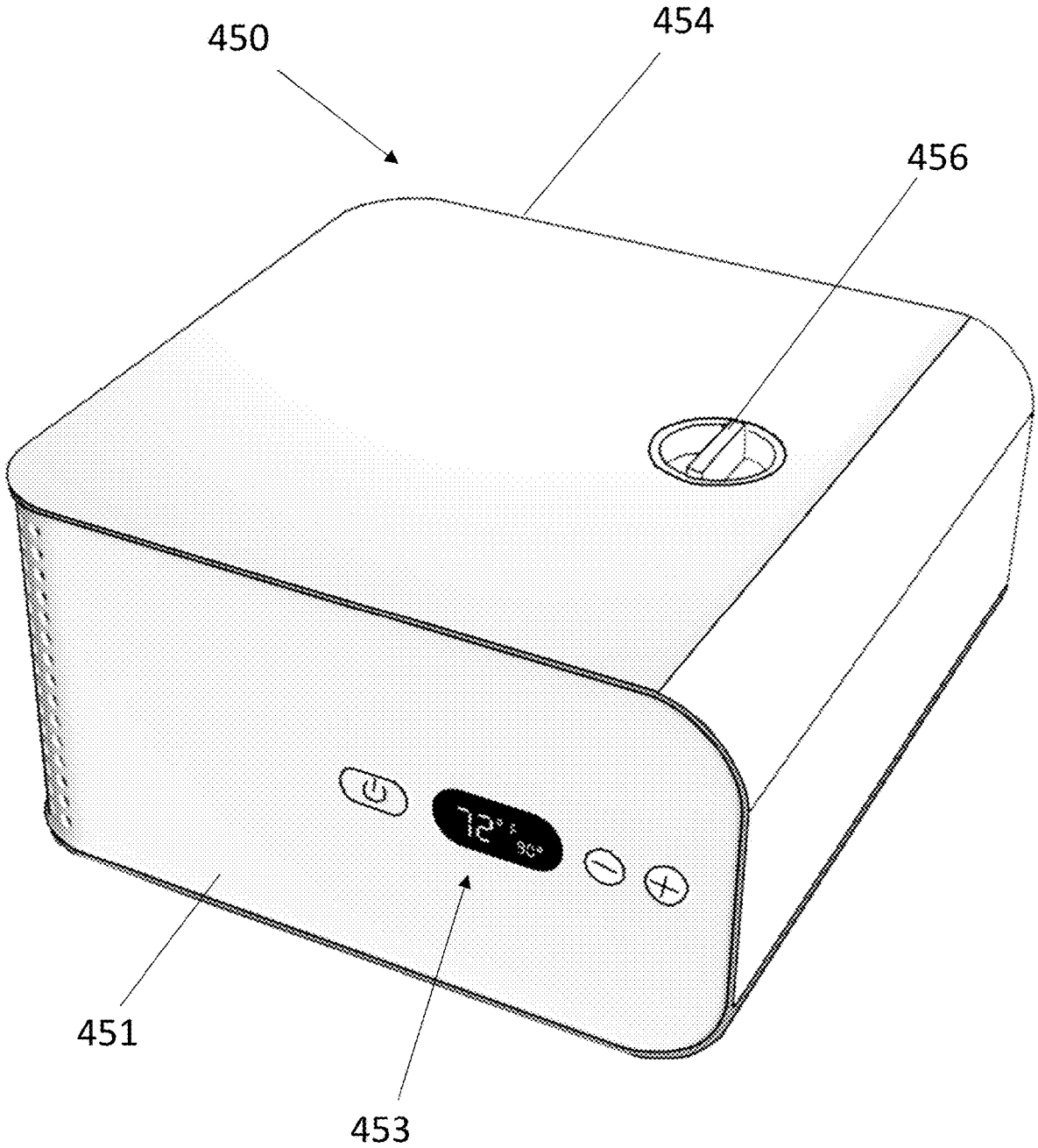
FIG. 60 is an isometric view of the control unit for a climate-control system of FIG. 59.
Figure 61:
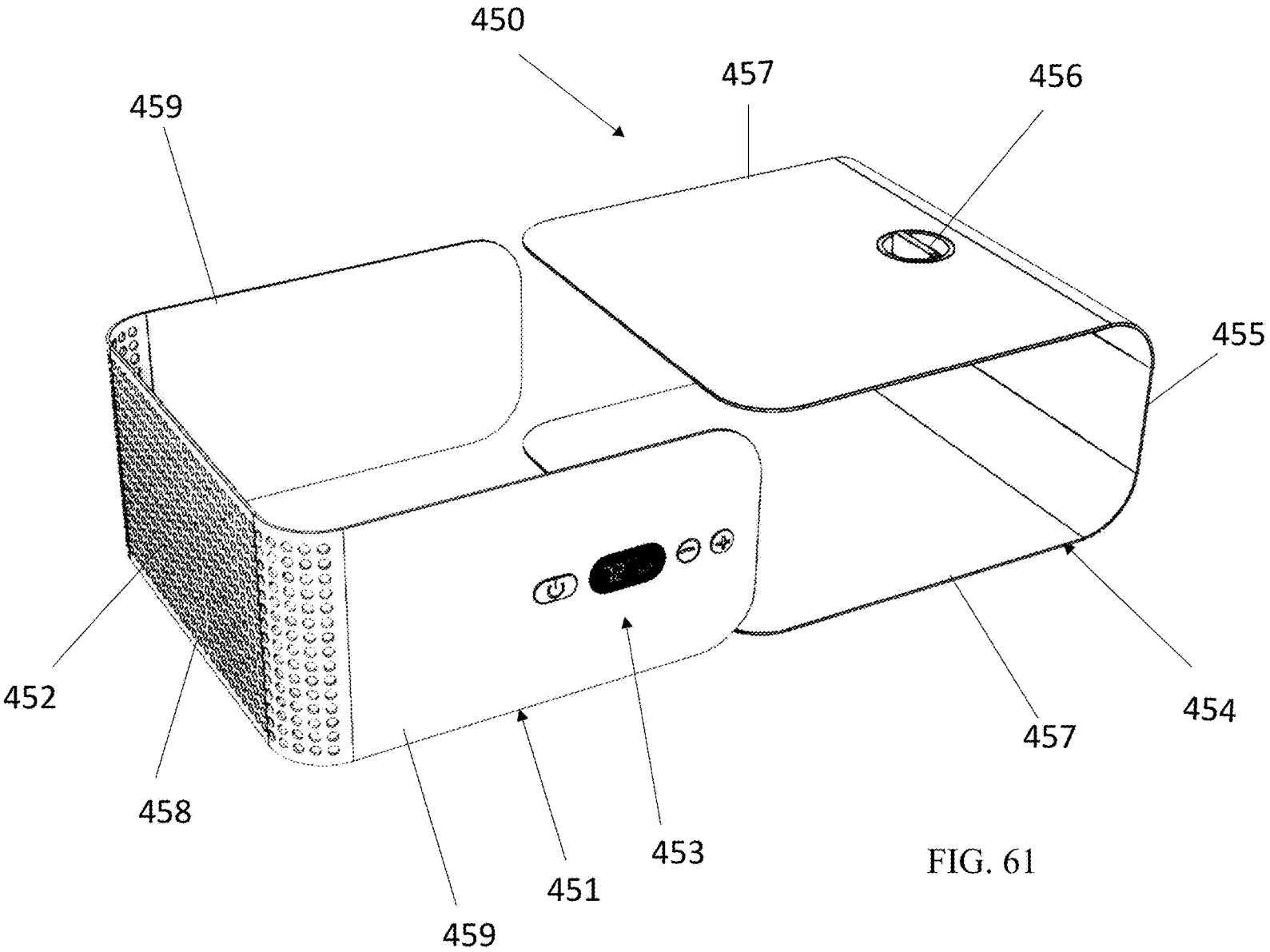
FIG. 61 is an exploded view of the control unit for a climate-control system of FIG. 59.

FIGS. 59-61 is a control unit for a climate-control system according to one embodiment of the present invention. In one embodiment, the control unit 450 includes a first component 451 and a second component 454. The first component 451 includes two substantially parallel wings 459, wherein one end of each of the substantially parallel wings 459 is connected by a bridging component 458. The substantially parallel wings 459 are therefore separated by a gap length approximately equal to the length of the bridging component 458. Similarly, the second component 454 includes two substantially parallel flaps 457 connected by a bridging connector 455 at one end of each of the substantially parallel flaps 457, and the two substantially parallel flaps 457 are therefore separated by a gap length approximately equal to the height of the bridging connector 455. When connected, the bridging component 458 and the bridging connector 455 are substantially parallel and the two substantially parallel wings 459 are substantially orthogonal to the two substantially parallel flaps 457. The first component 451 is configured such that the substantially parallel wings 459 fit within the gap between the two substantially parallel flaps 457, and, likewise, the two substantially parallel flaps 457 fit in the gap between the substantially parallel wings 459. Thus, the first component 451 and the second component 454 are matingly connected. In one embodiment, second component 454 includes a locking mechanism 456, which, when rotated (or otherwise activated), prevents the first component 451 from being separated from the second component 454. It should be noted that while not shown in FIGS. 59-61, in one embodiment, the internal components of the control unit 450 are attached to one of the substantially parallel flaps 457 of the second component 454.

In one embodiment, the bridging component 458 includes a plurality of vent openings 452. In one embodiment, the outside surface of one of the two substantially parallel wings 459 includes a control panel 453 (e.g., including a power button, a display, and/or other buttons for controlling the control unit 450).

Figure 12:
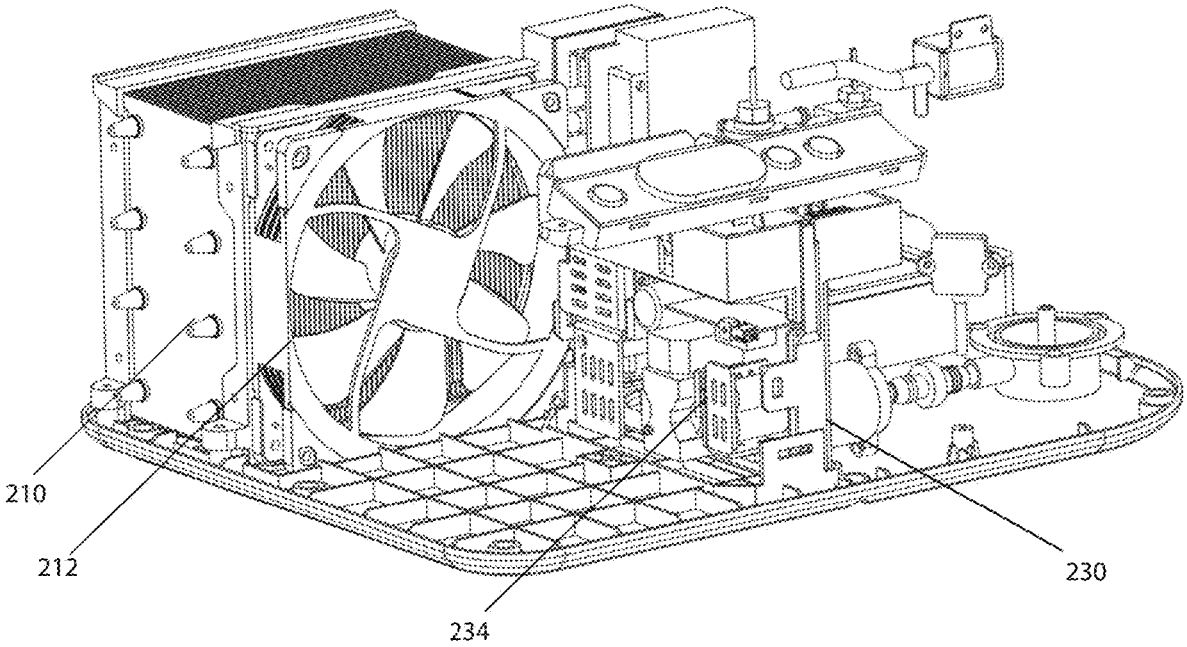
FIG. 12 is an isometric section view of a control unit for a climate-control system according to one embodiment of the present invention.

The fluid circulation system is separated from the at least one fan 212 and the at least one heat sink 210 by the partition 230, as shown in FIGS. 11 and 12. The partition 230 further houses a power supply unit 234, which generates and supplies energy to the control unit 200. Because the power supply unit 234 is located on the same side of the control unit 200 as the at least one fan 212, the at least one fan 212 provides cooling for the components of the power supply unit 234, which otherwise heat during operation of the control unit 200. The at least one fan 212 is operable to generate an air path over the at least one heat sink 210. However, the partition 230 prevents the air path from intersecting with the at least one fluid reservoir and the at least one thermoelectric module. Furthermore, in one embodiment, the air path intersect with the power supply unit 234, such that the air path cools the power supply unit 234.

In one embodiment, the control unit 200 includes at least one wireless antenna. The temperature of fluid outputted from the control unit 200 and/or a plurality of temperatures associated with a plurality of durations are able to be adjusted by at least one remote and/or at least one user device. In one embodiment, the control unit 200 is operable to communicate with the at least one remote and/or at least one user device via a wireless local area network (WLAN, e.g., WIFI, etc.), a wireless personal area network (WPAN, e.g., BLUETOOTH, ZIGBEE, etc.), a cellular network (3G, 4G, 5G, etc.), near-field communication (NFC), and/or infrared transmittal. In one embodiment, the control unit 200 and/or at least one user device are in communication with a remote server, including a global analytics engine, a calibration engine, a simulation engine, a reasoning engine, and/or a database. The global analytics engine is operable to predict values for stress-reduction and sleep promotion by generating a virtual model based on real-time data, while the calibration system modifies and updates the virtual model based on real-time data, as described in U.S. Patent Publication No. 2020/0113344, which is hereby incorporated by reference in its entirety. In one embodiment, the at least one user device includes a cellular phone, a tablet, a personal computer, a smart watch, a smart thermostat, and/or any other device operable to accept input from a user.

In one embodiment, the control unit 200 is operable to drop a temperature of fluid from 68° F. to 58° F. in less than 5.3 minutes when in a closed loop (i.e., without the mattress pad attached). In one embodiment, the closed loop consists of 14" long silicone tubing with an outer diameter of ⅜", an inner diameter of ¼", and ⅜" 90° circular plastic connector. The mattress pad 30 preferably has a rate of heat transfer of at least 200 W at a water temperature of 14.4° C. (58° F.). In another embodiment, the mattress pad 30 has a rate of heat transfer of at least 150 W at a water temperature of 14.4° C. (58° F.).

In one embodiment, the temperature modulation system 10 includes at least one sensor embedded within the temperature modulation system 10 and/or disposed on top of the temperature modulation system 10. In one embodiment, the at least one sensor includes at least one of the following: a heart rate sensor, a body weight sensor, a body temperature sensor, a pulse oximeter sensor, a respiration sensor, an electrooculography sensor, an electromyography sensor, a movement sensor, a brain wave sensor, an energy field sensor, an analyte sensor, a blood pressure sensor, and/or an electrodermal activity sensor. In another embodiment, the temperature modulation system 10 also includes at least one environmental sensor, including at least one of the following: an environmental temperature sensor, a humidity sensor, an air quality sensor, a light sensor, and/or a barometric sensor. In one embodiment, measurements taken by the at least one sensor and/or the at least one environmental sensor are used to automatically adjust the temperature of fluid output from the control unit 200.

Figure 62A:
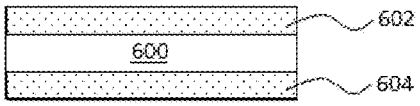
FIG. 62A illustrates a cross-section of a mattress pad with two layers of waterproof material.

FIG. 62A illustrates a cross-section of a mattress pad with two layers of waterproof material. In this embodiment, a first layer of a waterproof material 602 and a second layer of a waterproof material 604 are affixed or adhered together to form an interior chamber 600. The interior chamber 600 is constructed and configured to retain fluid without leaking. In a preferred embodiment, the first layer of the waterproof material 602 and the second layer of the waterproof material 604 are welded together (e.g., using high frequency/radio frequency (RF) welding or heat welding).

Figure 62B:
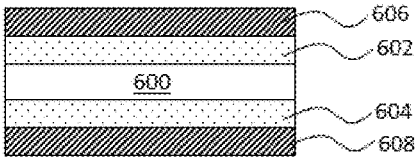
FIG. 62B illustrates a cross-section of a mattress pad with two layers of waterproof material and two layers of a second material.

FIG. 62B illustrates a cross-section of a mattress pad with two layers of waterproof material and two layers of a second material. In this embodiment, a first layer of a waterproof material 602 and a second layer of a waterproof material 604 are affixed or adhered together to form an interior chamber 600. The interior chamber 600 is constructed and configured to retain fluid without leaking. In a preferred embodiment, the first layer of the waterproof material 602 and the second layer of the waterproof material 604 are welded together (e.g., using high frequency/radio frequency (RF) welding or heat welding). A first layer of a second material 606 is on an exterior surface of the first layer of the waterproof material 602. A second layer of the second material 608 is on an exterior surface of the second layer of the waterproof material 604. In a preferred embodiment, the second material is a knit or interlock material. Alternatively, the second material is a woven or non-woven material. In yet another embodiment, the second material is formed of plastic.

Figure 62C:
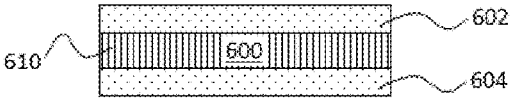
FIG. 62C illustrates a cross-section of a mattress pad with two layers of waterproof material and a spacer layer.

FIG. 62C illustrates a cross-section of a mattress pad with two layers of waterproof material and a spacer layer. In this embodiment, a first layer of a waterproof material 602 and a second layer of a waterproof material 604 are affixed or adhered together to form an interior chamber 600. The interior chamber 600 is constructed and configured to retain fluid without leaking. In a preferred embodiment, the first layer of the waterproof material 602 and the second layer of the waterproof material 604 are welded together (e.g., using high frequency/radio frequency (RF) welding or heat welding).

A spacer layer 610 is positioned within the interior chamber 600 between an interior surface of the first layer of the waterproof material 602 and an interior facing of the second layer of the waterproof material 604. The spacer layer 610 is configured to provide structural support to maintain partial channels for fluid flow through the interior chamber. In one embodiment, the fluid flows through the spacer layer. In a preferred embodiment, the spacer layer is laminated, affixed, adhered, attached, secured, or welded to the first layer of the waterproof material and/or the second layer of the waterproof material. The spacer layer is preferably made of a foam mesh or a spacer fabric. In one embodiment, the spacer layer has antimicrobial properties. In another embodiment, the spacer layer 610 is in a honeycomb shape.

Figure 62D:
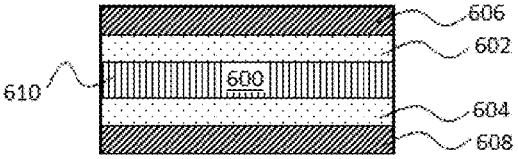
FIG. 62D illustrates a cross-section of a mattress pad with two layers of waterproof material, two layers of a second material, and a spacer layer.

FIG. 62D illustrates a cross-section of a mattress pad with two layers of waterproof material, two layers of a second material, and a spacer layer. In this embodiment, a first layer of a waterproof material 602 and a second layer of a waterproof material 604 are affixed or adhered together to form an interior chamber 600. The interior chamber 600 is constructed and configured to retain fluid without leaking. In a preferred embodiment, the first layer of the waterproof material 602 and the second layer of the waterproof material 604 are welded together (e.g., using high frequency/radio frequency (RF) welding or heat welding). A first layer of a second material 606 is on an exterior surface of the first layer of the waterproof material 602. A second layer of the second material 608 is on an exterior surface of the second layer of the waterproof material 604. In a preferred embodiment, the second material is a knit or interlock material. Alternatively, the second material is a woven or non-woven material. In yet another embodiment, the second material is formed of plastic.

A spacer layer 610 is positioned within the interior chamber 600 between an interior surface of the first layer of the waterproof material 602 and an interior facing of the second layer of the waterproof material 604. The spacer layer 610 is configured to provide structural support to maintain partial channels for fluid flow through the interior chamber. In one embodiment, the fluid flows through the spacer layer. In a preferred embodiment, the spacer layer is laminated, affixed, adhered, attached, secured, or welded to the first layer of the waterproof material and/or the second layer of the waterproof material. The spacer layer is preferably made of a foam mesh or a spacer fabric. In one embodiment, the spacer layer has antimicrobial properties.

As previously described, the mattress pad includes two layers of a waterproof material and at least one additional layer of a second material in one embodiment. Although FIGS. 62B and 62D illustrate a first layer of the second material 606 and a second layer of the second material 608, in one embodiment, the first layer of the second material 606 is present without the second layer of the second material 608. Alternatively, the second layer of the second material 608 is present without the first layer of the second material 606.

In another embodiment, the mattress pad includes at least one layer of a thermally reflective and/or an insulating material (e.g., lyocell, such as TENCEL). In one embodiment, the first layer of the second material 606 and/or the second layer of the second material 608 is a thermally reflective and/or the insulating material. In another embodiment, the thermally reflective and/or the insulating material is positioned between the second layer of the waterproof material 604 and the second layer of the second material 608. In yet another embodiment, the thermally reflective and/or the insulating material is positioned between the first layer of the waterproof material 602 and the first layer of the second material 606.

In one embodiment, the mattress pad absorbs heat from the mattress. Advantageously, providing the thermally reflective and/or the insulating material between the waterproof layer of the mattress pad and the mattress reduces the thermal demand on the cooling unit without impacting the rate of heat transfer from the occupant.

Figure 63:
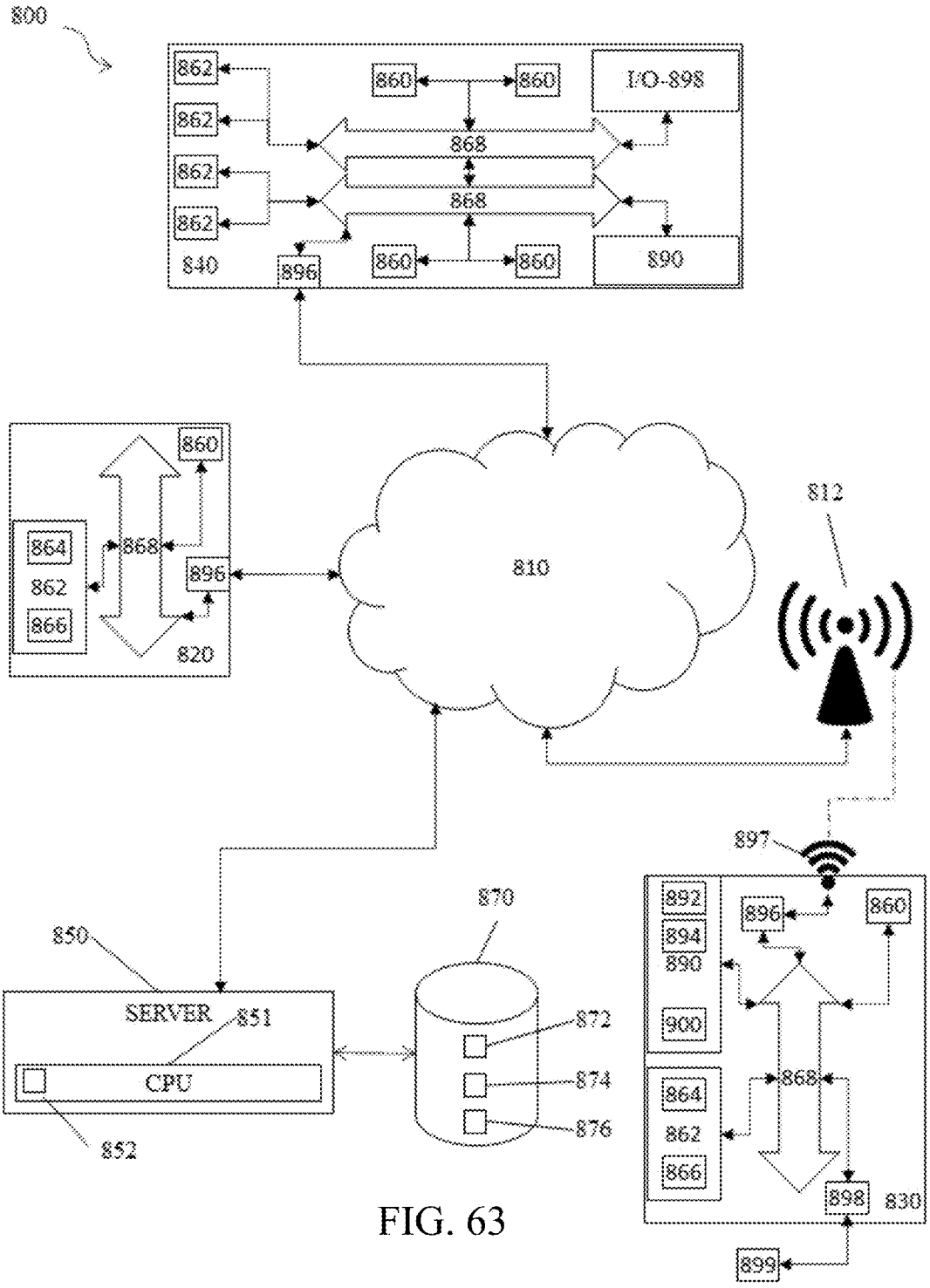
FIG. 63 is a schematic diagram of a system of the present invention.

FIG. 63 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that is able to perform calculations, process instructions for execution, and/or other manipulations of information.

In another implementation, shown as 840 in FIG. 63, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 63, is operable to include other components that are not explicitly shown in FIG. 63, or is operable to utilize an architecture completely different than that shown in FIG. 63. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by any claims appended hereto and the equivalents thereof.

The invention claimed is:

1. A system for heating or cooling a fluid, comprising:

a control unit comprising a first section and a second section;

wherein the first section of the control unit comprises a fluid reservoir connected to a pump;

wherein the pump is disposed downstream of the fluid reservoir and upstream of a thermoelectric heating/cooling device, the pump being operable to move the fluid from the fluid reservoir into the thermoelectric heating/cooling device that is thermally coupled to the fluid;

wherein the thermoelectric heating/cooling device includes first and second opposed heat-exchange sides and a set of current-conducting nodes that, when energized, cause the device to heat and/or cool the fluid;

wherein the second section of the control unit comprises a heat sink connected to the thermoelectric heating/cooling device and a fan;

wherein the fan generates an air path over the heat sink; and wherein a partition separates the first section from the second section, such that the air path generated by the fan does not intersect the fluid reservoir or the thermoelectric heating/cooling device.

2. The system of claim 1, wherein the second section of the control unit comprises a power supply circuit operable to supply electrical power to the control unit, and wherein the air path generated by the fan intersects with the power supply circuit.

3. The system of claim 1, wherein the fluid is water.

4. The system of claim 1, wherein the control unit comprises a fluid outlet line, wherein the fluid outlet line is connected to a thermally-regulated article, and wherein, when the fluid exits the thermoelectric heating/cooling device, the fluid enters the fluid outlet line, and subsequently enters the thermally-regulated article.

5. The system of claim 4, wherein the control unit comprises a fluid inlet line, wherein the fluid inlet line is connected to the thermally-regulated article and to the pump, and wherein the fluid enters the fluid inlet line after exiting the thermally-regulated article.

6. The system of claim 1, wherein the pump is disposed downstream of the fluid reservoir and upstream of an accumulator.

7. The system of claim 6, wherein the pump moves the fluid from the fluid reservoir into the accumulator, and further comprising a second pump disposed downstream of the accumulator and upstream of the thermoelectric heating/cooling device, wherein the second pump moves the fluid from the accumulator into the thermoelectric heating/cooling device.

8. The system of claim 1, wherein the thermoelectric heating/cooling device comprises at least one Peltier device.

9. The system of claim 1, wherein the control unit comprises a plurality of outlet lines and a plurality of inlet lines, wherein the fluid moves out of the control unit through one of the plurality of outlet lines and returns to the control unit through a corresponding one of the plurality of inlet lines, wherein each inlet line is connected to one of a plurality of separate pumps, and wherein the plurality of separate pumps move the fluid into the thermoelectric heating/cooling device.

10. The system of claim 9, wherein the fluid exiting the control unit through each of the plurality of outlet lines and returning through each of the plurality of inlet lines is substantially separated from the fluid exiting through different outlet lines and returning through different inlet lines.

11. A system for heating or cooling a fluid, comprising:

a control unit comprising a first section and a second section;

a thermally-regulated article connected to the control unit by tubing and configured to receive the fluid from and return the fluid to the control unit via the tubing;

wherein the first section of the control unit comprises a fluid reservoir connected to an accumulator;

wherein the accumulator is connected to a pump;

wherein the pump is disposed downstream of the accumulator and upstream from a thermoelectric heating/cooling device, and the pump is operable to move the fluid from the accumulator into the thermoelectric heating/cooling device that is thermally coupled to the fluid;

wherein the thermoelectric heating/cooling device includes first and second opposed heat-exchange sides and a set of current-conducting nodes that, when energized, cause the device to heat and/or cool the fluid;

wherein the second section of the control unit comprises a heat sink connected to the thermoelectric heating/cooling device and a fan; and wherein the accumulator is operable to receive the fluid returning from the thermally-regulated article.

12. The system of claim 11, wherein the fluid is water.

13. The system of claim 11, wherein the thermoelectric heating/cooling device comprises one or more Peltier chips.

14. The system of claim 11, further comprising a second pump disposed along a fluid flow path downstream of the fluid reservoir and upstream of the accumulator, the second pump operable to move the fluid from the fluid reservoir into the accumulator.

15. The system of claim 11, further comprising a partition separating the first section from the second section, such that an air path generated by the fan does not intersect the fluid reservoir or the thermoelectric heating/cooling device.

* * * * *